US009233534B2

(12) United States Patent
Koga et al.

(10) Patent No.: US 9,233,534 B2
(45) Date of Patent: Jan. 12, 2016

(54) DROPLET-DISCHARGING HEAD, IMAGE-FORMING DEVICE, AND METHOD FOR POSITIONING HEAD MODULES OF DROPLET-DISCHARGING HEAD

(71) Applicant: FUJIFILM Corporation, Tokyo (JP)

(72) Inventors: Takehiko Koga, Ashigarakami-gun (JP); Tsutomu Kusakari, Ashigarakami-gun (JP); Makoto Takeuchi, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/676,768

(22) Filed: Apr. 1, 2015

(65) Prior Publication Data

US 2015/0202867 A1 Jul. 23, 2015

Related U.S. Application Data

(63) Continuation of application No. PCT/JP2013/076896, filed on Oct. 3, 2013.

(30) Foreign Application Priority Data

Oct. 5, 2012 (JP) ..... 2012-223366

(51) Int. Cl.
*B41J 2/14* (2006.01)
*B41J 2/155* (2006.01)
*B41J 25/34* (2006.01)

(52) U.S. Cl.
CPC .. *B41J 2/14* (2013.01); *B41J 2/155* (2013.01); *B41J 25/34* (2013.01); *B41J 2202/14* (2013.01)

(58) Field of Classification Search
CPC ..... B41J 2/14427; B41J 29/393; B41J 2/155; B41J 2/04505; B41J 2002/14362; B41J 2202/19; B41J 2202/21; B41J 2/04506; B41J 25/308; B41J 2/2135; B41J 11/008; B41J 2/16585; B41J 2/2146; B41J 3/543
USPC ..... 347/14, 19, 20, 40, 42–44, 49
See application file for complete search history.

(56) References Cited

U.S. PATENT DOCUMENTS 6,213,580 B1 * 4/2001 Segerstrom et al. ..... 347/19
7,014,289 B1 * 3/2006 Matsuda ..... 347/19

(Continued)

FOREIGN PATENT DOCUMENTS

JP 2005-329595 A 12/2005
JP 2008-062534 A 3/2008

(Continued)

OTHER PUBLICATIONS

International Search Report; PCT/JP2013/076896; Jan. 7, 2014.

(Continued)

*Primary Examiner* — Thinh Nguyen
(74) *Attorney, Agent, or Firm* — Studebaker & Brackett PC

(57) ABSTRACT

Provided are a droplet-discharging head, a droplet-discharging device, and a method for positioning head modules of the droplet-discharging head in which the job of adjusting head module installation positions can be easily performed. In an ink jet head (200) configured by linking multiple head modules (210) together, each head modules (210) is mounted on a base frame (212) supported by a head module support unit provided on the base frame (212). The mounting positions of the head modules (210) in an X-direction mounted on the base frame (212) are individually adjusted by X-directional mounting position adjustment unit. The amounts of displacement of the head modules (210) here are detected by displacement detection unit.

18 Claims, 19 Drawing Sheets

(56) References Cited

U.S. PATENT DOCUMENTS

| | | | | |
|---|---|---|---|---|
| 7,407,267 | B2 | 8/2008 | Enomoto et al. | |
| 8,425,007 | B2 * | 4/2013 | Essen | 347/49 |
| 8,585,190 | B2 | 11/2013 | Hiratsuka et al. | |
| 2010/0225694 | A1 | 9/2010 | Suzuki | |

FOREIGN PATENT DOCUMENTS

| | | | |
|---|---|---|---|
| JP | 2008-062583 | A | 3/2008 |
| JP | 2008-194972 | A | 8/2008 |
| JP | 2010-125806 | A | 6/2010 |
| JP | 2010-201790 | A | 9/2010 |
| JP | 2011-136507 | A | 7/2011 |
| JP | 2012-000930 | A | 1/2012 |
| JP | 2012-016904 | A | 1/2012 |

OTHER PUBLICATIONS

Written Opinion of the International Searching Authority; PCT/JP2013/076896; Jan. 7, 2014.

International Preliminary Report on Patentability; PCT/JP2013/076896; Jan. 15, 2015.

* cited by examiner

DROPLET-DISCHARGING HEAD, IMAGE-FORMING DEVICE, AND METHOD FOR POSITIONING HEAD MODULES OF DROPLET-DISCHARGING HEAD

CROSS-REFERENCE TO RELATED APPLICATIONS

This application is a Continuation of PCT International Application No. PCT/JP2013/076896 filed on Oct. 3, 2013, which claims priority under 35 U.S.C §119(a) to Patent Application No. 2012-223366 filed in Japan on Oct. 5, 2012, all of which are hereby expressly incorporated by reference into the present application.

BACKGROUND OF THE INVENTION

1. Field of the Invention

The present invention relates to a droplet-discharging head, an image-forming device, and a method for positioning head modules of the droplet-discharging head. In particular, the present invention relates to a droplet-discharging head configured such that a plurality of head modules is arranged, an image-forming device, and a method for positioning head modules of the droplet-discharging head. The head modules have nozzle surfaces on which a plurality of nozzles is arranged.

2. Description of the Related Art

By discharging minute ink droplets of ink from the nozzles toward a recording medium, an ink jet recording apparatus is known as an image-forming device for forming an image on a recording medium.

The ink jet recording apparatus is roughly classified into a serial type and a line type. In the serial type, an ink jet head (droplet-discharging head) performs recording while reciprocating in a direction orthogonal to a conveying direction of the recording medium. In the line type, a head performs recording in a state where the head is fixed without movement. The ink jet head mounted on the serial-type ink jet recording apparatus is called a serial head, and the ink jet head mounted on the line-type ink jet recording apparatus is called a line head. The serial-type ink jet recording apparatus has an advantage in that it is possible to record an image on a recording medium with a large area by increasing a distance the carriage moves even when a size of the ink jet head is not increased. In contrast, the line-type ink jet recording apparatus is able to record an image on the entire region of the recording medium without shuttling the ink jet head in a main scanning direction, and thus there is an advantage in that it is possible to perform high-speed recording.

However, in the ink jet recording apparatus, a single image is represented by combining dots which are formed using ink discharged from the nozzles. Accordingly, in order to increase image quality, it is necessary to increase the number of pixels per one image by decreasing sizes of the dots. Hence, in the ink jet recording apparatus, by making the nozzles highly dense, it is possible to increase image quality.

However, in a case of the line head, when the number of nozzles increases, a problem arises in that yield may deteriorate or cumulative pitch error may increase. Therefore, JP2012-16904A and JP2005-329595A propose that a long ink jet head is produced by arranging a plurality of short ink jet heads (head modules).

Even when such a head gets out of order, it suffices that only the defective head module is replaced. Hence, there is an advantage in that an economical operation is possible.

However, a problem arises in that the ink jet head, which is configured such that a plurality of head modules is arranged as described above, is unable to record an image with high quality unless each head module is precisely positioned.

JP2012-930A proposes a method of positioning and mounting the head modules by forming pairs of convex portions and concave portions on the head modules and fitting the convex portions and the concave portions of the adjacent head modules to each other.

Further, JP2008-194972A proposes a method of positioning and mounting the head modules by connecting the adjacent head modules through connecting fittings.

SUMMARY OF THE INVENTION

However, in the method of JP2012-930A, there is a problem in that the convex portions and the concave portions have to be processed with high accuracy. Further, in a case of a method of connecting the head modules through the connecting fittings, there is a problem in that changes in positions of the head modules caused by disturbance (such as change in dimensions caused by thermal expansion) tends to have effects on other head modules.

Likewise, in the method of JP2008-194972A, there is a problem in that changes in positions of the head modules caused by disturbance tend to have effects on other head modules. Further, since the connecting fittings are separately necessary, there is a problem in that the number of components increases. In addition, since combination using the connecting fittings has to be performed, there is a problem in that it takes time to perform mounting job.

The present invention has been made in consideration of such situations, and its object is to provide a droplet-discharging head, an image-forming device, and a method for positioning head modules of the droplet-discharging head capable of easily adjusting mounting positions of head modules.

Means for solving the problems are as follows.

According to a first aspect, there is provided a droplet-discharging head that is constituted of a plurality of head modules each having a nozzle surface on which a plurality of nozzles is arranged, the droplet-discharging head including: a base frame that has the head modules mounted thereon; a head module support unit that individually supports the head modules, the head module support unit provided on the base frame; mounting position adjustment unit that individually adjusts mounting positions of the head modules supported by the head module support unit; and a displacement detection unit that individually detects amounts of displacement of the head modules when the mounting position adjustment unit adjusts the mounting positions of the head modules.

In the present aspect, the head modules are supported by the head module support unit provided on the base frame, and are mounted on the base frame. The mounting positions of the head modules mounted on the base frame are individually adjusted by the mounting position adjustment unit. Then, the amounts of displacement (amounts of movement) at the time of the adjustment are detected by the displacement detection unit. Thereby, it is possible to easily perform fine adjustment after the head modules are mounted on the base frame.

According to a second aspect, in the droplet-discharging head of the first aspect, the mounting position adjustment unit has an X-directional mounting position adjustment unit that adjusts the mounting positions in an X direction parallel to an arrangement direction of the nozzles, and the displacement detection unit detects the amounts of displacement of the head modules in the X direction.

In the present aspect, it is possible to adjust the mounting positions in the X direction parallel to the arrangement direction of the nozzles, and it is possible to detect the amounts of displacement in the X direction. In the case of the droplet-discharging head configured such that the plurality of head modules is arranged, in order to perform high-quality printing, it is necessary to set the distance (interval) between the adjacent head modules in an allowable range. That is, it is necessary to achieve high mounting accuracy in the direction parallel to the arrangement direction of the nozzles. In the present aspect, it is possible to adjust the mounting accuracy in the direction (X direction) parallel to the arrangement direction of the nozzles, and it is possible to detect the amounts of displacement in the direction (X direction). As a result, mounting can be performed with high accuracy.

According to a third aspect, in the droplet-discharging head of the second aspect, the X-directional mounting position adjustment unit has an X-directional positioning reference pin which is provided on one of the base frame and the head module, an eccentric roller which is provided on the other thereof, and X-directional biasing unit that biases the head modules in the X direction and bringing the eccentric roller into direct pressure contact with the X-directional positioning reference pin, and the X-directional mounting position adjustment unit moves the head modules in the X direction by rotating the eccentric roller brought into direct pressure contact with the X-directional positioning reference pin.

In the present aspect, the X-directional mounting position adjustment unit is configured to have the X-directional positioning reference pin which is provided on one of the base frame and the head module, the eccentric roller which is provided on the other thereof, and the X-directional biasing unit that biases the head modules in the X direction and bringing the eccentric roller into direct pressure contact with the X-directional positioning reference pin. For example, the X-directional positioning reference pin is provided on the base frame side, and the eccentric roller is provided to close to the head modules. Thereby, the head modules are biased in the X direction so as to bring the eccentric roller into direct pressure contact with the X-directional positioning reference pin. Thereby, when the eccentric roller is rotated, the head modules move in the X direction in accordance with a rotation position of the roller. Further, with such a configuration, it is possible to easily minutely displace the head modules.

According to a fourth aspect, in the droplet-discharging head of the second or third aspect, the base frame has three Y-directional base frame positioning members that serve as a reference for positioning the based frame in a Y direction orthogonal to the arrangement direction of the nozzles, and two Z-directional base frame positioning members that serve as a reference for positioning the based frame in a Z direction orthogonal to the nozzle surfaces, the head module has three Y-directional head module positioning members that are brought into direct contact with the Y-directional base frame positioning members, and two Z-directional head module positioning members that are brought into direct contact with the Z-directional base frame positioning members, and the head module support unit has Y-directional biasing unit that biases the head modules in the Y direction in engagement with the head modules and bringing the Y-directional head module positioning members into direct pressure contact with the Y-directional base frame positioning members, and Z-directional biasing unit that biases the head modules in the Z direction in engagement with the head modules and bringing the Z-directional head module positioning members into direct pressure contact with the Z-directional base frame positioning members.

In the present aspect, the base frame has the three Y-directional base frame positioning members that serve as a reference for positioning the based frame in the Y direction orthogonal to the arrangement direction of the nozzles, and two Z-directional base frame positioning members that serve as a reference for positioning the based frame in the Z direction orthogonal to the nozzle surfaces. In addition, the head module has the three Y-directional head module positioning members that are brought into direct contact with the Y-directional base frame positioning members, and the two Z-directional head module positioning members that are brought into direct contact with the Z-directional base frame positioning members. The head module support unit biases the head modules through the Y-directional biasing unit in the Y direction so as to bring the Y-directional head module positioning members into direct pressure contact with the Y-directional base frame positioning members, thereby adjusting the positions of the head modules in the Y direction. The head module support unit biases the head modules through the Z-directional biasing unit in the Z direction so as to bring the Z-directional head module positioning members into direct pressure contact with the Z-directional base frame positioning members, thereby adjusting the positions of the head modules in the Z direction. Thereby, the position of the base frame can be adjusted in the Y direction and Z direction at a state where the head modules are mounted on the base frame.

According to a fifth aspect, in the droplet-discharging head of the fourth aspect, the number of the Y-directional biasing unit is set to be plural, and biasing forces of the Y-directional biasing unit arranged to be closer to the X-directional mounting position adjustment unit are set to be greater than biasing forces of the Y-directional biasing unit arranged to be further from the X-directional mounting position adjustment unit.

In the present aspect, the number of the Y-directional biasing unit is set to be plural, and the biasing forces of the Y-directional biasing unit arranged to be closer to the X-directional mounting position adjustment unit are set to be greater than the biasing forces of the Y-directional biasing unit arranged to be further from the X-directional mounting position adjustment unit. Thereby, it is possible to prevent the head modules from being tilted when the head modules are displaced by the X-directional mounting position adjustment unit.

According to a sixth aspect, in the droplet-discharging head of the fourth or fifth aspect, at least either the Y-directional base frame positioning members or the Y-directional head module positioning members are provided to be movable in the Y direction, and are able to adjust the mounting positions of the head modules, which are supported by the head module support unit, in the Y direction.

In the present aspect, at least either the Y-directional base frame positioning members or the Y-directional head module positioning members are provided to be movable in the Y direction. Thereby, it is possible to adjust the mounting positions of the head modules supported by the head module support unit in the Y direction.

According to a seventh aspect, in the droplet-discharging head of any one of the fourth to sixth aspects, at least either the Z-directional base frame positioning members or the Z-directional head module positioning members are provided to be movable in the Z direction, and are able to adjust the mounting positions of the head modules, which are supported by the head module support unit, in the Z direction.

In the present aspect, at least either the Z-directional base frame positioning members or the Z-directional head module positioning members are provided to be movable in the Z direction. Thereby, it is possible to adjust the mounting positions of the head modules supported by the head module support unit in the Z direction.

According to an eighth aspect, in the droplet-discharging head of any one of the fourth to seventh aspects, the Y-directional base frame positioning members are formed to have a higher hardness than the Y-directional head module positioning members, and the Z-directional base frame positioning members are formed to have a higher hardness than the Z-directional head module positioning members.

In the present aspect, the Y-directional base frame positioning members are formed to have a higher hardness than the Y-directional head module positioning members, and the Z-directional base frame positioning members are formed to have a higher hardness than the Z-directional head module positioning members. Thereby, it is possible to improve positional stability after the head modules are replaced. Further, it is possible to improve accuracy in repetition of head module replacement. As an aspect for the high hardness formation, it is possible to employ an aspect in which a high hardness material is used in the Y-directional base frame positioning members and the Z-directional base frame positioning members, or an aspect in which high hardness is achieved through surface treatment.

According to a ninth aspect, in the droplet-discharging head of the eighth aspect, the Y-directional base frame positioning members and the Z-directional base frame positioning members are formed of stainless steel.

In the present aspect, the Y-directional base frame positioning members and the Z-directional base frame positioning members are formed of stainless steel. By forming the members using high hardness stainless steel, it is possible to improve positional stability after the head modules are replaced. Further, it is possible to improve accuracy in repetition of head module replacement.

According to a tenth aspect, in the droplet-discharging head of any one of the fourth to ninth aspects, the Y-directional head module positioning members and the Z-directional head module positioning members are formed in spherical shapes.

In the present aspect, the Y-directional head module positioning members and the Z-directional head module positioning members are formed in spherical shapes. Thereby, the Y-directional base frame positioning members and the Z-directional base frame positioning members are in direct contact at a point, whereby it is possible to perform the positioning with high accuracy.

According to an eleventh aspect, in the droplet-discharging head of any one of the second to tenth aspects, the base frame has a first mounting portion and a second mounting portion parallel to each other, and the head module support unit are alternately disposed on the first mounting portion and the second mounting portion.

In the present aspect, the base frame has the first mounting portion and the second mounting portion parallel to each other, and the head module support unit are alternately disposed on the first mounting portion and the second mounting portion. Thereby, it is possible to set a large installation interval between the head module support unit adjacent to each other.

According to a twelfth aspect, in the droplet-discharging head of the eleventh aspect, an installation interval between the two Z-directional base frame positioning members is set to be greater than lengths of columns of the nozzles arranged on the nozzle surface of the head module.

In the present aspect, the installation interval between the two Z-directional base frame positioning members is set to be greater than the lengths of columns of the nozzles arranged on the nozzle surface of the head module. Thereby, it is possible to further stably mount the head modules on the base frame.

According to the third aspect, in the droplet-discharging head of the eleventh or twelfth aspect, an installation interval between two of the three Y-directional head module positioning members is set to be greater than the lengths of the columns of the nozzles arranged on the nozzle surface of the head module according to the droplet-discharging head of claim 11 or 12.

In the present aspect, the installation interval between two of the three Y-directional head module positioning members is set to be greater than the lengths of the columns of the nozzles arranged on the nozzle surface of the head module. Thereby, it is possible to further stably mount the head modules on the base frame.

According to a thirteenth aspect, in the droplet-discharging head of any one of the first to twelfth aspects, the base frame is formed of a material of which a linear expansion coefficient is equal to or less than 10 ppm/° C.

In the present aspect, the base frame is formed of a material of which a linear expansion coefficient is equal to or less than 10 ppm/° C. lower than a linear expansion coefficient (about 15 ppm/° C.) of iron. Thereby, it is possible to prevent the mounting positions for being changed by an effect of heat.

According to a fourteenth aspect, in the droplet-discharging head of the thirteenth aspect, the base frame is formed of ceramic, invar, or super invar.

In the present aspect, the base frame is formed of ceramic, invar, or super invar. Thereby, it is possible to prevent the mounting positions for being changed by an effect of heat.

According to a fifteenth aspect, in the droplet-discharging head of any one of the first to fourteenth aspects, the displacement detection unit has a magnet that is provided on one of the base frame and the head modules, and a magnetic sensor that is provided on the other thereof.

In the present aspect, the displacement detection unit has the magnet that is provided on one of the base frame and the head modules, and the magnetic sensor that is provided on the other thereof. For example, the magnet is provided on the head module side, and the magnetic sensor is provided on the base frame side. Since the magnetic sensor detects minute displacement with high accuracy, it is possible to position the head modules with high accuracy.

According to a sixteenth aspect, there is provided an image-forming device including: the droplet-discharging head according to any one of the first to fifteenth aspects; an image reading unit that reads an image drawn by the droplet-discharging head; and a position detection unit that detects relative positions of the plurality of head modules constituting the droplet-discharging head by processing the image which is read by the image reading unit.

In the present aspect, an image (test pattern) is drawn by the droplet-discharging head, and thus it is possible to detect relative positions of the plurality of head modules constituting the droplet-discharging head by reading the image. By adjusting the mounting positions of the head modules on the basis of the information of the relative positions of the head modules, it is possible to position the head modules with high accuracy.

According to a seventeenth aspect, there is provided a method for positioning head modules of the droplet-discharging head according to any one of the first to fifteenth aspects, the method for positioning head modules of the droplet-discharging head including: drawing a test pattern on a recording medium by using the droplet-discharging head in which the head modules are mounted on the base frame; reading the image of the test pattern drawn on the recording medium;

detecting relative positions of the head modules on the basis of the read image; calculating amounts of correction of mounting positions of the head modules on the basis of the detected relative positions of the head modules; and adjusting the mounting positions of the head modules on the basis of the calculated amounts of correction.

In the present aspect, the positioning of the head modules is performed through the following procedure. First, the test pattern is drawn on the recording medium by using the droplet-discharging head in which the head modules are mounted on the base frame. Next, the image of the test pattern drawn on the recording medium is read. Subsequently, the relative positions of the head modules are detected on the basis of the read image. Then, the amounts of correction of the mounting positions of the head modules are calculated on the basis of the detected relative positions of the head modules. Finally, the mounting positions of the head modules are adjusted on the basis of the calculated amounts of correction. Thereby, it is possible to position the head modules with high accuracy.

According to the aspects of the present invention, it is possible to easily adjust the mounting positions of the head modules.

DESCRIPTION OF THE PREFERRED EMBODIMENTS

Hereinafter, preferred embodiments of the present invention will be described in detail with reference to the accompanying drawings.

Here, an exemplary case where the present invention is applied to an ink jet recording apparatus (droplet-discharging device) will be described.

Overall Configuration of Ink Jet Recording Apparatus

First, an overall configuration of the ink jet recording apparatus will be described.

Figure 1:
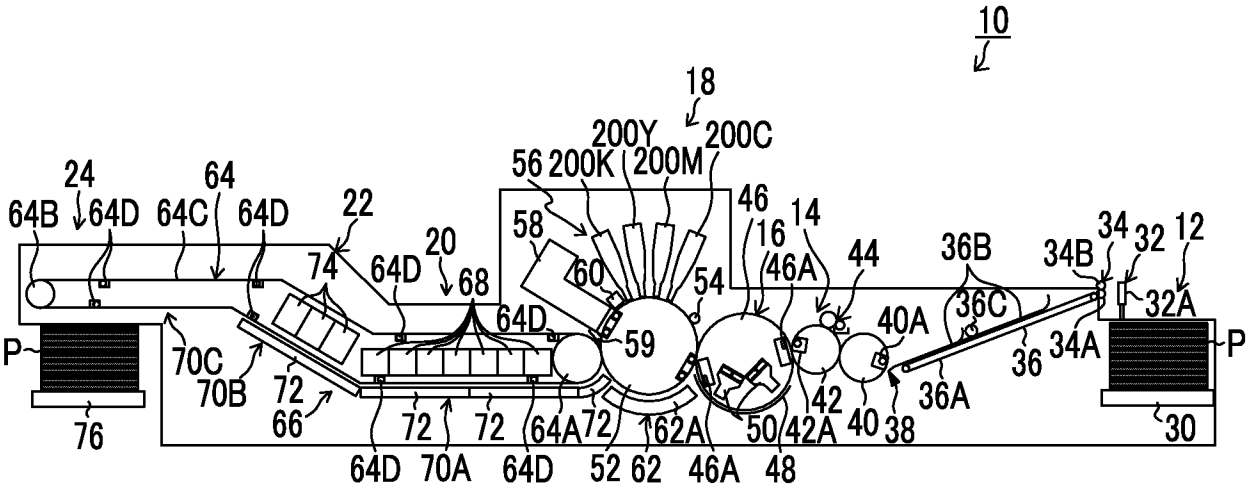
FIG. 1 is an overall configuration diagram illustrating a schematic configuration of the entirety of an ink jet recording apparatus.

FIG. 1 is an overall configuration diagram illustrating a schematic configuration of the entirety of the ink jet recording apparatus.

The ink jet recording apparatus 10 is an ink jet recording apparatus that records a color image by ejecting inks of four colors of cyan (C), magenta (M), yellow (Y), and black (K) onto cut sheets. As the cut sheets as a recording medium, general printing sheets are used. Further, as the inks, ultraviolet-curable-type aqueous inks are used.

Here, the general printing sheet is not a so-called ink jet sheet, and is a sheet of paper, of which a main component is cellulose, such as a coated sheet used in general offset printing or the like.

Further, the aqueous ink is ink in which a color material such as a dye or a pigment is dissolved or dispersed in water and solvent soluble in water. The ultraviolet-curable-type aqueous ink is aqueous ink which is curable through irradiation of ultraviolet light (UV).

When the general printing sheet has permeability and directly records an image on such a recording medium by using an aqueous ink in an ink jet method, feathering, bleeding, and the like occur. Hence, in the ink jet recording apparatus of the present example, the recording medium is coated with processing liquid, which has a function of aggregating components in the ink, in advance, and then the image is recorded.

As shown in FIG. 1, the ink jet recording apparatus 10 mainly include: a sheet feeding section 12 that feeds sheets of paper P as a recording medium; a processing liquid coating section 14 that coats surfaces (image recording surfaces) of the sheets of paper P, which are fed from the sheet feeding section 12, with processing liquid; a processing liquid drying processing section 16 that performs a drying process on the sheets of paper P coated with the processing liquid; an image recording section 18 that draws color images by ejecting ink droplets to the surfaces of the dried sheets of paper P in an ink jet method; an ink drying processing section 20 that performs a drying process on the sheets of paper P on which an image is recorded; a ultraviolet irradiation section 22 that irradiates the dried sheets of paper P with ultraviolet light so as to fix the images; and a sheet discharging section 24 that discharges and collects the sheets of paper P irradiated with ultraviolet light.

Sheet Feeding Section

The sheet feeding section 12 feeds the sheets of paper P stacked on the sheet feeding tray 30 to the processing liquid coating section 14 one by one. The sheet feeding section 12 mainly includes a sheet feeding tray 30, a sucker device 32, a sheet feeding roller pair 34, a feeder board 36, a front contact portion 38, and a sheet feeding drum 40.

The multiple sheets of paper P are placed on the sheet feeding tray 30 in a state where the sheets are stacked. The sheet feeding tray 30 is provided to be moved up and down by a sheet feeding tray lifting device which is not shown in the drawing. The sheet feeding tray lifting device moves the sheet feeding tray 30 up and down so as to continuously keep the sheet of paper P, which is positioned on the top of the stack, at a regular height through driving control, in conjunction with increase or decrease in the number of sheets of paper P stacked on the sheet feeding tray 30.

The sucker device 32 takes the sheets of paper P, which are stacked on the sheet feeding tray 30, one by one in order from the top of the stack, and feeds the sheets to the sheet feeding roller pair 34. The sucker device 32 has a suction foot 32A which is provided to be movable up and down and be swingable. The sucker device 32 sucks and holds the upper surface of the sheet of paper P through the suction foot 32A, and then transports the sheet of paper P from the sheet feeding tray 30 to the sheet feeding roller pair 34. At this time, the suction foot 32A sucks and holds the upper surface on the leading end side of the sheet of paper P positioned on the top of the stack, raises the sheet of paper P, and inserts the leading end of the raised sheet of paper P between a pair of rollers 34A and 34B constituting the sheet feeding roller pair 34.

The sheet feeding roller pair 34 is constituted of the pair of upper and lower rollers 34A and 34B coming into direct pressure contact with each other. One of the pair of upper and lower rollers 34A and 34B is set as a driving roller (roller 34A), and the other one is set as a driven roller (roller 34B). The driving roller (roller 34A) is rotated by being driven by a motor which is not shown in the drawing. The motor is driven in conjunction with the sheet feeding of the sheets of paper P, and rotates the driving roller (roller 34A) in accordance with the timing when the sheets of paper P are fed from the sucker device 32. The sheet of paper P, which is inserted between the pair of upper and lower rollers 34A and 34B, is nipped by the rollers 34A and 34B, and is sent in a rotation direction (an installation direction of the feeder board 36) of the rollers 34A and 34B.

The feeder board 36 is formed in accordance with a sheet width so as to receive the sheets of paper P delivered from the sheet feeding roller pair 34 and guide the sheets to the front contact portion 38. The feeder board 36 is obliquely provided such that the leading end side is directed downward, and the sheet of paper P placed on the conveying surface slides along the conveying surface so as to be guided to the front contact portion 38.

The feeder board 36 is provided with a plurality of tape feeders 36A for conveying the sheets of paper P. The tape feeders 36A are arranged with intervals in a width direction. The tape feeder 36A is formed in an endless belt shape, and is rotated through driving of a motor not shown in the drawing. The sheet of paper P placed on the conveying surface for the feeder board 36 is delivered by the tape feeder 36A, and is conveyed on the feeder board 36.

Further, retainers 36B and a fulcrum roller 36C are provided on the feeder board 36.

The multiple (two in this example) retainers 36B are arranged to be tandem in the front-back direction along the conveying surface for the sheets of paper P. The retainer 36B includes a leaf spring having a width corresponding to the sheet width, and is provided in direct pressure contact with the conveying surface. The sheet of paper P, which is conveyed on the feeder board 36 by the tape feeder 36A, passes through the retainers 36B, thereby smoothing unevenness of the surface thereof. In addition, each retainer 36B is formed such that the rear end portion thereof is curved in order to easily receive the sheets of paper P through a gap between itself and the feeder board 36.

The fulcrum roller 36C is disposed between the front and back retainers 36B. The fulcrum roller 36C is provided in direct pressure contact with the conveying surface for the sheets of paper P. The sheet of paper P, which is conveyed between the front and back retainers 36B, is conveyed while the upper surface is pressed by the fulcrum roller 36C.

The front contact portion 38 corrects the posture of each sheet of paper P. The front contact portion 38 is formed in a plate shape, and is disposed to be orthogonal to the conveying direction of the sheets of paper P. Further, the front contact portion 38 is driven by a motor not shown in the drawing, and is swingably provided. The leading end of the sheet of paper P, which is conveyed on the feeder board 36, comes into direct contact with the front contact portion 38, whereby the posture of the sheet of paper P is corrected (so-called, skew prevention). The front contact portion 38 swings in conjunction with the feeding of the sheets of paper to the sheet feeding drum 40, thereby delivering the sheets of paper P, of which the postures are corrected, to the sheet feeding drum 40.

The sheet feeding drum 40 receives the sheets of paper P which are fed from the feeder board 36 through the front contact portion 38, and conveys the sheets to the processing liquid coating section 14. The sheet feeding drum 40 is formed in a cylindrical shape, and is rotated through driving of a motor not shown in the drawing. A gripper 40A is provided on the outer circumferential surface of the sheet feeding drum 40, and the leading end of the sheet of paper P is gripped by the gripper 40A. The sheet feeding drum 40 rotates in a state where the leading end of the sheet of paper P is gripped by the gripper 40A so as to wind the sheet of paper P around the circumferential surface thereof, thereby conveying the sheets of paper P to the processing liquid coating section 14.

The sheet feeding section 12 is configured as described above. The sheets of paper P, which are stacked on the sheet feeding tray 30, are taken up one by one by the sucker device 32 in order from the top of the stack, and are fed to the sheet feeding roller pair 34. The sheets of paper P, which are fed to the sheet feeding roller pair 34, are sent ahead by the pair of upper and lower rollers 34A and 34B constituting the sheet feeding roller pair 34, and are placed on the feeder board 36. The sheets of paper P, which are placed on the feeder board 36, are conveyed by the tape feeder 36A provided on the conveying surface of the feeder board 36. Then, in the course of conveyance, the retainers 36B tightly press the sheet onto the conveying surface of the feeder board 36, thereby smoothing unevenness of the surface of the sheet. The leading end of the sheet of paper P, which is conveyed by the feeder board 36, comes into direct contact with the front contact portion 38, whereby the inclination of the sheet is corrected, and thereafter the sheet is delivered from the sheet feeding drum 40. Subsequently, the sheets are conveyed to the processing liquid coating section 14 through the sheet feeding drum 40.

Processing Liquid Coating Section

The processing liquid coating section 14 coats the surfaces (image recording surfaces) of the sheets of paper P with the processing liquid which has a function of aggregating ink. The processing liquid coating section 14 mainly includes: a processing liquid coating drum 42 that conveys the sheets of paper P; and a processing liquid coating device 44 that coats the surfaces (image recording surfaces) of the sheets of paper P, which are conveyed by the processing liquid coating drum 42, with the processing liquid.

The processing liquid coating drum 42 functions as means (recording medium holding unit) for holding the sheets of paper P as a recording medium, and functions as means (recording medium conveying unit) for conveying the sheets of paper P as a recording medium. The processing liquid coating drum 42 receives the sheets of paper P from the sheet feeding drum 40 of the sheet feeding section 12, and rotates while holding the sheets on the outer circumferential surface thereof, thereby conveying the sheets of paper P to the processing liquid drying processing section 16.

The processing liquid coating drum 42 is formed in a cylindrical shape, and is rotated through driving of a motor not shown in the drawing. A gripper 42A is provided on the outer circumferential surface of the processing liquid coating drum 42, and the leading end of the sheet of paper P is gripped by the gripper 42A. The processing liquid coating drum 42 rotates in a state where the leading end of the sheet of paper P is gripped by the gripper 42A so as to wind the sheets of paper P around the circumferential surface thereof, thereby conveying the sheets of paper P to the processing liquid drying processing section 16 (one sheet of paper P is conveyed per one revolution). The rotation of the processing liquid coating drum 42 and the rotation of the sheet feeding drum 40 are controlled such that the timings for delivering the sheets of paper P coincide with each other. Consequently, the drums are driven so as to make the circumferential velocities thereof the same, and are driven so as to make the positions of the grippers thereof the same as each other.

The processing liquid coating device 44 functions as processing liquid coating means that coats the surfaces of the sheets of paper P, which are conveyed by the processing liquid coating drum 42, with the processing liquid. The processing liquid coating device 44 is formed as, for example, a roller coating device. The processing liquid coating device 44 brings the coating roller, of which a circumferential surface thereof is coated with the processing liquid, into direct pressure contact with the surface of the sheet of paper P, and coats the surfaces of the sheets of paper P with the processing liquid. Otherwise, the processing liquid coating device 44 may be formed as, for example, a head that performs coating by discharging the processing liquid in the ink jet method, or may be formed as a spray that performs coating by spraying the processing liquid.

The processing liquid coating section 14 is configured as described above. The sheets of paper P, which are delivered from the sheet feeding drum 40 of the sheet feeding section 12, are taken by the processing liquid coating drum 42. The processing liquid coating drum 42 rotates in a state where the leading end of the sheet of paper P is gripped by the gripper 42A so as to wind the sheet of paper P around the circumferential surface thereof, thereby conveying the sheets of paper P. In the course of conveyance, the coating roller is brought into direct pressure contact with the surface of the sheet of paper P, and the coating roller rolls on the sheet, thereby coating the surface of the sheet of paper P with the processing liquid.

In addition, the processing liquid, which is used in the coating of the processing liquid coating section 14, is formed as liquid which includes an aggregating agent for aggregating components in ink composition. Examples of the aggregating agent may include a compound capable of changing pH of the ink composition, multivalent metal salt, or polyallyl amines. Appropriate examples of the compound, which can be obtained by lowering the pH, include highly water-soluble acidic substances (such as phosphoric acid, oxalic acid, malonic acid, citric acid, derivatives of these compounds, and salts thereof). A single acidic substance may be used, or two or more acidic substances may be used in combination. Thereby, by increasing aggregability, it is possible to fix the entire ink. Further, pH (25° C.) of the ink composition is equal to or greater than 8.0, and it is preferable that pH (25° C.) of the processing liquid is in a range of 0.5 to 4. Thereby, it is possible to achieve an increase in image density, resolution, and a speed of ink jet recording.

The processing liquid may contain an additive. For example, processing liquid may contain a well-known additive such as an anti-drying agent (wetting agent), a color fading inhibitor, an emulsion stabilizer, a permeation accelerator, a ultraviolet absorber, a preservative, an antifungal agent, a pH adjusting agent, a surface tension adjusting agent, a defoaming agent, a viscosity modifier, a dispersant, a dispersion stabilizer, an anti-rust agent, or a chelating agent.

An image is recorded by coating the surface (image recording surface) of the sheet of paper P with such processing liquid. In such a manner, it is possible to prevent feathering or bleeding from occurring. Thus, even when using a general printing sheet having permeability, it is possible to perform high quality printing.

Processing Liquid Drying Processing Section

The processing liquid drying processing section 16 performs a drying process on the sheets of paper P of which the surfaces are coated with the processing liquid. The processing liquid drying processing section 16 mainly includes: a processing liquid drying processing drum 46 that conveys the sheets of paper P; a sheet conveying guide 48; and processing liquid drying processing units 50 that perform drying by blowing hot air on the image recording surfaces of the sheets of paper P which are conveyed by the processing liquid drying processing drum 46.

The processing liquid drying processing drum 46 receives the sheets of paper P from the processing liquid coating drum 42 of the processing liquid coating section 14, and conveys the sheets of paper P to the image recording section 18. The processing liquid drying processing drum 46 is formed as a frame body having a cylindrical shape, and rotates through driving of a motor not shown in the drawing. Grippers 46A are provided on the outer circumferential surface of the processing liquid drying processing drum 46, and the leading end of the sheets of paper P are gripped by the grippers 46A. The processing liquid drying processing drum 46 rotates in a state where the leading ends of the sheets of paper P are gripped by the grippers 46A, thereby conveying the sheets of paper P to the image recording section 18. It should be noted that the processing liquid drying processing drum 46 of the present example is configured such that the grippers 42A are disposed at two locations on the outer circumferential surface thereof and two sheets of paper P are conveyed per one revolution. The rotation of the processing liquid drying processing drum 46 and the processing liquid coating drum 42 are controlled such that the timings for receiving and delivering the sheets of paper P coincide with each other. Consequently, the drums are driven so as to make the circumferential velocities thereof the same, and are driven so as to make the positions of the grippers thereof the same as each other.

The sheet conveying guide 48 is disposed along a conveying path for conveying the sheets of paper P through the processing liquid drying processing drum 46, and guides conveying of the sheets of paper P.

The processing liquid drying processing units 50 are provided inside the processing liquid drying processing drum 46, and perform the drying process by blowing hot air on the surfaces of the sheets of paper P which are conveyed by the processing liquid drying processing drum 46. In this example, the two processing liquid drying processing units 50 are disposed inside the processing liquid drying processing drum, and have a configuration that hot air is blown toward the surfaces of the sheets of paper P which are conveyed by the processing liquid drying processing drum 46.

The processing liquid drying processing section 16 is configured as described above. The sheets of paper P, which are delivered from the processing liquid coating drum 42 of the processing liquid coating section 14, are taken by the processing liquid drying processing drum 46. The processing liquid drying processing drum 46 rotates in a state where the leading ends of the sheets of paper P are gripped by the grippers 46A, thereby conveying the sheets of paper P. At this time, the processing liquid drying processing drum 46 conveys the surfaces (surfaces coated with the processing liquid) of the sheets of paper P to the inside of the apparatus. In the course of conveyance performed by the processing liquid drying processing drum 46, hot air is blown onto the surfaces of the sheets of paper P from the processing liquid drying processing units 50 which are provided inside the processing liquid drying processing drum 46, thereby performing the drying process. Consequently, a solvent component in the processing liquid is removed. Thereby, an ink aggregation layer is formed on the surface of each sheet of paper P.

Image Recording Section

The image recording section 18 draws color images on the image recording surfaces of the sheets of paper P by ejecting inks of respective colors of C, M, Y, and K. The image recording section 18 mainly includes: an image recording drum 52 that conveys the sheets of paper P; a sheet pressing roller 54 that brings the sheets of paper P into tight contact with the circumferential surface of the image recording drum 52 by pressing the sheets of paper P which are conveyed by the image recording drum 52; a head unit 56 that records images by discharging ink droplets of the colors of C, M, Y, and K onto the sheets of paper P; an in-line sensor 58 as image reading unit that reads images recorded on the sheets of paper P; a mist filter 60 that captures ink mist; and a drum cooling unit 62 that cools down the image recording drum 52.

The image recording drum 52 functions as recording medium holding unit that holds the sheets of paper P as a recording medium, and functions as recording medium conveying unit that conveys the sheets of paper P as a recording medium. The image recording drum 52 receives the sheets of paper P from the processing liquid drying processing drum 46 of the processing liquid drying processing section 16, and conveys the sheets of paper P to the ink drying processing section 20. The image recording drum 52 is formed in a cylindrical shape, and rotates through driving of a motor as driving unit not shown in the drawing. Grippers are provided on the outer circumferential surface of the image recording drum 52, and the leading end of the sheets of paper P are gripped by the grippers. The image recording drum 52 rotates in a state where the leading ends of the sheets of paper P are gripped by the grippers so as to wind the sheets of paper P around the circumferential surface thereof, thereby conveying the sheets of paper P to the ink drying processing section 20. Further, multiple suction holes (not shown in the drawing) are formed in a predetermined pattern on the circumferential surface of the image recording drum 52. The sheets of paper P, which are wound around the circumferential surface of the image recording drum 52, are conveyed while being sucked and held on the circumferential surface of the image recording drum 52 through suctioning from the suction holes. Thereby, it is possible to convey the sheets of paper P with high flatness.

The sheet pressing roller 54 is disposed in the vicinity of a sheet receiving position (a position at which the sheets of paper P are received from the processing liquid drying processing drum 46) of the image recording drum 52. The sheet pressing roller 54 is formed as a rubber roller, and is provided in direct pressure contact with the circumferential surface of the image recording drum 52. The sheets of paper P, which are delivered from the processing liquid drying processing drum 46 to the image recording drum 52, are nipped by passing through the sheet pressing roller 54, and are brought into tight contact with the circumferential surface of the image recording drum 52.

The head unit 56 includes: an ink jet head (droplet-discharging head) 200C that discharges ink droplets of cyan (C) in the ink jet method; an ink jet head (droplet-discharging head) 200M that discharges ink droplets of magenta (M) in the ink jet method; an ink jet head (droplet-discharging head) 200Y that discharges ink droplets of yellow (Y) in the ink jet method; and an ink jet head (droplet-discharging head) 200K that discharges ink droplets of black (K) in the ink jet method. The ink jet heads 200C, 200M, 200Y, and 200K are disposed with regular intervals along the conveying path for conveying the sheets of paper P through the image recording drum 52.

The ink jet heads 200C, 200M, 200Y, and 200K are formed as line heads, and are formed to have lengths corresponding to the maximum sheet width. The ink jet heads 200C, 200M, 200Y, and 200K are disposed such that the nozzle surfaces (surfaces on which the nozzles are arranged) face the circumferential surface of the image recording drum 52.

The ink jet heads 200C, 200M, 200Y, and 200K record images on the sheets of paper P, which are conveyed by the image recording drum 52, by discharging the liquid droplets of the inks toward the image recording drum 52 from the nozzles formed on the nozzle surfaces.

It should be noted that configurations of the ink jet heads 200C, 200M, 200Y, and 200K will be described in detail later.

The in-line sensor 58 functions as image reading unit that reads images recorded on the sheets of paper P. The in-line sensor 58 is provided downstream of the rearmost ink jet head 200K in the conveying direction of the sheets of paper P conveyed by the image recording drum 52, and reads images which are recorded by the ink jet heads 200C, 200M, 200Y, and 200K. The in-line sensor 58 is formed as, for example, a line scanner, and reads images, which are recorded by the ink jet heads 200C, 200M, 200Y, and 200K, from the sheets of paper P conveyed by the image recording drum 52.

It should be noted that a contact prevention plate 59 is provided downstream of the in-line sensor 58 so as to be close to the in-line sensor 58. The contact prevention plate 59 prevents the sheets of paper P from coming into contact with the in-line sensor 58 when lifting occurs on the sheets of paper P due to troubles in conveying and the like.

The mist filter 60 is disposed between the rearmost ink jet head 200K and the in-line sensor 58, and captures the ink mist by suctioning air around the image recording drum 52. As described above, by suctioning air around the image recording drum 52 so as to capture the ink mist, it is possible to prevent the ink mist from entering into the in-line sensor 58, and it is possible to prevent reading failure and the like from occurring.

The drum cooling unit 62 cools down the image recording drum 52 by blowing cold air to the image recording drum 52. The drum cooling unit 62 mainly includes an air conditioner (not shown in the drawing), and a duct 62A for blowing cold air, which is supplied from the air conditioner, onto the circumferential surface of the image recording drum 52. The duct 62A blows cold air in a region other than the conveying region for the sheets of paper P on the image recording drum 52, thereby cooling down the image recording drum 52. In this example, the sheets of paper P are conveyed along the arc surface of a substantially upper half of the image recording drum 52. Therefore, the duct 62A is configured to blow cold air in a region of a substantially lower half of the image recording drum 52, thereby cooling down the image recording drum 52. Specifically, an outlet of the duct 62A is formed in an arc shape so as to cover the substantially lower half of the image recording drum 52, and is thus configured to blow cold air in the region of the substantially lower half of the image recording drum 52.

Here, a temperature, to which the image recording drum 52 is cooled down, is set on the basis of temperatures (particularly, temperatures of the nozzle surfaces) of the ink jet heads 200C, 200M, 200Y, and 200K. Thus, the image recording drum 52 is cooled down to a temperature which is lower than the temperatures of the ink jet heads 200C, 200M, 200Y, and 200K. Thereby, it is possible to prevent condensation from occurring on the ink jet heads 200C, 200M, 200Y, and 200K. That is, by setting the temperature of the image recording drum 52 lower than the temperatures of the ink jet heads 200C, 200M, 200Y, and 200K, condensation is likely to occur on the image recording drum side. Thereby it is possible to prevent condensation (particularly, condensation occurring on the nozzle surfaces) from occurring on the ink jet heads 200C, 200M, 200Y, and 200K.

The image recording section 18 is configured as described above. The sheets of paper P, which are delivered from the processing liquid drying processing drum 46 of the processing liquid drying processing section 16, are taken by the image recording drum 52. The image recording drum 52 rotates in a state where the leading ends of the sheets of paper P are gripped by the grippers, thereby conveying the sheets of paper P. The sheets of paper P, which are delivered to the image recording drum 52, first passes the sheet pressing roller 54, thereby coming into tight contact with the circumferential surface of the image recording drum 52. Simultaneously, the sheets of paper P are sucked by the suction holes of the image recording drum 52, and are sucked and held on the outer circumferential surface of the image recording drum 52. The sheets of paper P are conveyed in this state, and pass the ink jet heads 200C, 200M, 200Y, and 200K. Then, liquid droplets of the inks of the colors of C, M, Y, and K are ejected onto surfaces of the sheets from the ink jet heads 200C, 200M, 200Y, and 200K at the time of passing, and color images are drawn on the surfaces. Since the ink aggregation layer is formed on each surface of the sheets of paper P, it is possible to record high quality images without causing feathering or bleeding.

The sheets of paper P, on which images are recorded by the ink jet heads 200C, 200M, 200Y, and 200K, subsequently pass the in-line sensor 58. Then, images, which are recorded on the surfaces, are read when passing the in-line sensor 58. By reading the recorded images as necessary, discharge defects and the like are inspected on the basis of the read images. When the reading is performed, the sheets are read in a state where the sheets are sucked and held on the image recording drum 52, and therefore it is possible to perform the reading with high accuracy. Further, since the reading is performed immediately after the image recording, for example, errors such as discharge defects can be immediately detected, and it is possible to promptly cope with the errors. Thereby, it is possible to prevent unnecessary recording, and it is possible to minimize occurrence of waste sheets.

Thereafter, suction of the sheets of paper P is released, and the sheets are subsequently delivered to the ink drying processing section 20.

Ink Drying Processing Section

The ink drying processing section 20 performs the drying process on the sheets of paper P on which images are recorded, and the liquid components, which remain on the surfaces of the sheets of paper P, are removed. The ink drying processing section 20 includes: a chain gripper 64 that conveys the sheets of paper P on which the images are recorded; a back tension application mechanism 66 that applies back tension to the sheets of paper P conveyed by the chain gripper 64; and ink drying processing units 68 that perform drying process on the sheets of paper P conveyed by the chain gripper 64.

The chain gripper 64 is a sheet conveying mechanism that is commonly used in the ink drying processing section 20, the ultraviolet irradiation section 22, and the sheet discharging section 24. The chain gripper 64 receives the sheets of paper P delivered from the image recording section 18, and conveys the sheets to the sheet discharging section 24.

The chain gripper 64 mainly includes: first sprockets 64A that are provided to be close to the image recording drum 52; second sprockets 64B that are provided in the sheet discharging section 24; endless chains 64C that are stretched around the first sprockets 64A and the second sprockets 64B; a plurality of chain guides (not shown in the drawing) that guides running of the chains 64C; and a plurality of grippers 64D that is mounted on the chains 64C with regular intervals. The first sprockets 64A are set as a pair, the second sprockets 64B are set as a pair, the chains 64C are set as a pair, and the chain guides are set as a pair, and those are arranged on both sides in the width direction of the sheet of paper P. The grippers 64D are provided to be hung on the chains 64C provided as a pair.

The first sprockets 64A are provided to be close to the image recording drum 52 so as to receive the sheets of paper P, which are delivered from the image recording drum 52, through the grippers 64D. The first sprockets 64A are rotatably supported by bearings not shown in the drawing, are rotatably provided, and are connected to a motor not shown in the drawing. The chains 64C, which are stretched around the first sprockets 64A and the second sprockets 64B, are run by driving the motor.

The second sprockets 64B are provided in the sheet discharging section 24 so as to collect the sheets of paper P, which are received from the image recording drum 52, in the sheet discharging section 24. That is, the positions, at which the second sprockets 64B are provided, are set as the end of the path for conveying the sheets of paper P through the chain gripper 64. The second sprockets 64B are rotatably supported by bearings not shown in the drawing, and are rotatably provided.

The chains 64C are formed in endless belt shapes, and are stretched around the first sprockets 64A and the second sprockets 64B.

The chain guides are disposed at predetermined positions, and perform guiding such that the chains 64C run through a predetermined path (perform guiding such that the sheets of paper P are conveyed through running along a predetermined conveying path). In the ink jet recording apparatus 10 of the present example, the second sprockets 64B are arranged at higher positions than the first sprockets 64A. Hence, the chains 64C are formed as a running path which is inclined in the middle of the path. Specifically, the path includes a first horizontal conveying path 70A, an inclined conveying path 70B, and a second horizontal conveying path 70C.

The first horizontal conveying path 70A is set at the same height as the first sprockets 64A, and is set such that the chains 64C winding around the first sprockets 64A run in the horizontal direction.

The second horizontal conveying path 70C is set at the same height as the second sprockets 64B, and is set such that the chains 64C winding around the second sprockets 64B run in the horizontal direction.

The inclined conveying path 70B is set between the first horizontal conveying path 70A and the second horizontal conveying path 70C, and is set to connect the first horizontal conveying path 70A and the second horizontal conveying path 70C.

The chain guides are arranged to form the first horizontal conveying path 70A, the inclined conveying path 70B, and the second horizontal conveying path 70C. Specifically, the chain guides are arranged at least at a bonding point between the first horizontal conveying path 70A and the inclined conveying path 70B and at a bonding point between the inclined conveying path 70B and the second horizontal conveying path 70C.

The plurality of grippers 64D is mounted on the chains 64C with regular intervals. The mounting intervals between the grippers 64D are set in accordance with intervals with which the sheets of paper P are received from the image recording drum 52. That is, the sheets of paper P, which are sequentially delivered from the image recording drum 52, are received from the image recording drum 52 in accordance with timing, and are set in accordance with intervals with which the sheets of paper P are received from the image recording drum 52.

The chain gripper 64 is configured as described above. As described above, when a motor (not shown in the drawing) connected to the first sprockets 64A is driven, the chains 64C run. The chains 64C run at the same velocity as the circumferential velocity of the image recording drum 52. Further, the timings for receiving the sheets of paper P, which are delivered from the image recording drum 52, are adjusted such that the sheets are received through the grippers 64D.

The back tension application mechanism 66 applies back tension to the sheets of paper P which are conveyed while the leading ends of the sheets are gripped by the chain gripper 64. The back tension application mechanism 66 mainly includes a guide plate 72, and a suction mechanism (not shown in the drawing) that sucks air through the suction holes (not shown in the drawing) which are formed on the guide plate 72.

The guide plate 72 is formed as a hollow box plate with a width corresponding to the sheet width. The guide plate 72 is disposed along the path (the running path of the chain) for conveying the sheets of paper P through the chain gripper 64. Specifically, the guide plate 72 is disposed along the chains 64C which run along the first horizontal conveying path 70A and the inclined conveying path 70B, and is disposed to be separated at a predetermined distance from the chains 64C. The sheet of paper P, which is conveyed by the chain gripper 64, is conveyed while the rear surface (a surface on a side on which the image is not recorded) thereof is in slidable contact with the top surface (a slidable contact surface: a surface facing the chains 64C) of the guide plate 72.

Multiple suction holes (not shown in the drawing) are formed in a predetermined pattern on the slidable contact surface (top surface) of the guide plate 72. As described above, the guide plate 72 is formed as a hollow box plate. A suction mechanism (not shown in the drawing) sucks air of the hollow portion (the inside) of the guide plate 72. Thereby, air is sucked through the suction holes which are formed on the slidable contact surface.

By sucking air through the suction holes of the guide plate 72, the rear surfaces of the sheets of paper P conveyed by the chain gripper 64 are sucked by the suction holes. Thereby, back tension is applied to the sheets of paper P which are conveyed by the chain gripper 64.

As described above, the guide plate 72 is disposed along the chains 64C which run along the first horizontal conveying path 70A and the inclined conveying path 70B. Therefore, the back tension is applied while the sheets are conveyed along the first horizontal conveying path 70A and the inclined conveying path 70B.

The ink drying processing units 68 are provided inside (particularly, on a portion constituting the first horizontal conveying path 70A) the chain gripper 64, and apply a drying process to the sheets of paper P which are conveyed along the first horizontal conveying path 70A. The ink drying processing units 68 perform the drying process by blowing hot air on the surfaces of the sheets of paper P which are conveyed along the first horizontal conveying path 70A. The plurality of ink drying processing units 68 is disposed along the first horizontal conveying path 70A. The number of ink drying processing units 68 provided is set depending on a processing capability of the ink drying processing units 68, a conveying speed (printing speed) of the sheets of paper P, and the like. That is, the sheets of paper P, which are received from the image recording section 18, are set to be dried while being conveyed along the first horizontal conveying path 70A. Consequently, the length of the first horizontal conveying path 70A is set in consideration of the capability of the ink drying processing units 68.

In addition, by performing the drying process, the humidity of the ink drying processing section 20 increases. When the humidity increases, it is difficult to perform the drying process efficiently. Therefore, it is preferable that, by providing exhaust unit together with the ink drying processing units 68 in the ink drying processing section 20, the humid air caused by the drying process is forcibly exhausted. For example, the exhaust unit is configured as follows. An exhaust duct is provided in the ink drying processing section 20, and the air in the ink drying processing section 20 is exhausted through the exhaust duct.

The ink drying processing section 20 is configured as described above. The sheets of paper P, which are delivered from the image recording drum 52 of the image recording section 18, are taken by the chain gripper 64. The chain gripper 64 conveys the sheets of paper P along the planar guide plate 72 in a state where the leading ends of the sheets of paper P are gripped by the grippers 64D. The sheets of paper P, which are delivered to the chain gripper 64, are first conveyed along the first horizontal conveying path 70A. In the process of conveying the sheets of paper P along the first horizontal conveying path 70A, the sheets are subjected to the drying process through the ink drying processing units 68 which are provided inside the chain gripper 64. That is, by blowing hot air onto the surfaces (image recording surfaces), the drying process is performed. At this time, the sheets of paper P are subjected to the drying process while back tension is applied thereto by the back tension application mechanism 66. Thereby, it is possible to perform the drying process while suppressing deformation of the sheets of paper P.

Ultraviolet Irradiation Section

The ultraviolet irradiation section 22 fixes images by irradiating the images, which are recorded using the ultraviolet-curable-type aqueous ink, with ultraviolet light (UV). The ultraviolet irradiation section 22 mainly includes: the chain gripper 64 that conveys the dried sheets of paper P; the back tension application mechanism 66 that applies back tension to the sheets of paper P conveyed by the chain gripper 64; and ultraviolet irradiation units 74 that irradiate the sheets of paper P conveyed by the chain gripper 64 with ultraviolet light.

As described above, the chain gripper 64 and the back tension application mechanism 66 are commonly used together with the ink drying processing section 20 and the sheet discharging section 24.

The ultraviolet irradiation units 74 are provided inside (particularly, on a portion constituting the inclined conveying path 70B) the chain gripper 64, and irradiate the surfaces of the sheets of paper P, which are conveyed along the inclined conveying path 70B, with ultraviolet light. The plurality of ultraviolet irradiation units 74 has ultraviolet light lamps (UV lamps), and is arranged along the inclined conveying path 70B. Then, the surfaces of the sheets of paper P, which are conveyed along the inclined conveying path 70B, are irradiated with ultraviolet light. The number of ultraviolet irradiation units 74 provided is set depending on the conveying speed (printing speed) of the sheets of paper P and the like. That is, the sheets of paper P are set such that images can be fixed thereon by the irradiated ultraviolet light while the sheets are conveyed along the inclined conveying path 70B. Consequently, the length of the inclined conveying path 70B is set in consideration of the conveying speed of the sheets of paper P and the like.

The ultraviolet irradiation section 22 is configured as described above. The sheets of paper P, which are conveyed by the chain gripper 64 and are subjected to the drying process by the ink drying processing section 20, are subsequently conveyed along the inclined conveying path 70B. In the process of conveying the sheets of paper P along the inclined conveying path 70B, the sheets are subjected to the ultraviolet irradiation through the ultraviolet irradiation units 74 which are provided inside the chain gripper 64. That is, ultraviolet light is emitted from the ultraviolet irradiation units 74 toward the surfaces of the sheets. At this time, the sheets of paper P are subjected to the ultraviolet irradiation while back tension is applied thereto by the back tension application mechanism 66. Thereby, it is possible to perform the ultraviolet irradiation while suppressing deformation of the sheets of paper P. Further, the ultraviolet irradiation section 22 is provided in the inclined conveying path 70B, and the inclined guide plate 72 is provided in the inclined conveying path 70B. Hence, even though the sheet of paper P falls down from the gripper 64D in the course of conveying, the sheet slides on the guide plate 72, and can be discharged.

Sheet Discharging Section

The sheet discharging section 24 discharges and collects the sheets of paper P subjected to a series of image recording processes. The sheet discharging section 24 mainly includes the chain gripper 64 that conveys the sheets of paper P irradiated with ultraviolet light, and a sheet discharging tray 76 that stacks and collects the sheets of paper P.

As described above, the chain gripper 64 is commonly used together with the ink drying processing section 20 and the ultraviolet irradiation section 22. The chain gripper 64 releases the sheets of paper P above the sheet discharging tray 76, and stacks the sheets of paper P on the sheet discharging tray 76.

The sheet discharging tray 76 stacks and collects the sheets of paper P released from the chain gripper 64. The sheet discharging tray 76 includes sheet contact portions (a front sheet contact portion, a rear sheet contact portion, a horizontal sheet contact portion, and the like) for neatly stacking the sheets of paper P (not shown in the drawing).

Further, the sheet discharging tray 76 is provided to be moved up and down by a sheet discharging tray lifting device which is not shown in the drawing. The sheet discharging tray lifting device moves the sheet discharging tray 76 up and down so as to continuously keep the sheet of paper P, which is positioned on the top of the stack, at a regular height through driving control, in conjunction with increase or decrease in the number of sheets of paper P stacked on the sheet discharging tray 76.

Control System

Figure 2:
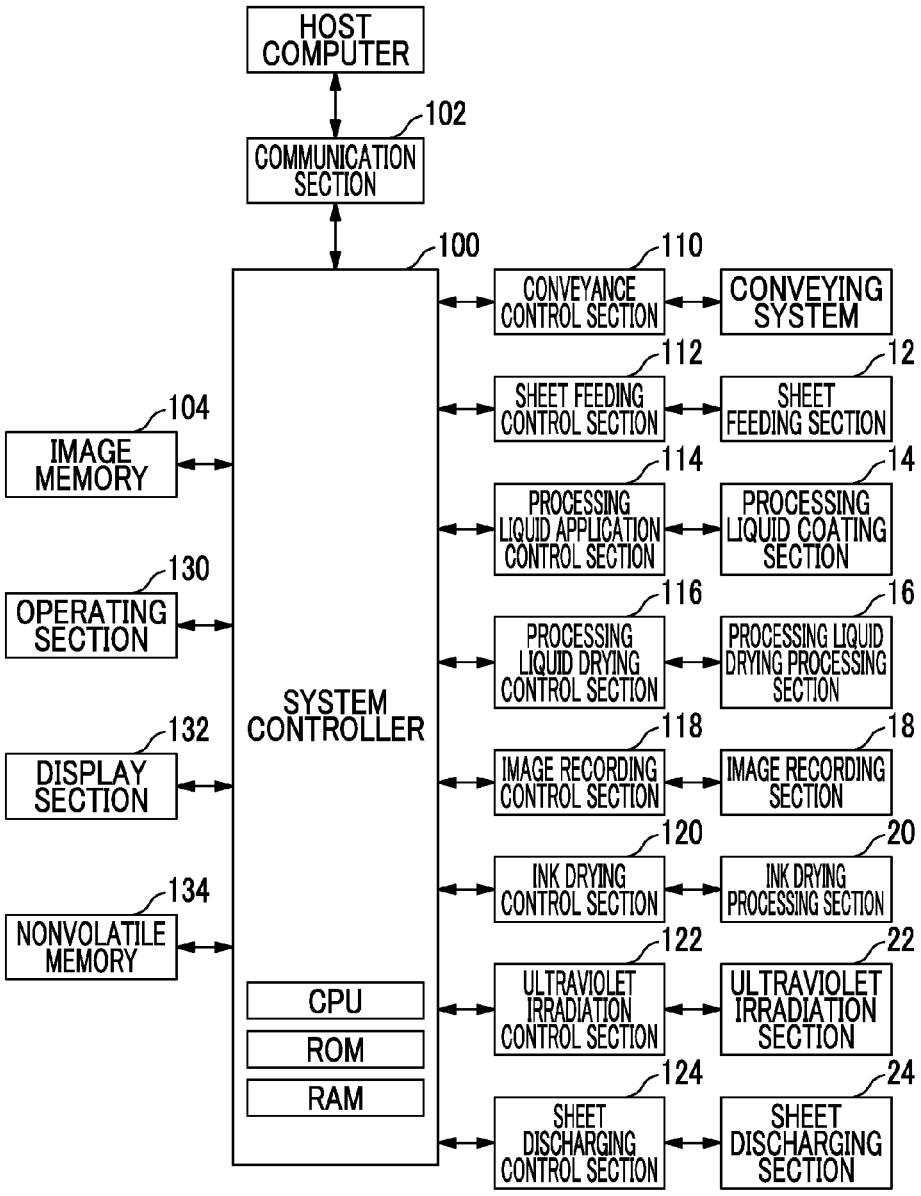
FIG. 2 is a block diagram illustrating a schematic configuration of a control system of the ink jet recording apparatus.

FIG. 2 is a block diagram illustrating a schematic configuration of a control system of the ink jet recording apparatus according to the present embodiment.

As shown in the drawing, the ink jet recording apparatus 10 includes a system controller 100, a communication section 102, an image memory 104, a conveyance control section 110, a sheet feeding control section 112, a processing liquid application control section 114, a processing liquid drying control section 116, an image recording control section 118, an ink drying control section 120, a ultraviolet irradiation control section 122, a sheet discharge control section 124, an operating section 130, a display section 132, a nonvolatile memory 134, and the like.

The system controller 100 functions as control means for overall controlling the respective sections of the ink jet recording apparatus 10, and functions as calculation unit that performs various calculation processes. The system controller 100 includes a CPU, a ROM, a RAM, and the like, and operates through a predetermined control program. The ROM stores the control program executed by the system controller 100 and various kinds of data necessary for control.

The communication section 102 has a necessary communication interface, and receives and transmits data from and to a host computer which is connected to the communication interface.

The image memory 104 functions as a temporary storage device for various data including image data, and data is read from and written to the memory through the system controller 100. Image data, which is received from a host computer through the communication section 102, is stored in the image memory 104.

The conveyance control section 110 controls the conveying system for the sheets of paper Pin the ink jet recording apparatus 10. In other words, the conveyance control section 110 controls driving of the tape feeder 36A, the front contact portion 38, and the sheet feeding drum 40 in the sheet feeding section 12, as well as controlling driving of the processing liquid coating drum 42 in the processing liquid coating section 14, the processing liquid drying processing drum 46 in the processing liquid drying processing section 16, and the image recording drum 52 in the image recording section 18. Further, the conveyance control section 110 controls driving of the chain gripper 64 and the back tension application mechanism 66, which are commonly used in the ink drying processing section 20, the ultraviolet irradiation section 22, and the sheet discharging section 24.

The conveyance control section 110 controls the conveying system in response to a command issued from the system controller 100 such that the sheets of paper P are conveyed from the sheet feeding section 12 to the sheet discharging section 24 without delay.

The sheet feeding control section 112 controls the sheet feeding section 12 in response to a command issued from the system controller 100. Specifically, driving of the sucker device 32 and the sheet feeding tray lifting mechanism, and the like, is controlled such that the sheets of paper P stacked on the sheet feeding tray 30 are sequentially fed, one sheet at a time, without overlapping.

The processing liquid application control section 114 controls the processing liquid coating section 14 in response to a command issued from the system controller 100. Specifically, driving of the processing liquid coating device 44 is controlled such that the sheets of paper P conveyed by the processing liquid coating drum 42 are coated with the processing liquid.

The processing liquid drying control section 116 controls the processing liquid drying processing section 16 in response to a command issued from the system controller 100. Specifically, driving of the processing liquid drying processing unit 50 is controlled such that the sheets of paper P conveyed by the processing liquid drying processing drum 46 undergo a drying process.

The image recording control section 118 controls the image recording section 18 in response to a command issued from the system controller 100. Specifically, driving of the ink jet heads 200C, 200M, 200Y, and 200K is controlled such that predetermined images are recorded on the sheets of paper P which are conveyed by the image recording drum 52. Further, an operation of the in-line sensor 58 is controlled such that the recorded images are read.

The ink drying control section 120 controls the ink drying processing section 20 in response to a command issued from the system controller 100. Specifically, driving of the ink drying processing units 68 is controlled such that hot air is blown onto the sheets of paper P which are conveyed by the chain gripper 64.

The ultraviolet irradiation control section 122 controls the ultraviolet irradiation section 22 in response to a command issued from the system controller 100. Specifically, driving of the ultraviolet irradiation units 74 is controlled such that the sheets of paper P conveyed by the chain gripper 64 are irradiated with ultraviolet light.

The sheet discharge control section 124 controls the sheet discharging section 24 in response to a command issued from the system controller 100. Specifically, driving of the sheet discharging tray lifting mechanism, and the like, is controlled such that the sheets of paper P are stacked on the sheet discharging tray 76.

The operating section 130 includes necessary operating means (such as operating buttons, a keyboard, and a touch panel), and outputs operation information, which is input through the operating means, to the system controller 100. The system controller 100 executes various kinds of processing on the basis of the operational information which is input from the operating section 130.

The display section 132 includes a necessary display device (such as an LCD panel), and causes the display device to display necessary information in response to a command issued from the system controller 100.

The nonvolatile memory 134 is formed as, for example, an electrically erasable programmable read only memory (EEPROM) or the like, and various kinds of data necessary for control and various kinds of setting information are recorded therein.

As described above, the ink jet recording apparatus 10 receives image data to be recorded on the sheets from the host computer through the communication section 102. The received image data is stored in the image memory 104.

The system controller 100 generates dot data by performing necessary signal processing on the image data stored in the image memory 104. Then, the system controller 100 controls the driving of the ink jet heads 200C, 200M, 200Y, and 200K of the image recording section 18 on the basis of the generated dot data, so as to record images, which are represented by the image data, on the sheets.

In general, the dot data is generated by performing color conversion processing and halftone processing on the image data. The color conversion processing is processing for converting image data represented by sRGB or the like (for example, RGB 8-bit image data) into ink volume data of each color of ink used by the ink jet recording apparatus 10 (in the present example, ink volume data of the respective colors of C, M, Y, and K). The halftone processing is processing for converting the ink volume data of the colors generated by the color conversion processing into dot data of respective colors by error diffusion processing or the like.

The system controller 100 generates dot data of the colors by performing the color conversion processing and the halftone processing on the image data. Then, an image represented by the image data is recorded on the sheet by controlling the driving of the corresponding ink jet heads, on the basis of the generated dot data of the colors.

Further, as described later, the system controller 100 draws an image with a predetermined test pattern on the sheet of paper P at the time of positioning the head modules constituting the ink jet heads 200C, 200M, 200Y, and 200K. Then, the system controller 100 causes the in-line sensor 58 to read the drawn image, and processes the read image, thereby performing processing of calculating the amounts of correction for the mounting positions of the respective head modules.

It should be noted that, although not shown in the drawing, the ink jet recording apparatus 10 has a maintenance section adjacent to the image recording section 18. The maintenance section performs maintenance of the ink jet heads 200. The maintenance section includes a cap that covers the nozzle surfaces of the ink jet heads 200, and a cleaning device that cleans the nozzle surfaces. The head unit 56 is provided to be movable between the image recording section 18 and the maintenance section through a head section transport mechanism, and is subjected to the maintenance process by the maintenance section as necessary. For example, in such a case where the operation of the apparatus is stopped for a long period of time, the ink jet heads 200 move to the maintenance section, and the nozzle surfaces thereof are covered by the cap. Thereby, the nozzle surfaces are prevented from drying. Further, since the nozzle surfaces of the ink jet heads 200 are contaminated through usage, the cleaning device periodically cleans the nozzle surfaces. For example, the nozzle surfaces are cleaned by scraping a blade or a web on the nozzle surfaces.

Recording Operation of Ink Jet Recording Apparatus

Next, an operation of the ink jet recording apparatus 10 configured as described above at the time of image recording will be described.

When the system controller 100 is instructed to start a printing job through the operating section 130, a cycle-up process is performed. That is, preparatory operations are performed by the respective sections such that the operation of the apparatus can be stabilized.

When the cycle-up process is completed, a printing process is started. In other words, the sheets of paper P are sequentially fed from the sheet feeding section 12.

In the sheet feeding section 12, the sheets of paper P stacked on the sheet feeding tray 30 are fed in order from the top, one sheet at a time, by the sucker device 32. The sheets of paper P, which are fed from the sucker device 32, are loaded onto the feeder board 36, one sheet at a time, through the sheet feeding roller pair 34.

The sheet of paper P, which is loaded on the feeder board 36, is delivered by the tape feeder 36A provided on the feeder board 36, and is conveyed to the sheet feeding drum 40 while sliding over the feeder board 36. At this time, the sheets of paper P are sequentially fed to the sheet feeding drum 40 while sliding over the feeder board 36 one sheet at a time, without any overlap between the sheets of paper P. Further, in the course of this conveyance, the upper surface of the sheet of paper P is tightly pressed against the feeder board 36 by the retainers 36B. Thereby, unevenness of the sheet is smoothed.

The leading end of the sheet of paper P, which is conveyed to the end of the feeder board 36, is brought into direct contact with the front contact portion 38, and subsequently the sheet of paper P is delivered to the sheet feeding drum 40. Consequently, it is possible to feed the sheets of paper P to the sheet feeding drum 40 in a regular posture, without causing occurrence of skew.

The sheet feeding drum 40 receives the sheet of paper P by gripping the leading end of the sheet of paper P with the gripper 40A while rotating, and conveys the sheet of paper P towards the processing liquid coating section 14.

The sheet of paper P, which is conveyed to the processing liquid coating section 14, is delivered from the sheet feeding drum 40 to the processing liquid coating drum 42.

The processing liquid coating drum 42 receives the sheet of paper P by gripping the leading end of the sheet of paper P with the gripper 40A while rotating, and conveys the sheet of paper P towards the processing liquid drying processing section 16. In the course of conveyance performed by the processing liquid coating drum 42, the processing liquid coating device 44 coats the surface of the sheet of paper P with the processing liquid.

The sheet of paper P, of which the surface is coated with the processing liquid, is delivered from the processing liquid coating drum 42 to the processing liquid drying processing drum 46.

The processing liquid drying processing drum 46 receives the sheet of paper P by gripping the leading end of the sheet of paper P while rotating, and conveys the sheet of paper P towards the image recording section 18. In the course of conveyance performed by the processing liquid drying processing drum 46, the sheet of paper P undergoes a drying process while hot air is blown onto the surface of the sheet from the processing liquid drying processing unit 50. Thereby, the solvent component in the processing liquid is removed, and an ink aggregate layer is formed on the surface of the sheet of paper P (image recording surface).

The sheet of paper P, which is subjected to the process of drying the processing liquid, is delivered from the processing liquid drying processing drum 46 to the image recording drum 52.

The image recording drum 52 receives the sheet of paper P by gripping the leading end of the sheet of paper P while rotating, and conveys the sheet of paper P towards the ink drying processing section 20. In the course of conveyance performed by the image recording drum 52, an image is recorded by ejecting droplets of inks of the respective colors of C, M, Y, and K onto the surface of the sheet of paper P through the ink jet heads 200C, 200M, 200Y, and 200K. Further, the image recorded in the course of this conveyance is read by the in-line sensor 58. At this time, the sheet of paper P is conveyed while being sucked and held on the circumferential surface of the image recording drum 52. Then, the processes of image recording and reading of the recorded image are performed with the sheet sucked and held. Thereby, it is possible to record an image with high accuracy, and it is possible to read the image with high accuracy.

The sheet of paper P, on which an image is recorded, is delivered from the image recording drum 52 to the chain gripper 64.

The chain gripper 64 receives the sheet of paper P by gripping the leading end of the sheet of paper P with the gripper 64D provided on the running chain 64C, and conveys the sheet of paper P towards the sheet discharging section 24.

First, the sheet of paper P undergoes an ink drying process in the course of conveyance performed by the chain gripper 64. That is, hot air is blown towards the surface of the sheet of paper P from the ink drying processing units 68 which are provided in the first horizontal conveying path 70A. Thereby, the drying process is performed. At this time, the sheet of paper P is conveyed while the rear surface thereof is sucked and held by the guide plate 72, and thus back tension is applied to the sheet of paper P. Consequently, it is possible to perform the drying process while suppressing deformation of the sheet of paper P.

The sheet of paper P (the sheet of paper P which has passed through the ink drying processing section 20), which has been subjected to the drying process, is subsequently subjected to ultraviolet irradiation. That is, ultraviolet light is emitted onto the surface of the sheet of paper P from the ultraviolet irradiation units 74 which are provided in the inclined conveying path 70B. Thereby, the ink, which forms an image, is cured, and the image is fixed onto the sheet of paper P. At this time, the sheet of paper P is conveyed while the rear surface thereof is sucked and held by the guide plate 72, and thus back tension is applied to the sheet of paper P. Consequently, it is possible to perform a fixing process while suppressing deformation of the sheet of paper P.

The sheet of paper P (the sheet of paper P which has passed the ultraviolet irradiation section 22), which has been subjected to ultraviolet irradiation, is conveyed towards the sheet discharging section 24, released from the gripper 64D in the sheet discharging section 24, and stacked on top of the sheet discharging tray 76.

The image recording process is completed by the series of operations described above. As described above, the sheets of paper P are consecutively fed from the sheet feeding section 12, and thus the sheets of paper P are consecutively processed by the respective sections.

Configuration of Head

As described above, the ink jet heads 200C, 200M, 200Y, and 200K of the present embodiment are formed as line heads, each of which has a length corresponding to the sheet width.

It should be noted that the respective ink jet heads 200C, 200M, 200Y, and 200K have the same configurations, and thus the configuration will be described herein as a configuration of an ink jet head 200.

Figure 3:
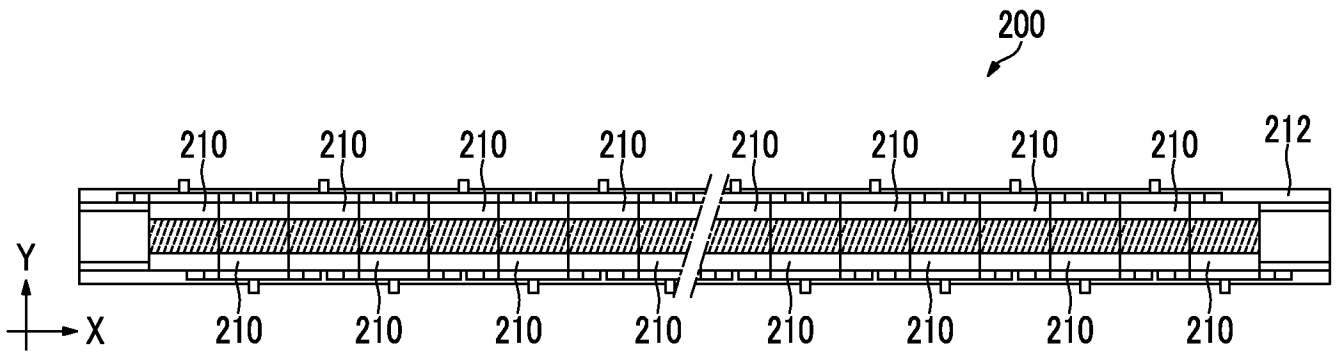
FIG. 3 is a bottom plan view illustrating a structure of a principal section of an ink jet head.
Figure 4:
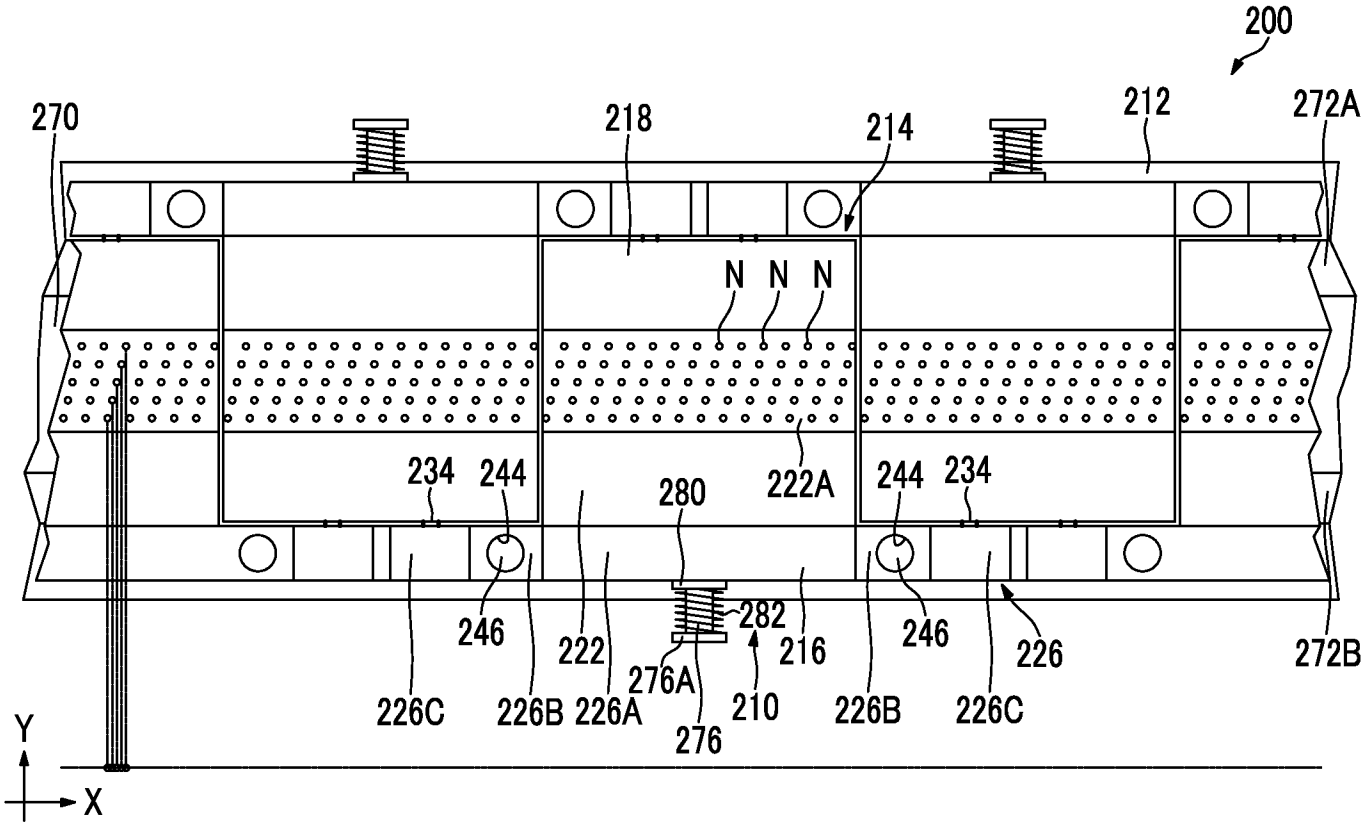
FIG. 4 is an enlarged diagram illustrating a part of FIG. 3 in an enlarged manner.
Figure 5:
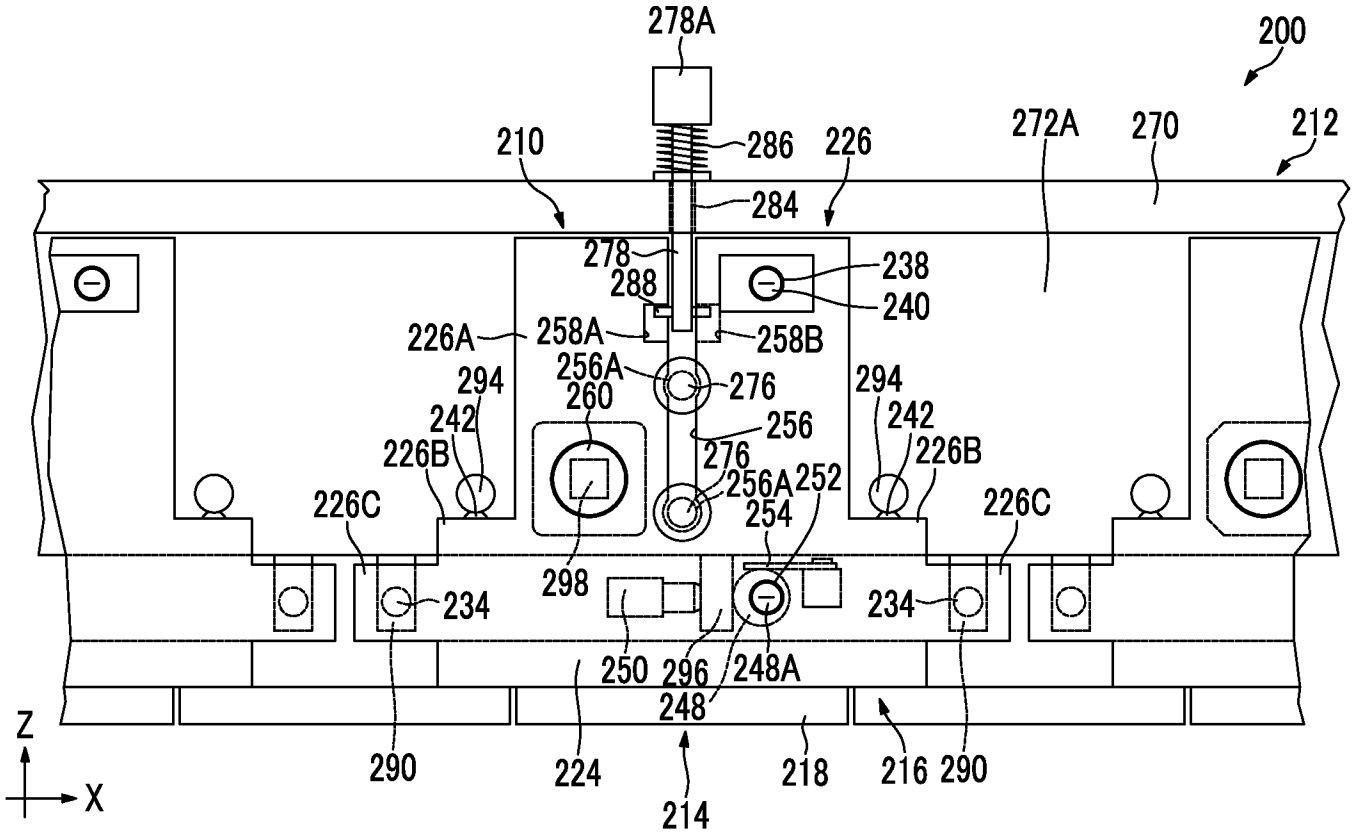
FIG. 5 is a front view illustrating the structure of the principal section of the ink jet head.
Figure 6:
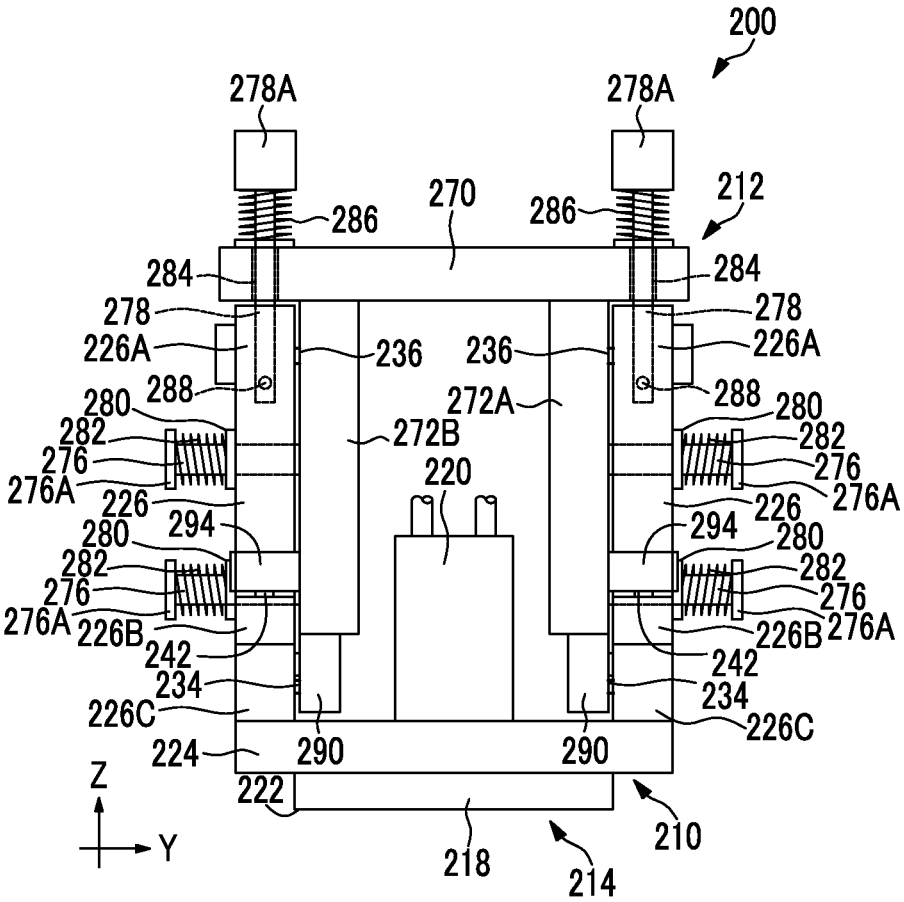
FIG. 6 is a side view illustrating the structure of the principal section of the ink jet head.

FIG. 3 is a bottom plan view (a diagram of a head viewed from the nozzle surface side) illustrating a structure of a principal section of the head. FIG. 4 is an enlarged diagram illustrating a part of FIG. 3 in an enlarged manner. FIG. 5 is a front view illustrating the structure of the principal section of the head. FIG. 6 is a side view illustrating the structure of the principal section of the head.

As shown in the drawing, the ink jet head 200 is formed of a plurality of head modules 210 connected in line. The respective head modules 210 have the same structures, and are arranged in line on a base frame 212, thereby constituting one ink jet head 200.

Hereinafter, configurations of the head modules 210 and the base frame 212 will be described.

It should be noted that, in the following description, an arrangement direction of the nozzles of the ink jet head 200 (a direction of the nozzle array) is assumed as an X direction, a direction orthogonal to the nozzle surface is assumed as a Z direction, and a direction parallel to the nozzle surface and orthogonal to the X direction is assumed as a Y direction. The X direction, the Y direction, and the Z direction are orthogonal to one another.

Head Module

The head modules 210 are so-called short heads, and each module is able to record an image with a predetermined print width alone. The multiple head modules 210 are connected along the direction of the nozzle array (the direction orthogonal to the conveying direction of the sheet of paper P), thereby constituting a single long head.

Figure 7:
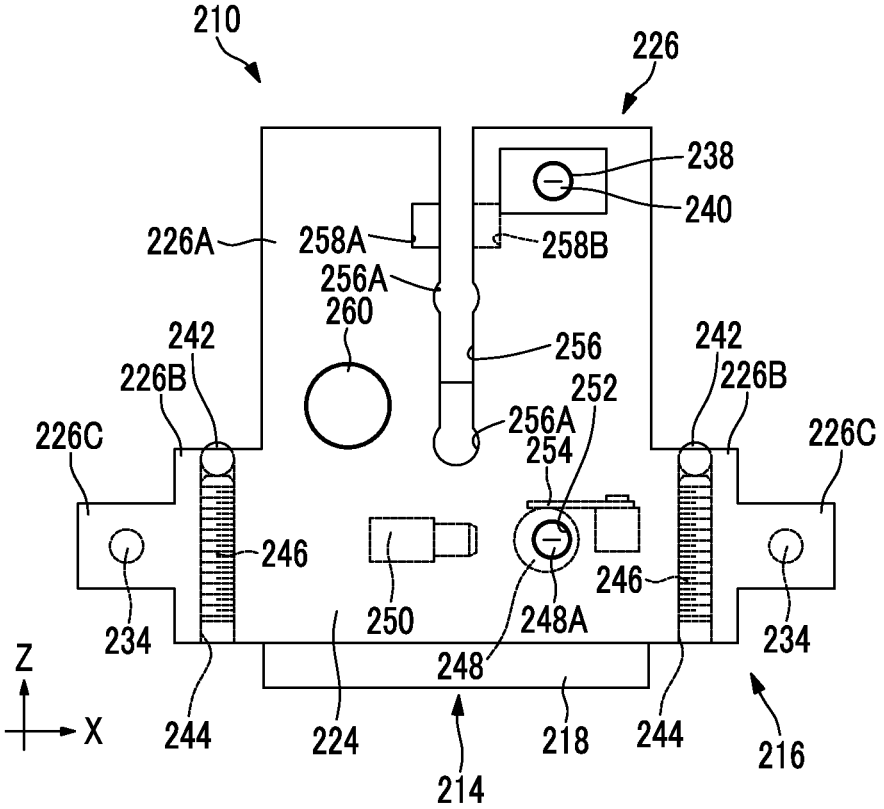
FIG. 7 is a front view of a head module.
Figure 8:
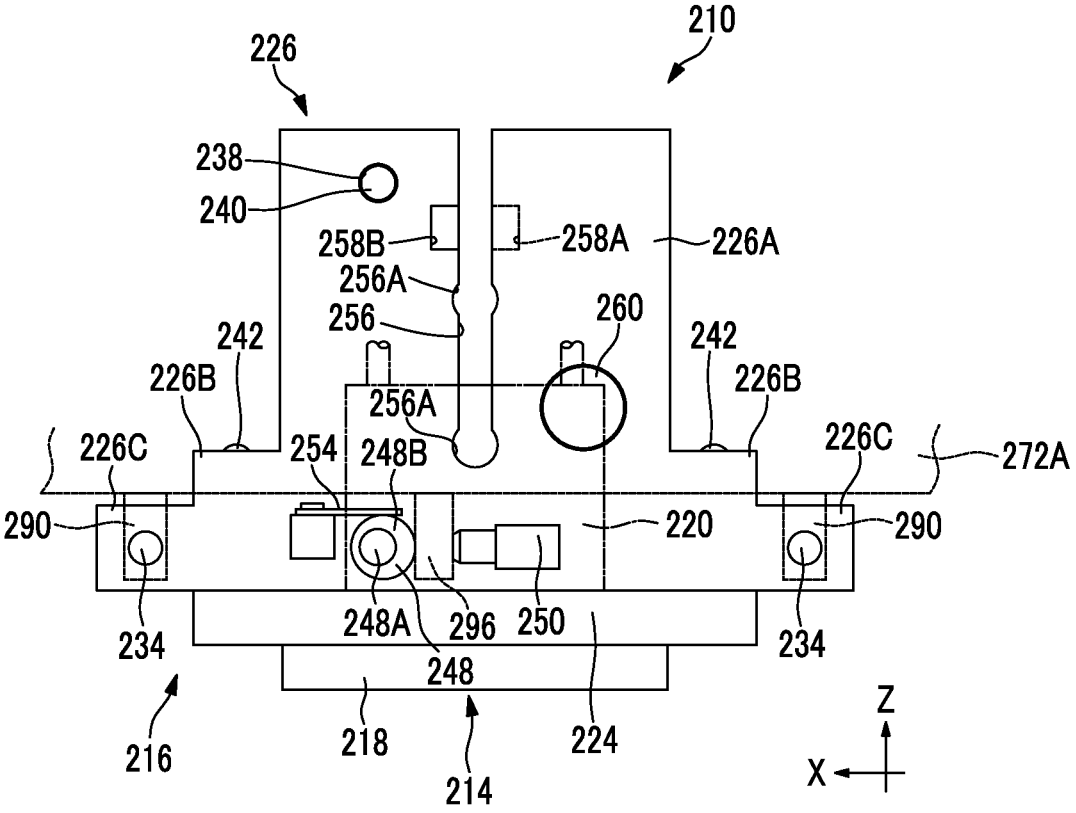
FIG. 8 is a rear view of the head module.
Figure 9:
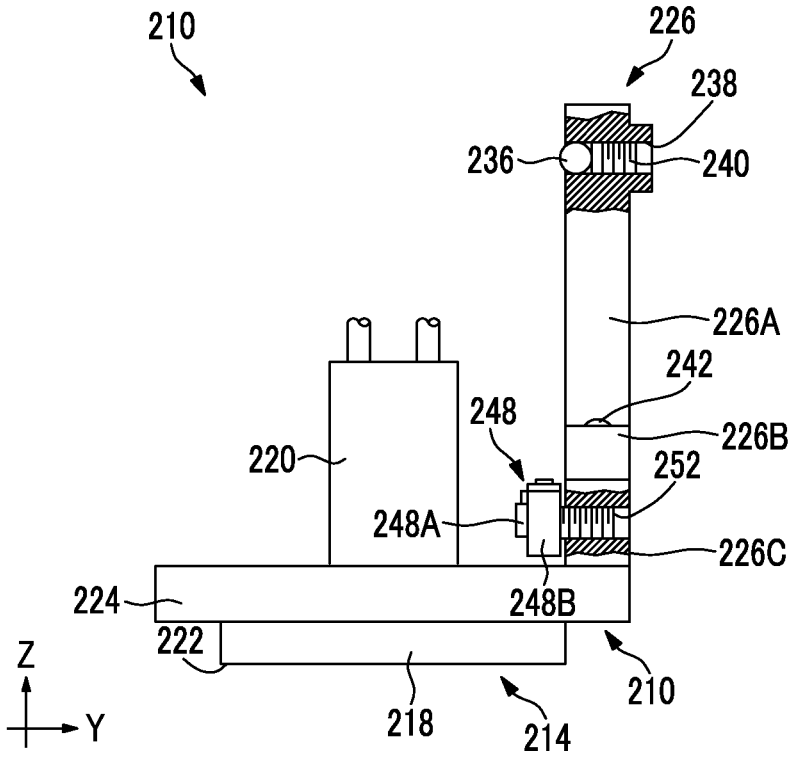
FIG. 9 is a cross-sectional view of a side surface part of the head module.

FIG. 7 is a front view of the head module. FIG. 8 is a rear view of the head module. FIG. 9 is a cross-sectional view of a side surface part of the head module.

The head module 210 includes an ink jet head 214 that discharges ink, and a bracket 216 that is for mounting the ink jet head 214 on the base frame 212.

The ink jet head 214 mainly includes a head main body portion 218 and an electric pipe portion 220.

The head main body portion 218 has a rectangular plate shape. The head main body portion 218 has a nozzle surface 222 provided on the lower surface part thereof. The nozzle surface 222 has a band-like nozzle formation region 222A at the center thereof. The nozzle formation region 222A has a regular width, and is formed along the X direction. Nozzles N are formed in the nozzle formation region 222A.

Here, in the ink jet head 214 of the present example, as shown in FIG. 4, the nozzles N are arranged in a two-dimensional matrix shape. Specifically, the nozzles are arranged with regular pitches along the X direction, and are arranged with regular pitches along a direction which is at a predetermined angle to the X direction. By arranging the nozzles N in such a manner, it is possible to decrease actual intervals between the nozzles N projected in the X direction. In this case, the arrangement direction of the nozzles N (the direction of the nozzle array) is set as the X direction. It should be noted that the nozzles N may be arranged in line along the X direction.

The electric pipe portion 220 is a group of pipes, a circuit board, and the like, and is provided on the top of the head main body portion 218.

The bracket 216 is formed in an L shape so as to include a horizontal portion 224 and a vertical portion 226.

The horizontal portion 224 functions as a mounting portion of the ink jet head 214. The vertical portion 226 functions as a mounting portion onto the base frame 212.

The horizontal portion 224 has a rectangular plate shape. The horizontal portion 224 is formed in a shape (rectangular shape) which is substantially the same as the outer shape of the head main body portion 218 of the ink jet head 214. The head main body portion 218 of the ink jet head 214 is mounted on the lower surface part of the horizontal portion 224. The horizontal portion 224 includes an opening portion 224A through which the electric pipe portion 220 of the ink jet head 214 passes.

The vertical portion 226 also has a plate shape. The vertical portion 226 is disposed vertically to the horizontal portion 224, is bonded to one end of the horizontal portion 224, and is integrated with the horizontal portion 224.

The vertical portion 226 includes: a vertical portion main body 226A that is formed to have a width substantially the same as that of the horizontal portion 224; a pair of first protruding portions 226B that is formed to protrude in the X direction from the both sides of the vertical portion main body 226A; and a pair of second protruding portions 226C that is formed to further protrude in the X direction from the pair of first protruding portions 226B.

The vertical portion 226 is provided with Y-directional head module positioning unit that is set as a reference for positioning the head module 210 in the Y direction when mounting the head module 210 on the base frame 212, Z-directional head module positioning unit that is set as a reference for positioning the head module 210 in the Z direction, and a part of X-directional mounting position adjustment unit that finely adjusts the mounting position in the X direction.

The Y-directional head module positioning unit includes: two Y-directional head module fixed-contact members 234 constituting a Y-directional head module positioning member; and a pair of Y-directional head module movable-contact member 236 constituting the same Y-directional head module positioning member.

The two Y-directional head module fixed-contact members 234 are provided on a second protruding portion 226C of the vertical portion 226. Each Y-directional head module fixed-contact member 234 is formed as a rigid sphere (a sphere having rigidity). The Y-directional head module fixed-contact member 234 is inserted into a hole (not shown in the drawing) which is formed in the second protruding portion 226C, and a part of the member is provided to protrude by a predetermined length from an inner surface of the second protruding portion 226C (a surface facing the base frame 212 when the head module 210 is mounted on the base frame 212).

Meanwhile, the Y-directional head module movable-contact member 236 is provided on the vertical portion main body 226A of the vertical portion 226. The Y-directional head module movable-contact member 236 is formed as a rigid sphere, is inserted into a Y-directional head module movable-contact member insertion hole 238 which is formed in the vertical portion main body 226A, and is provided on the vertical portion main body 226A. The Y-directional head module movable-contact member insertion hole 238 is formed along the Y direction, and is formed to penetrate from an outer surface of the vertical portion main body 226A to an inner surface thereof. The Y-directional head module movable-contact member 236 is inserted into the Y-directional head module movable-contact member insertion hole 238, and is provided to be able to protrude from the inner surface of the vertical portion main body 226A. In addition, the Y-directional head module movable-contact member insertion hole 238 is formed in such a manner that a diameter of the hole on the inner surface side of the vertical portion main body 226A is reduced not to drop the Y-directional head module movable-contact member 236.

The Y-directional head module movable-contact member insertion hole 238 is formed as a screw hole, and a Y-directional head module movable-contact member position adjustment screw 240 is threadedly engaged into the hole. The Y-directional head module movable-contact member position adjustment screw 240 is formed as a so-called set screw (a screw of which a screw head part has the same size as a screw body part). By adjusting a threaded amount of the Y-directional head module movable-contact member position adjustment screw 240, an amount of protrusion from the inner surface of the vertical portion main body 226A of the Y-directional head module movable-contact member 236 is adjusted.

As described later, the Y-directional head module fixed-contact members 234 and the Y-directional head module movable-contact member 236 are brought into direct contact with Y-directional fixed-contact base frame positioning members 290 provided on the base frame 212 side and a Y-directional movable-contact base frame positioning member 292, when the head module 210 is mounted on the base frame 212. Thereby, the position of the head module 210 is set in the Y direction relative to the base frame 212.

The Z-directional head module positioning unit includes a pair of Z-directional head module contact members 242 constituting the Z-directional head module positioning member.

The pair of Z-directional head module contact members 242 is provided on the first protruding portion 226B of the vertical portion 226. Each Z-directional head module contact member 242 is formed as a rigid sphere. The Z-directional head module contact member 242 is inserted into a Z-directional head module contact member insertion hole 244 which is formed in the first protruding portion 226B, and is provided on the first protruding portion 226B. The Z-directional head module contact member insertion hole 244 is formed along the Z direction, and is formed to penetrate from the lower surface of the first protruding portion 226B to the upper surface thereof. The Z-directional head module contact member 242 is inserted into the Z-directional head module contact member insertion hole 244, and is provided such that a part thereof is able to protrude from the upper surface of the first protruding portion 226B. In addition, the Z-directional head module contact member insertion hole 244 is formed in such a manner that a diameter of the hole on the upper surface side of the first protruding portion 226B is reduced not to drop the Z-directional head module contact member 242.

The Z-directional head module contact member insertion hole 244 is formed as a screw hole. A Z-directional head module contact member position adjustment screw 246 is threadedly engaged into the Z-directional head module contact member insertion hole 244. The Z-directional head module contact member position adjustment screw 246 is formed as a so-called set screw. By adjusting a threaded amount of the Z-directional head module contact member position adjustment screw 246, an amount of protrusion from the upper surface of the first protruding portion 226B of the Z-directional head module contact member 242 is adjusted.

As described later, the Z-directional head module contact members 242 are brought into direct contact with a Z-directional base frame contact members 294 which are provided on the base frame 212 side, when the head module 210 is mounted on the base frame 212. Thereby, the position of the head module 210 is set in the Z direction relative to the base frame 212.

In addition, it is preferable that an installation interval (an installation interval in the X direction) between the pair of Z-directional head module contact members 242 is set to be longer than a printing area width (a length of the entire nozzle array) of the ink jet head 214. Thereby, it is possible to increase stability at the time of mounting, and thus it is possible to improve positioning accuracy in the Z direction.

Further, likewise, it is also preferable that an installation interval (an installation interval in the X direction) between the pair of Y-directional head module fixed-contact members 234 is set to be longer than a printing area width (the length of the entire nozzle array) of the ink jet head 214. Thereby, it is possible to increase stability at the time of mounting, and thus it is possible to improve positioning accuracy in the Y direction.

The X-directional mounting position adjustment unit constituting the mounting position adjustment unit mainly includes an eccentric roller 248, a plunger 250, and an X-directional positioning reference pin 296. The eccentric roller 248 and the plunger 250 are provided in the head module 210, and the X-directional positioning reference pin 296 is provided on the base frame 212.

The eccentric roller 248 and the plunger 250 are disposed on the inner surface side of the vertical portion main body 226A. The eccentric roller 248 and the plunger 250 are separated at a regular interval while facing each other.

The eccentric roller 248 includes a shaft portion 248A and a roller portion 248B. The shaft portion 248A functions as a rotational shaft for rotating the roller portion 248B, and is connected eccentrically to the roller portion 248B. Hence, when the shaft portion 248A is rotated, the roller portion 248B is eccentrically rotated.

The shaft portion 248A of the eccentric roller 248 is formed as a male screw. The shaft portion 248A is inserted through an eccentric roller mounting hole 252 of the vertical portion main body 226A. The eccentric roller mounting hole 252 is formed as a screw hole, and is formed in parallel with the Y direction. The eccentric roller mounting hole 252 is formed to penetrate from the outer surface side of the vertical portion main body 226A to the inner surface side thereof. The eccentric roller 248 is mounted on the vertical portion main body 226A by threadedly engaging the shaft portion 248A into the eccentric roller mounting hole 252. A groove (embossed or depressed groove) for rotating the shaft portion 248A through a screw driver is formed on the base end section of the shaft portion 248A of the eccentric roller 248. In the eccentric roller 248 mounted on the vertical portion main body 226A, by rotating the shaft portion 248A through a screw driver, the roller portion 248B is eccentrically rotated.

A leaf spring 254 is brought into direct pressure contact with the roller portion 248B. The leaf spring 254 is disposed on the inner surface side of the vertical portion main body 226A. The leaf spring 254 is brought into direct contact with the circumferential surface of the roller portion 248B so as to press the roller portion 248B in the axial direction. The leaf spring 254 applies a constant resistance to rotation of the roller portion 248B.

The plunger 250 functions as X-directional biasing unit. The plunger 250 is disposed along the X direction, and the leading end (pressing portion) thereof is disposed to face the eccentric roller 248.

As described above, the eccentric roller 248 and the plunger 250 are separated at a constant distance while facing each other. When the head module 210 is mounted on the base frame 212, the X-directional positioning reference pin 296 provided on the base frame side is nailed into the space between the eccentric roller 248 and the plunger 250, and is sandwiched by the eccentric roller 248 and the plunger 250. The plunger 250 presses the X-directional positioning reference pin 296 in the X direction. Thereby, the head module 210 is biased in the X direction. In this state, when the eccentric roller 248 is rotated, the head module 210 moves in the X direction in accordance with the amount of rotation.

A guide groove 256 for mounting the bracket 216 on the base frame 212 is further formed on the vertical portion 226 of the bracket 216. The guide groove 256 is formed on the vertical portion main body 226A of the vertical portion 226, and is formed with a predetermined width and a predetermined depth in a vertically downward direction (Z direction) from the upper surface portion of the vertical portion main body 226A. A pair of Y-directional guide posts 276, which is provided on the base frame side, is nailed into the guide groove 256 when the bracket 216 is mounted on the base frame 212. Hence, a width of the guide groove 256 is formed to be approximately equal to a width (diameter) of the Y-directional guide post 276. Thereby, it is possible to prevent the adjacent head modules 210 from interfering with each other.

In the guide groove 256, enlarged diameter portions 256A having arc shapes are formed at the leading end portion (lower end portion) and at the substantially central portion. When the head module 210 is mounted at a predetermined position of the base frame 212, the pair of Y-directional guide posts 276, which is provided on the base frame side, is housed in the enlarged diameter portions 256A. Thereby, the head module 210 mounted on the base frame 212 is movably supported.

As described above, the enlarged diameter portions 256A of the guide groove 256 are provided to movably support the head module 210. Therefore, regarding the formation positions, the enlarged diameter portions 256A are formed to correspond to the Y-directional guide posts 276, and are formed to house the Y-directional guide posts 276 at the substantially central position when the head module 210 is mounted on the base frame 212. Here, when the head module 210 is mounted on the base frame 212, each enlarged diameter portion 256A is formed in a circular shape centered on the axis of the Y-directional guide post 276. The circular shape is formed to have a diameter larger than that of the Y-directional guide posts 276. Thereby, when the head module 210 is mounted on the base frame 212, the head module 210 is movably supported in a predetermined range. Further, when the head module 210 is mounted on the base frame 212, the mounting can be performed without causing rattling in the head module 210.

Further, a pair of notch portions 258A and 258B is formed on the inner wall surface of the guide groove 256. The pair of notch portions 258A and 258B is engaged with a locking bar 288 of a Z-directional hanging rod 278, which is provided on the base frame side, when the bracket 216 is mounted on the base frame 212. The bracket 216 is locked in the base frame 212 by engaging the locking bar 288 of the Z-directional hanging rod 278 with the notch portions 258A and 258B. The notch portions 258A and 258B are formed to face the inner wall surface of the guide groove 256, and are respectively formed to have predetermined depths on the inner surface side and the outer surface side of the vertical portion 226 of the bracket 216. That is, one notch portion 258A is formed on the outer surface side of the vertical portion 226, and the other notch portion 258B is formed on the inner surface side thereof.

Furthermore, the vertical portion 226 of the bracket 216 is provided with a magnet 260 for detecting an amount of displacement (amount of movement) of the head module 210 when the head module 210 is mounted on the base frame 212. The magnet 260 and a magnetic sensor 298, which is provided on the base frame 212 side, constitute position detection unit. When the head module 210 is mounted on the base frame 212, the magnet 260 is disposed to face the magnetic sensor 298 which is provided on the base frame 212 side.

The head module 210 is configured as described above.

Base Frame

Figure 10:
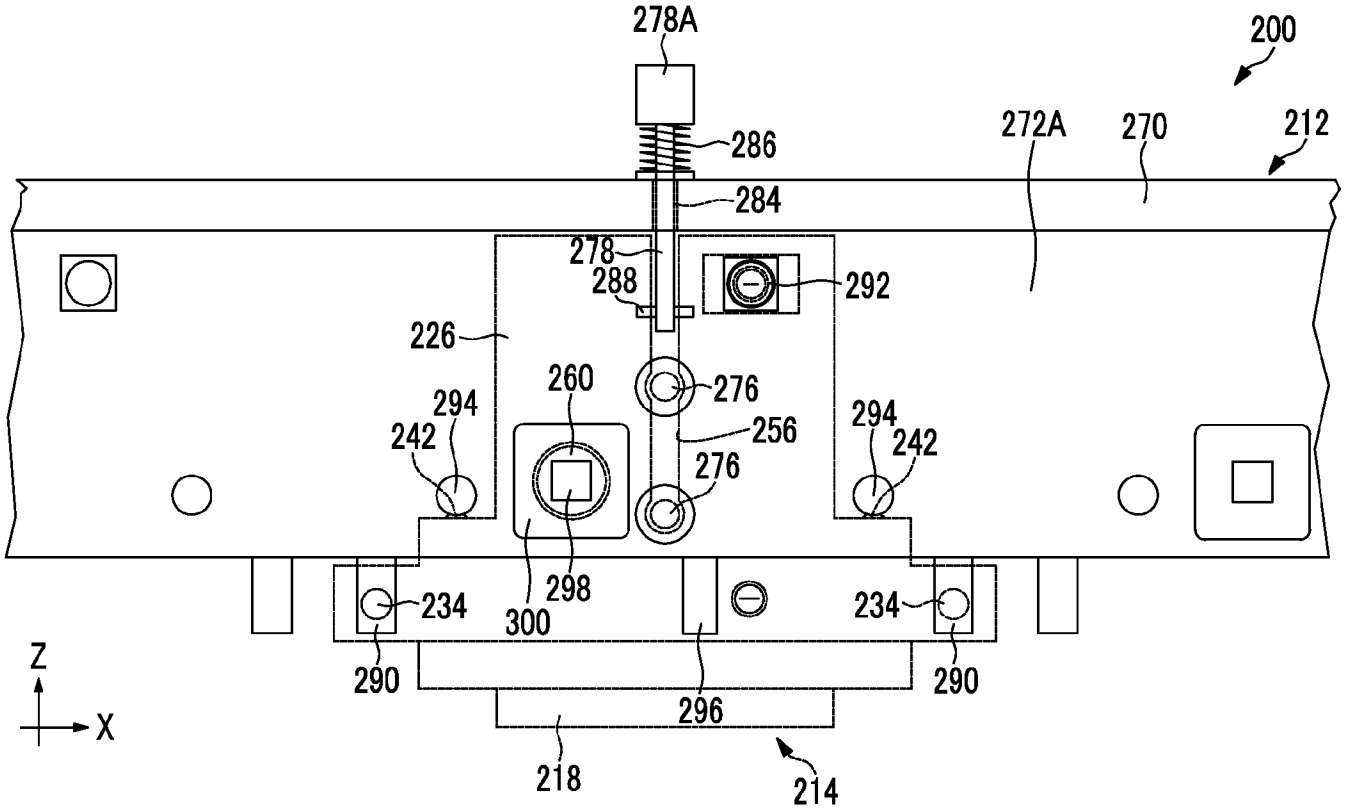
FIG. 10 is a front view illustrating a structure of a principal section of a base frame.
Figure 11:
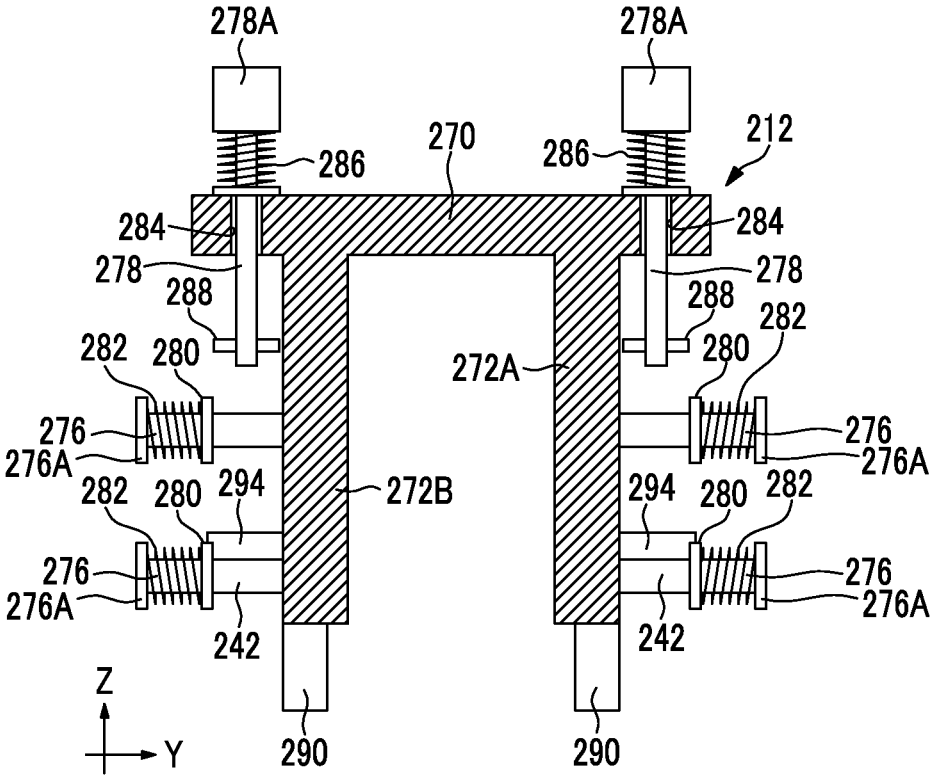
FIG. 11 is a side surface cross-sectional view illustrating the structure of the principal section of the base frame.

FIG. 10 is a front view illustrating a structure of a principal section of the base frame. Further, FIG. 11 is a side surface cross-sectional view illustrating the structure of the principal section of the base frame.

The base frame 212 mainly includes an upper frame portion 270 and a pair of lower frame portions 272A and 272B.

The upper frame portion 270 has a rectangular plate shape. The upper frame portion 270 is disposed horizontally (in parallel with an XY plane). The pair of lower frame portions 272A and 272B has rectangular plate shapes. The pair of lower frame portions 272A and 272B is disposed vertically (in parallel with an XZ plane) to the lower portion of the upper frame portion 270 with a regular interval.

The pair of lower frame portions 272A and 272B functions as mounting portions for mounting the head modules 210. The head modules 210 are alternately mounted on the pair of lower frame portions 272A and 272B. That is, one lower frame portion 272A is referred to as a first lower frame (first mounting portion), and the other lower frame portion 272B is referred to as a second lower frame (second mounting portion). In this case, the first head module 210 is mounted on the first lower frame portion 272A, and the second head module 210 disposed in the vicinity thereof is mounted on the second lower frame portion 272B. Further, the third head module 210, which is disposed in the vicinity of the second head module 210, is mounted on the first lower frame portion 272A, and the fourth head module, which is disposed in the vicinity of the third head module, is mounted on the second lower frame portion 272B. With such a configuration, the head modules 210 are alternately mounted on the first lower frame portion 272A and the second lower frame portion 272B.

The base frame 212 is provided with head module support unit that supports the head module 210. The head module support unit is provided for each head module. As described above, the head modules 210 are alternately mounted on the pair of lower frame portions 272A and 272B. Therefore, the head module support units are alternately provided on the pair of lower frame portions 272A and 272B. Consequently, an installation interval (an installation interval in the X direction) between the head module support unit coincides with an installation interval (an installation interval in the X direction) between the head modules 210 which are mounted on the respective lower frame portions 272A and 272B.

The head module support unit includes the pair of Y-directional guide posts 276 and the Z-directional hanging rod 278.

The pair of Y-directional guide posts 276 is arranged in parallel so as to have a regular interval in an up-down direction (Z direction). Each Y-directional guide post 276 is formed in a columnar shape. The Y-directional guide post 276 has a flange portion 276A at the top thereof. The Y-directional guide posts 276 are provided to protrude from outer side surface of the lower frame portions 272A and 272B, and are arranged in parallel with the Y direction. A width (diameter) of the Y-directional guide post 276 is formed to be approximately equal to the width of the guide groove 256.

As described above, when the head module 210 is mounted on the base frame 212, the guide groove 256, which is formed on the vertical portion 226 of the bracket 216, is fit to the pair of Y-directional guide posts 276. Since the width (diameter) of the Y-directional guide post 276 is formed to be approximately equal to the width of the guide groove 256, the mounting can be performed without causing rattling.

Each of the pair of Y-directional guide posts 276 has a Y-directional pressure plate 280. The Y-directional pressure plate 280 is formed in a ring shape. The Y-directional guide post 276 is inserted through the inner circumferential portion of the Y-directional pressure plate 280, and the Y-directional pressure plate 280 is provided on the Y-directional guide post 276.

Further, each of the pair of Y-directional guide posts 276 has a Y-directional pressure spring 282 as the Y-directional biasing unit. The Y-directional guide post 276 is inserted through the inner circumferential portion of the Y-directional pressure spring 282, and the Y-directional pressure spring 282 is provided on the Y-directional guide post 276. The Y-directional pressure spring 282 is disposed between the Y-directional pressure plate 280 and the flange portion 276A of the Y-directional guide post 276.

As described above, when the head module 210 is mounted on the base frame 212, the pair of Y-directional guide posts 276 is fit into the guide groove 256. When the pair of Y-directional guide posts 276 is fit into the guide groove 256, the Y-directional pressure plates 280 are engaged with the vertical portion 226 of the bracket 216. Since the Y-directional pressure plate 280 is biased by the Y-directional pressure spring 282 in the Y direction, the head module 210 is pressed against the base frame 212 by the Y-directional pressure plate 280.

Here, the pair of Y-directional guide posts 276 is disposed with a regular interval in the up-down direction as described above. However, as the Y-directional pressure springs 282 provided on the respective Y-directional guide posts 276, springs having different biasing forces, that is, different spring constants are used. Specifically, as the Y-directional pressure spring 282 provided on the lower Y-directional guide post 276, a spring, which has a spring constant greater than that of the Y-directional pressure spring 282 provided on the upper Y-directional guide post 276, is used. As a result, a pressure applied by the Y-directional pressure plate 280, which is provided on the lower Y-directional guide post 276, is greater than a pressure applied by the Y-directional pressure plate 280 which is provided on the upper Y-directional guide post 276. The reason is that each head module 210 is prevented from being tilted at the time of adjustment in the mounting position in the X direction. In other words, by increasing the spring constant of the Y-directional pressure spring 282 provided on the lower Y-directional guide post 276 close to the X-directional mounting position adjustment unit, the center of the rotation moment at the time of adjustment in the mounting position in the X direction is set in the vicinity of the X-directional mounting position adjustment unit, and thus it is possible to prevent the head module 210 from being tilted (when the spring constant of the Y-directional pressure spring 282 provided on the upper Y-directional guide post 276 is set to be larger, the upper side of the head module 210 is unlikely to move, and tends to be tilted).

In the ink jet head 200 of the present embodiment, the X-directional mounting position adjustment unit is provided in the vicinity of the lower Y-directional guide post 276. Therefore, the spring constant of the Y-directional pressure spring 282 provided on the lower Y-directional guide post 276 is greater than the spring constant of the Y-directional pressure spring 282 provided on the upper Y-directional guide post 276. However, when the X-directional mounting position adjustment unit is provided in the vicinity of the upper Y-directional guide post 276, the spring constant of the Y-directional pressure spring 282 provided on the upper Y-directional guide post 276 is set to be greater than the spring constant of the Y-directional pressure spring 282 provided on the lower Y-directional guide post 276. That is, the spring constant of the Y-directional pressure spring 282 of the Y-directional guide post 276 provided to be closer to the X-directional mounting position adjustment unit is set to be greater than the spring constant of the Y-directional pressure spring 282 of the other Y-directional guide post 276. Thereby, it is possible to prevent the head module 210 from being tilted at the time of adjustment in the mounting position in the X direction.

Each Z-directional hanging rod 278 is formed in a columnar shape. The Z-directional hanging rod 278 has a knob portion 278A at the top thereof. The Z-directional hanging rod 278 is disposed in parallel with the Z direction. Z-directional hanging rod insertion holes 284 for mounting the Z-directional hanging rods 278 are formed in the upper frame portion 270. Each Z-directional hanging rod insertion hole 284 is formed along the Z direction, and is formed to penetrate from the upper surface portion of the upper frame portion 270 to the lower surface portion thereof. The Z-directional hanging rod 278 is inserted through the Z-directional hanging rod insertion hole 284, and is mounted on the upper frame portion 270.

The Z-directional hanging rods 278 mounted on the upper frame portion 270 are disposed in front of the outer side surfaces of the lower frame portions 272A and 272B.

Further, the Z-directional hanging rods 278 are disposed in the same line as the pair of Y-directional guide posts 276, and are disposed on the upper sides of the pair of Y-directional guide posts 276. Consequently, when the head module 210 is mounted on the base frame 212, the Z-directional hanging rods 278 are housed in the guide groove 256.

Each Z-directional hanging rod 278 includes a Z-direction pressure spring 286 as the Z-directional biasing unit. The Z-directional hanging rod 278 is inserted through the inner circumferential portion of the Z-direction pressure spring 286, and the Z-direction pressure spring 286 is provided on the Z-directional hanging rod 278. The Z-direction pressure spring 286 is disposed between the upper frame portion 270 and the knob portion 278A of the Z-directional hanging rod 278. As a result, the Z-directional hanging rod 278 is biased upward by the biasing force of the Z-direction pressure spring 286 (biased in a direction of moving up the rod toward the upper frame portion 270).

Further, the Z-directional hanging rod 278 has the locking bar 288 at the leading end (lower end). The locking bar 288 is provided to protrude to the right and left sides from the leading end of the Z-directional hanging rod 278 (provided to be orthogonal to an axial direction of the Z-directional hanging rod 278). The locking bar 288 is formed to be longer than the width of the guide groove 256. The locking bar 288 is fit into the notch portions 258A and 258B which are formed on the guide groove 256 on the head module 210 side, thereby locking the head module 210.

The fitting of the locking bar 288 into the notch portions 258A and 258B is performed by rotating the Z-directional hanging rod 278. That is, as described above, the locking bar 288 is formed to be longer than the width of the guide groove 256. Therefore, when the head module 210 is mounted on the base frame 212 in a state where the direction of the locking bar 288 is set to be the same as the width direction (X direction) of the guide groove 256, the locking bar 288 comes into direct contact with the inlet portion (upper end portion) of the guide groove 256. As a result, it is difficult to mount the head module 210.

Accordingly, when the head module 210 is mounted on the base frame 212, the locking bar 288 is positioned not to be in contact with the inner wall surface of the guide groove 256. In this state, the head module 210 is mounted on the base frame 212. Then, the head module 210 is mounted on the base frame 212, the locking bar 288 is set at the formation position of the notch portions 258A and 258B, and the Z-directional hanging rod 278 is rotated. Thereby, the locking bar 288 is fit into the notch portions 258A and 258B.

In addition, when the axial direction of the locking bar 288 is parallel to the width direction (X direction) of the guide groove 256, as described above, the locking bar 288 is fit into the notch portions 258A and 258B. The position of the locking bar 288 at this time is set as a locking position.

Meanwhile, when the axial direction of the locking bar 288 is orthogonal to the width direction (X direction) of the guide groove 256, as described above, the locking bar 288 is not in contact with the inner wall surface of the guide groove 256 (is shifted from the notch portions 258A and 258B). The position of the locking bar 288 at this time is set as an unlocked position.

The Z-directional hanging rods 278 are biased upward by the Z-direction pressure spring 286. Therefore, when the locking bars 288 are fit into the notch portions 258A and 258B, the locking bars 288 are engaged with the notch portions 258A and 258B (engaged with the top surfaces of the inner circumferential portions of the notch portions 258A and 258B). Thereby, the head module 210 mounted on the base frame 212 is biased upward.

The base frame 212 includes: Y-directional base frame positioning unit that positions the base frame 212 in the Y direction when the head module 210 is mounted on the base frame 212; and Z-directional base frame positioning unit that positions the base frame 212 in the Z direction.

The Y-directional base frame positioning unit includes: two Y-directional fixed-contact base frame positioning members 290 constituting a Y-directional base frame positioning member; and one Y-directional movable-contact base frame positioning member 292 constituting the same Y-directional base frame positioning member.

The two Y-directional fixed-contact base frame positioning members 290 are respectively formed as pins (for example, stainless steel pins) having rigidity, and are formed to have higher hardness than the Y-directional head module fixed-contact members 234. The two Y-directional fixed-contact base frame positioning members 290 are respectively provided to protrude downward (downward in the Z direction) from the lower surface portions of the lower frame portions 272A and 272B. The two Y-directional fixed-contact base frame positioning members 290 are provided with an interval equal to the installation interval between the two Y-directional head module fixed-contact members 234 which are provided on the head module 210 side, and are provided at positions, at which the circumferential surfaces thereof are in direct contact with the two Y-directional head module fixed-contact members 234, when the head module 210 is mounted on the base frame 212. Consequently, the two Y-directional fixed-contact base frame positioning members 290 are provided to correspond to the two Y-directional head module fixed-contact members 234 which are provided on the head module 210 side.

The Y-directional movable-contact base frame positioning member 292 is formed as a pin (for example, a stainless steel pin) having rigidity, and is formed to have higher hardness than the Y-directional head module movable-contact member 236. The Y-directional movable-contact base frame positioning member 292 is disposed on the lower frame portions 272A and 272B so as to be housed in the concave portions which are formed on the outer side surfaces of the lower frame portions 272A and 272B. The Y-directional movable-contact base frame positioning member 292 is disposed in parallel with the Y direction. The Y-directional movable-contact base frame positioning member 292 is provided at a position, at which the leading end thereof is in direct contact with the Y-directional head module movable-contact member 236 on the head module 210 side, when the head module 210 is mounted on the base frame 212. Consequently, the Y-directional movable-contact base frame positioning member 292 is provided to correspond to the Y-directional head module movable-contact member 236 which is provided on the head module 210 side.

As described above, when the head module 210 is mounted on the base frame 212, the head module 210 is pressed against the base frame 212 by the Y-directional pressure plates 280 provided on the Y-directional guide posts 276. Accordingly, when the head module 210 is mounted on the base frame 212, the two Y-directional head module fixed-contact members 234 provided on the head module 210 side are brought into direct pressure contact with the two Y-directional fixed-contact base frame positioning members 290 provided on the base frame 212 side. Further, the Y-directional head module movable-contact member 236 provided on the head module 210 side is brought into direct pressure contact with the Y-directional movable-contact base frame positioning member 292 provided on the base frame 212 side. Thereby, the position of the head module 210 mounted on the base frame 212 is set in the Y direction relative to the base frame 212.

In addition, as described above, the Y-directional fixed-contact base frame positioning members 290 are formed to have higher hardness than the Y-directional head module fixed-contact members 234, and the Y-directional movable-contact base frame positioning member 292 is formed to have higher hardness than the Y-directional head module movable-contact member 236. Thereby, it is possible to improve positional stability at the time of the positioning, and it is possible to improve accuracy in repetition of replacement of the head module 210.

As a method of achieving high hardness, it is possible to employ a method of using a material with high hardness, a method of achieving high hardness by applying surface treatment, or the like.

The Z-directional base frame positioning unit that positions the head module 210 on the base frame 212 in the Z direction is formed of the pair of Z-directional base frame contact members 294.

The two Z-directional base frame contact members 294 are formed as pins (for example, stainless steel pins) having rigidity, and are formed to have higher hardness than the Z-directional head module contact members 242. The two Z-directional base frame contact members 294 are respectively provided to protrude from the outer side surfaces of the lower frame portions 272A and 272B, and are disposed in parallel with the Y direction. The pair of Z-directional base frame contact members 294 is provided with an interval equal to the installation interval between the pair of Z-directional head module contact members 242 which are provided on the head module 210 side, and are positioned to be in direct contact with the pair of Z-directional head module contact members 242 when the head module 210 is mounted on the base frame 212. Consequently, the pair of Z-directional base frame contact members 294 is provided to correspond to the Z-directional head module contact members 242 which are provided on the head module 210 side.

As described above, when the head module 210 is mounted on the base frame 212, the head module 210 is biased upward through action of the Z-direction pressure spring 286 which is provided on the Z-directional hanging rod 278. Accordingly, when the head module 210 is mounted on the base frame 212, the pair of Z-directional head module contact members 242 provided on the head module 210 is brought into direct contact with the pair of Z-directional base frame contact members 294 provided on the base frame 212. Thereby, the position of the head module 210 is set in the Z direction relative to the base frame 212.

In addition, as described above, the Z-directional base frame contact members 294 are formed to have higher hardness than the Z-directional head module contact members 242. Thereby, it is possible to improve positional stability at the time of the positioning, and it is possible to improve accuracy in repetition of replacement of the head module 210.

As a method of achieving high hardness, it is possible to employ a method of using a material with high hardness, a method of achieving high hardness by applying surface treatment, or the like.

The X-directional positioning reference pin 296, which is one constituent member of the X-directional mounting position adjustment unit, is provided on the base frame 212. The X-directional positioning reference pin 296 is formed as a pin (for example, stainless steel pin) having rigidity, and is provided to protrude downward (downward in the Z direction) from the lower surface portions of the lower frame portions 272A and 272B. The X-directional positioning reference pin 296 is positioned to be nailed into the space between the plunger 250 and the eccentric roller 248 provided on the head module 210 side, when the head module 210 is mounted on the base frame 212.

When the head module 210 is mounted on the base frame 212, the X-directional positioning reference pin 296 is nailed into the space between the eccentric roller 248 and the plunger 250, and is sandwiched by both of those. In this state, when the eccentric roller 248 is rotated, the head module 210 is displaced relative to the base frame 212 in the X direction.

Further, the base frame 212 is provided with the magnetic sensor 298 that constitutes the position detection unit together with the magnet 260 provided on the head module 210 side. The magnetic sensor 298 is provided on the lower frame portions 272A and 272B. A magnetic sensor mounting portion 300 is provided at a predetermined position on the lower frame portions 272A and 272B. The magnetic sensor 298 is mounted on the magnetic sensor mounting portion 300. The magnetic sensor 298, which is mounted on the magnetic sensor mounting portion 300, is positioned to face the magnet 260 provided on the head module 210 side, when the head module 210 is mounted on the base frame 212.

When the head modules 210 mounted on the base frame 212 is displaced by the X-directional mounting position adjustment unit in the X direction, an amount of displacement thereof is detected by the magnetic sensor 298. The information about the amount of displacement detected by the magnetic sensor 298 is output to the system controller 100.

The base frame 212 is configured as described above.

It should be noted that, although the material of the base frame 212 is not particularly limited, in order for the head module 210 to be mounted with high accuracy, it is preferable to use a material which is unlikely to be affected by heat. Specifically, it is preferable that the base frame is formed of a material of which a linear expansion coefficient is equal to or less than 10 ppm/° C. lower than a linear expansion coefficient (about 15 ppm/° C.) of iron. Thereby, it is possible to prevent the mounting positions of the head modules 210 for being changed by an effect of heat. As such a material, for example, it is possible to use ceramic, invar, or super invar.

Installation Method of Head Modules

Next, an installation method of the head modules 210 will be described.

As described above, the base frame 212 includes the head module support unit, and the head modules 210 are mounted on the base frame 212 by using the head module support unit.

The head module support unit are alternately mounted on the pair of lower frame portions 272A and 272B. Accordingly, the head modules 210 are alternately mounted on the pair of lower frame portions 272A and 272B. It should be noted that the installation method itself is the same at any location. Thus, a case of mounting the head module 210 on the lower frame portion 272A will be described herein.

The head module 210 is mounted on the base frame 212 through an operation that pushes up the head module from the lower side of the base frame 212.

First, at the lower side position of the base frame 212, the horizontal portion 224 of the bracket 216 of the head module 210 is set in parallel with the upper frame portion 270 of the base frame 212. Further, the vertical portion 226 of the bracket 216 is set in parallel with the lower frame portion 272A of the base frame 212. In this state, the position of the guide groove 256, which is formed on the bracket 216 of the head modules 210, is adjusted to the positions of the Y-directional guide posts 276 provided on the lower frame portion 272A of the base frame 212.

Figure 12:
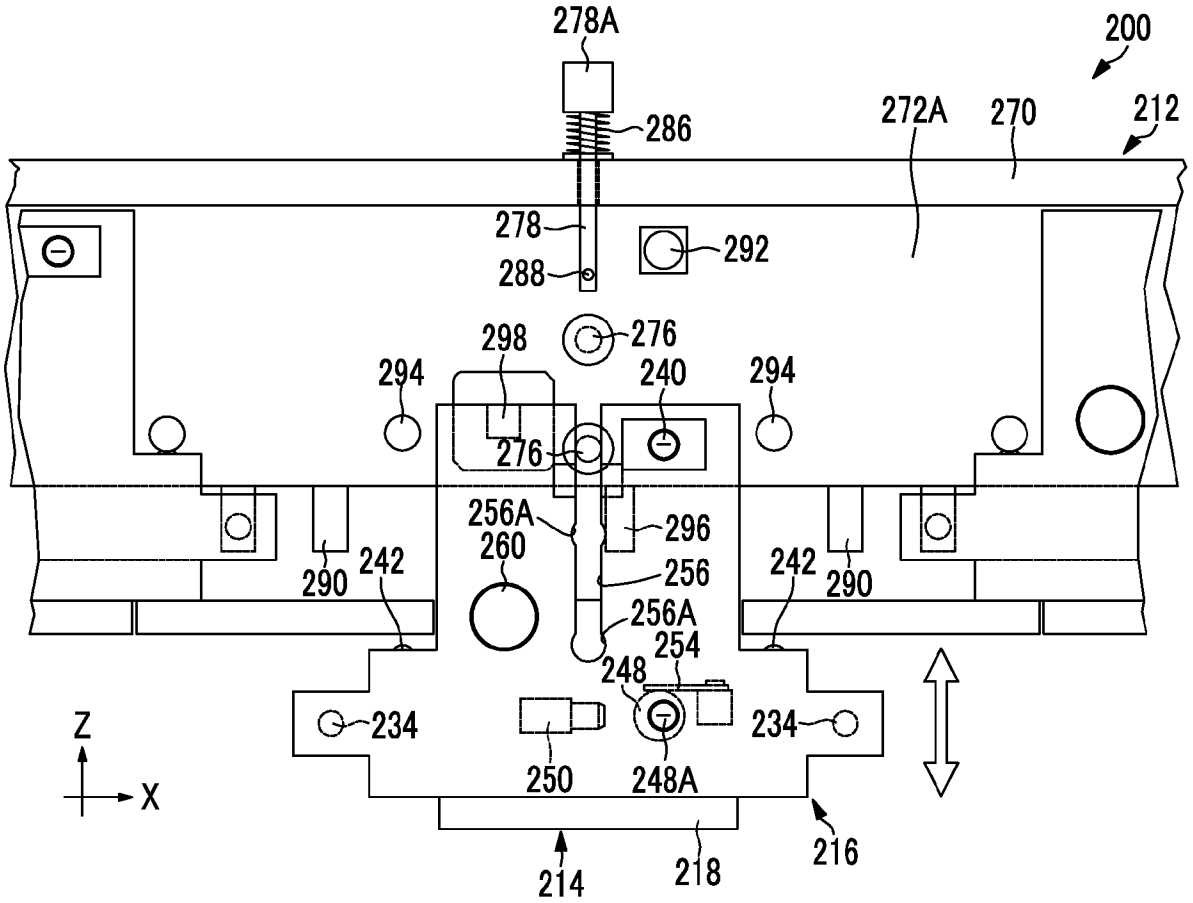
FIG. 12 is an explanatory diagram of a method of mounting head modules.
Figure 13:
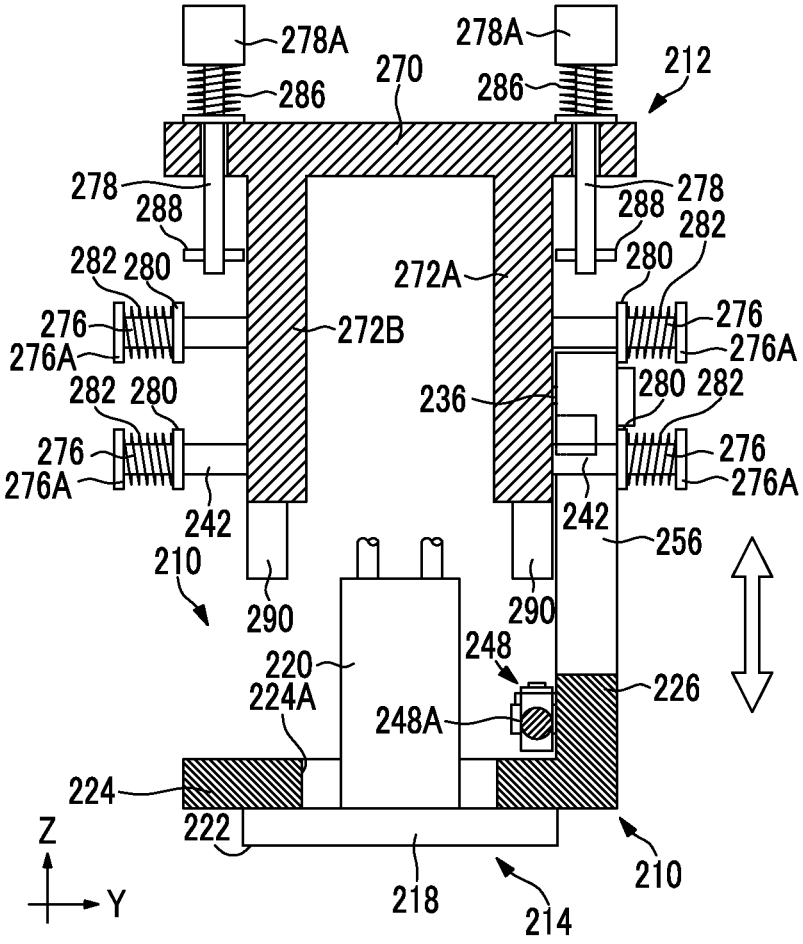
FIG. 13 is an explanatory diagram of the method of mounting the head modules.

Next, as shown in FIGS. 12 and 13, the head module 210 is pushed up toward the base frame 212 such that the Y-directional guide posts 276 are fit into the guide groove 256. When the Y-directional guide posts 276 is fit into the guide groove 256, the head module 210 is pushed up vertically using the Y-directional guide posts 276 as a guide. Thereby, it is possible to prevent rattling or deviation at the installation, and thus it is possible to prevent the head module 210 from coming into contact with another member (such as the head module 210 which has been mounted).

When the Y-directional guide posts 276 are fit into the guide groove 256 and the head module 210 is pushed up, the Z-directional hanging rod 278 provided on the base frame 212 is housed in the guide groove 256.

Here, each Z-directional hanging rod 278 includes the locking bar 288. When the head module 210 is mounted on the base frame 212, the locking bar 288 is set at the unlocked position such that the locking bar 288 does not come into contact with the inner wall surface of the guide groove 256. Thereby, it is possible to prevent movement of the head module 210 from being disturbed due to contact of the locking bar 288 with the inlet portion of the guide groove 256.

When the head module 210 is pushed up toward the base frame 212 in such a manner, the pair of Z-directional head module contact members 242 provided on the bracket 216 of the head module 210 is brought into direct contact with the pair of Z-directional base frame contact members 294 provided on the base frame 212. Then, when the pair of Z-directional head module contact members 242 is brought into direct contact with the pair of Z-directional base frame contact members 294 provided on the base frame 212, the pair of notch portions 258A and 258B formed on the guide groove 256 of the head module 210 is set at the installation position of the locking bar 288 provided on the Z-directional hanging rod 278. In this state, by rotating the Z-directional hanging rod 278, the locking bar 288 is made to be at the locking position. Thereby, the locking bar 288 is fit into the notch portions 258A and 258B, and thus the locking bar 288 is locked on the top surfaces of the inner circumferential portions of the notch portions 258A and 258B. With such a configuration, the head module 210 is mounted on the base frame 212 in a state where the head module 210 is hung on the Z-directional hanging rod 278.

Here, each Z-directional hanging rod 278 includes a Z-direction pressure spring 286. Hence, when being locked by the Z-directional hanging rod 278, the head module 210 is pushed upward due to the action of the Z-direction pressure spring 286. As a result, the pair of Z-directional head module contact members 242 provided on the head module 210 is brought into direct contact with the pair of Z-directional base frame contact members 294 provided on the base frame 212. Thereby, the position of the head module 210 is set in the Z direction relative to the base frame 212.

Further, the pair of Y-directional guide posts 276, which is fit into the guide groove 256, includes the Y-directional pressure springs 282. Each Y-directional pressure spring 282 presses the head module 210 against the base frame 212 through the Y-directional pressure plate 280. As a result, the Y-directional head module fixed-contact members 234 and the Y-directional head module movable-contact member 236 provided on the head module 210 are brought into direct pressure contact with the Y-directional fixed-contact base frame positioning members 290 and the Y-directional movable-contact base frame positioning member 292 provided on the base frame 212. Thereby, the position of the head module 210 is set in the Y direction relative to the base frame 212.

In addition, when the Z-directional head module contact members 242 are brought into direct contact with the Z-directional base frame contact members 294, the Y-directional guide posts 276 are housed in the enlarged diameter portions 256A formed in the guide groove 256. Thereby, the head module 210 is mounted on the base frame 212 in a state where the head module 210 can be displaced in the X direction.

In addition, the positions of the Z-directional head module contact members 242 and the Y-directional head module movable-contact member 236 can be adjusted. However, it is preferable that the position adjustment is performed in advance (for example, the position adjustment is performed at the factory).

With such a configuration, the head module 210 is mounted on the base frame 212. This job is performed on all the head modules 210. As described above, the head modules 210 are alternately mounted on the base frame 212, and thus installation is alternately performed.

In addition, it is preferable that the installation is performed in order from one end of the base frame 212 to the other end thereof. At this time, it is preferable that the first head module 210 (the head module 210 which is mounted first) is mounted in accordance with a mid-value in the adjustment range of the amounts of displacement in the X direction. Thereby, it is possible to reduce the risk that the mounting positions of the following head modules 210 are deviated from the adjustment range. As a result, it is possible to prevent the adjustment range from being set to be unnecessarily large.

The base frame 212, on which the head modules 210 are mounted, is held by a predetermined holder provided in the ink jet recording apparatus 10, and is mounted on the ink jet recording apparatus 10.

Method of Positioning Head Modules

Through the mounting job, the head modules 210 are mounted on the base frame 212. However, this mounting is roughly performed (temporarily performed). Thereafter, the intervals between the head modules adjacent to each other are accurately adjusted, and thus no space occurs between the nozzle arrays through the joints of the head modules 210. That is, the head modules 210 are positioned. Hereinafter, a method of positioning the head modules 210 will be described.

The head modules 210 are positioned by detecting a relative position relationship between the head modules 210 mounted on the base frame 212 and by adjusting the mounting position in the X direction so as to set the intervals between the head modules 210 in an allowable range on the basis of the detection result.

Here, the relative position relationship between the head modules 210 mounted on the base frame 212 is detected by recording an image with a predetermined test pattern on a sheet through the ink jet head 200 in which the head modules 210 are assembled. That is, the ink jet head 200, in which the head modules 210 are assembled, is mounted on the ink jet recording apparatus 10, and records the image with the predetermined test pattern on the sheet of paper P, and the relative position relationship between the head modules 210 is detected from the recorded image.

Figure 14:
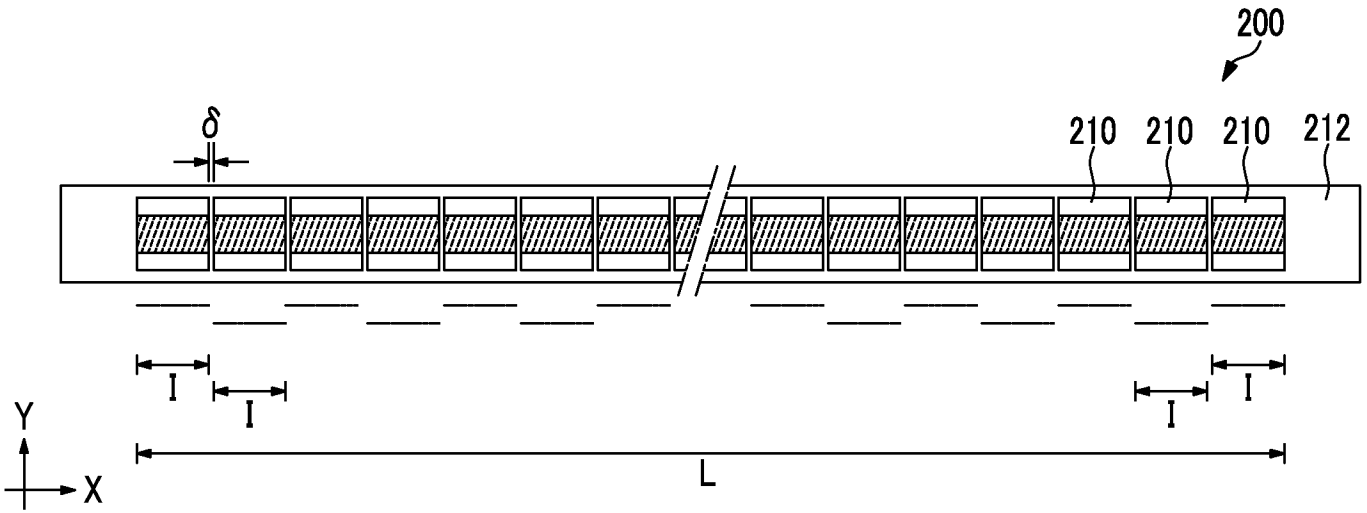
FIG. 14 is an explanatory diagram of a method of positioning head modules.

The image recorded on the sheet of paper P is read by the in-line sensor 58. The system controller 100 acquires the test pattern image data which is read by the in-line sensor 58, processes the acquired image data, and detects the relative position relationship between the head modules 210. For example, as shown in FIG. 14, a distance between dots ejected by the nozzles N as a reference in the head modules 210 is measured on the basis of the image data, and the relative position relationship (distance 8 between the head modules 210 adjacent to each other) between the head modules 210 is detected. The system controller 100 performs this processing by executing a predetermined control program. The system controller 100 executes this control program, thereby functioning as position information acquisition unit and position detection unit that detects relative positions of the head modules 210.

After the relative position relationship between the head modules 210 is detected, the mounting positions of the head modules 210 are finely adjusted using the X-directional mounting position adjustment unit. That is, the positions of the head modules 210 in the X direction are adjusted such that the intervals between the head modules 210 adjacent to each other are set in the preset allowable range.

The position adjustment in the X direction performed by the X-directional mounting position adjustment unit is performed by rotating the eccentric roller 248 provided on each head module 210. The eccentric roller 248 is rotated through a screw driver. That is, since a groove for a screw driver is formed on the base end section of the shaft portion 248A of the eccentric roller 248, the eccentric roller 248 is rotated by rotating the shaft portion 248A through a screw driver in a state where the leading end of the screw driver is inserted into the groove.

By rotating the shaft portion of the eccentric roller 248, the eccentric roller 248 is eccentrically rotated. Then, by eccentrically rotating the eccentric roller 248, the head module 210 moves in the X direction relative to the X-directional positioning reference pin 296 as a reference.

Here, when the head module 210 moves in the X direction, the amount of displacement thereof is detected by the magnetic sensor 298. Information of the detected amount of displacement is output to the system controller 100. The system controller 100 outputs the acquired information of the amount of displacement to the display section 132. An operator rotates the eccentric roller 248 by a desired amount, on the basis of the information of the amount of displacement displayed on the display section 132.

In addition, the amounts of correction for each head module 210 depend on the relative position relationships between the head modules 210. That is, the amounts of correction for the mounting positions of the head modules 210 are calculated such that the intervals between the head modules 210 adjacent to each other are set in the preset allowable range.

The system controller 100 acquires the information (head module position information) of the relative positions of the head modules 210, and calculates the amounts of correction for setting the intervals between the head modules 210 adjacent to each other in the allowable range. The information of the calculated amounts of correction for the mounting positions of the head modules 210 is displayed on the display section 132 as instruction unit. An operator adjusts the mounting position of the head module 210 by moving the head module 210 on the basis of the information of the amounts of correction displayed on the display section 132.

In addition, the system controller 100 executes the predetermined control program, thereby calculating the amounts of correction. By executing the control program, the system controller 100 functions as correction amount calculation unit.

The mounting and the position adjustment (positioning) of the head modules 210 are completed through the series of jobs mentioned above. Here, a case where all the head modules 210 are mounted on the base frame 212 at once will be described. However, even in a case where some head modules 210 are replaced, the mounting and the position adjustment are performed in the same order.

In addition, the head module 210 is unmounted as follows.

The head module 210 is mounted in a state where the head module 210 is locked by the locking bar 288 of the Z-directional hanging rod 278 and is hung on the base frame 212. First, the engagement with the locking bar 288 is released. That is, by rotating the Z-directional hanging rod 278, the locking bar 288 is made to be at the unlocked position. Thereby, the locking bar 288 is shifted from the notch portions 258A and 258B, thereby releasing the engagement between the head module 210 and the locking bar 288. After the engagement between the head module 210 and the locking bar 288 is released, the head module 210 is pulled down.

With such a configuration, the head module 210 is unmounted from the base frame 212. In addition, when head module 210 is pulled down, the pair of Y-directional guide posts 276 functions as a guide. Therefore, the head module 210 can be unmounted without contact with another head module 210.

As described above, according to the ink jet head 200 of the present embodiment, in the ink jet head 200 formed by connecting the plurality of head modules 210, the head modules 210 are individually mounted on the base frame 212, and the mounting positions are individually adjusted. Thereby, it is possible to easily perform the mounting and adjust the positions thereof.

Further, in the ink jet head 200 of the present embodiment, regarding the positioning in the X direction for which high-accuracy positioning is necessary, it is possible to perform high-accuracy position adjustment using the eccentric roller 248, and thus it is possible to connect the head modules with each other with high accuracy. Further, it is possible to sufficiently ensure the adjustment width, and it is possible to minimize the component tolerance. Thereby, it is possible to decrease manufacturing costs.

Furthermore, when the head module 210 is mounted on the base frame 212, the ink jet head 200 of the present embodiment has a structure in which the head modules 210 are alternately mounted on the base frame 212. Thereby, the intervals between the head modules 210 adjacent to each other can be set to be large. Then, by setting large intervals between the head modules 210 adjacent to each other, the interval between the contact points for positioning (the interval between the Z-directional head module contact members 242) can be set to be large (can be set to be larger than the printing area width (the length of the entire nozzle array)). Thereby, the accuracy of the rotation direction of the head modules 210 can be set to be high, and thus the head modules 210 can be mounted with high accuracy in a further stabilized state. For example, when the printing area width 1 of the head module 210 is set to 40 mm, the interval between the contact points for positioning is set to 70 mm.

Method of Positioning Head Modules in Consideration of Another Head

As described above, the head modules 210 are positioned by adjusting the mounting positions of the head modules 210 in the X direction such that the intervals between the head modules 210 adjacent to each other are set in the allowable range.

At this time, by using not only the information of the relative positions of the head modules 210 of the ink jet head 200 as an adjustment target but also the information of the relative positions of the head modules 210 of the other ink jet heads 200, the mounting positions of the head modules 210 of the ink jet heads 200 are adjusted. In such a manner, the entire head unit 56 can be further accurately positioned.

For example, on the basis of the information (head module position information) of the relative positions of the head modules 210 of the ink jet heads 200, the mounting positions of the head modules 210 of ink jet heads 200 are adjusted such that the intervals between the head modules 210 adjacent to each other are set in the allowable range, and the mounting positions of the head modules 210 of ink jet heads 200 are adjusted such that the printing area widths L of the ink jet heads 200 are equal. Thereby, the printing area widths L of the ink jet heads 200 coincide with one another, and thus it is possible to record a high quality image.

The ink jet recording apparatus 10 of the present embodiment includes: the ink jet head 200C that discharges ink droplets of cyan (C); the ink jet head 200M that discharges ink droplets of magenta (M); the ink jet head 200Y that discharges ink droplets of yellow (Y); and the ink jet head 200K that discharges ink droplets of black (K). Therefore, the head modules 210 of the ink jet heads 200C, 200M, 200Y, and 200K are positioned by using the information of the relative positions of the head modules 210 of the respective heads of the cyan ink jet head 200C, the magenta ink jet head 200M, the yellow ink jet head 200Y, and the black ink jet head 200K.

Here, the printing area widths L of the ink jet heads 200 are calculated from, for example, as shown in FIG. 14, the information of the relative positions of the head modules 210. That is, the printing area widths L of the ink jet heads 200 can be calculated from the information of the printing area widths 1 of the head modules 210 (the lengths of the nozzle arrays of the head modules 210) and the information of the intervals δ of the head modules 210 (the printing area widths 1 of the head modules 210 are given).

Further, the positions of the head modules 210 (for example, the positions of the head modules 210 when the head module 210 disposed at one end of the ink jet head 200 is set as a reference) in the head can be calculated from the information of the printing area widths 1 of the head modules 210 and the information of the intervals δ of the head modules 210.

As described above, as for the position adjustment of the head modules 210 of the ink jet heads 200, the mounting positions of the head modules 210 of ink jet heads 200 are adjusted using the information (head module position information) of the relative positions of the head modules 210 of the ink jet heads 200 so as to satisfy the following conditions. The intervals between the head modules 210 adjacent to each other are set in the allowable range, and the printing area widths L of the ink jet heads 200 are equal.

Hereinafter, a specific procedure of the adjustment method will be described.

First, the relative positions of the head modules 210 mounted on the base frame 212 are detected (head module position information acquisition process).

As described above, the relative positions of the head modules 210 mounted on the base frame 212 are detected by recording an image with a predetermined test pattern on a sheet through the ink jet head 200 in which the head modules 210 are assembled. That is, the image with the predetermined test pattern is recorded on the sheet of paper P, the image recorded on the sheet of paper P is read by the in-line sensor 58, data of the read image is processed, and the relative positions of the head modules 210 of the ink jet heads 200 are detected. The system controller 100 performs this processing by executing a predetermined control program. The system controller 100 executes this control program, thereby functioning as position information acquisition unit and position detection unit that detects relative positions of the head modules 210.

In addition, as described later, the system controller 100 also functions as correction amount calculation unit by executing the predetermined control program. Then, the system controller 100 constitutes an adjustment device of the ink jet heads 200 together with the display section 132 as instruction unit.

After the relative positions of the head modules 210 are detected, the mounting positions of the head modules 210 are adjusted using the X-directional mounting position adjustment unit (position adjustment process). At this time, the mounting positions of the head modules 210 of ink jet heads 200 are adjusted using the information (head module position information) of the relative positions of the head modules 210 of the ink jet heads 200 so as to satisfy the following conditions. The intervals between the head modules 210 adjacent to each other are set in the allowable range, and the printing area widths L of the ink jet heads 200 are equal.

The system controller 100 calculates the amounts of correction for the mounting positions of the ink jet heads 200 from the information of the relative positions of the head modules 210 of the ink jet heads 200 (head module position information). The amounts of correction is for setting the intervals between the head modules 210 adjacent to each other in the allowable range and making the printing area widths L of the ink jet heads 200 equal.

Figure 15:
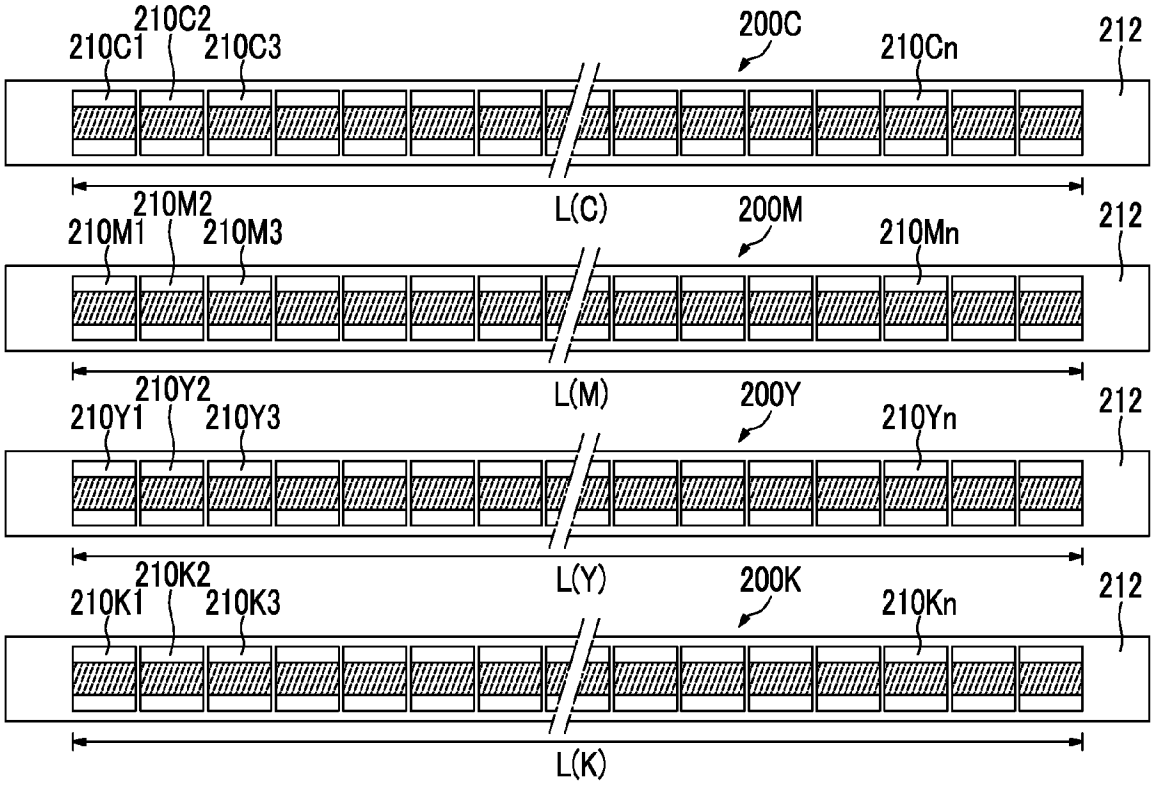
FIG. 15 is an explanatory diagram of the method of positioning the head modules.

In this case, for example, one reference head is determined, and the amounts of correction for the mounting positions of the head modules 210 of the other heads are calculated such that the printing area widths L thereof coincide with the printing area width L of the reference head. For example, as shown in FIG. 15, when the ink jet head 200K of black (K) is set as a reference, the amounts of correction for the mounting positions of the head modules 210 of the other ink jet heads 200C, 200M, and 200Y are calculated such that the printing area width L (K) of the ink jet head 200K of black (K) is equal to the printing area widths L(C), L(M), and (Y) of the ink jet heads 200C, 200M, and 200Y.

Further, the amounts of correction for the mounting positions of the head modules 210 of the ink jet heads 200 may be calculated such that the printing area widths L of the adjacent heads coincide with each other.

The information of the calculated amounts of correction for the mounting positions of the head modules 210 of the ink jet heads 200 is displayed on the display section 132 as instruction unit. An operator adjusts the mounting position of the head module 210 by moving the head module 210 on the basis of the information of the amounts of correction displayed on the display section 132.

In addition, the system controller 100 executes the predetermined control program, thereby calculating the amounts of correction. By executing the control program, the system controller 100 functions as correction amount calculation unit.

As described above, when the head modules 210 of the ink jet heads 200 are positioned, by using not only the information of the relative positions of the head modules 210 of the ink jet head 200 as an adjustment target but also the information of the relative positions of the head modules 210 of the other ink jet heads 200, the mounting positions of the head modules 210 of the ink jet heads 200 are adjusted. In such a manner, the entire head unit 56 can be further accurately positioned.

In the configuration of the above described example, the mounting positions of the head modules 210 of ink jet heads 200 are adjusted such that the intervals between the head modules 210 adjacent to each other are set in the allowable range and the printing area widths L of the ink jet heads 200 are equal. However, the mounting positions of the head modules 210 of ink jet heads 200 may be further adjusted so as to minimize misalignment (so-called misregistration) in registration (relationship of relative recording positions of dots). That is, the mounting positions of the head modules 210 of the ink jet heads 200 are adjusted such that the intervals between the head modules adjacent to each other are set in the allowable range, the printing area widths L of the ink jet heads 200 are equal, and the misregistration between the heads 200 is minimized.

For example, in the example shown in FIG. 15, when the position of the second head module 210C2 of the cyan ink jet head 200C is adjusted, the position adjustment is performed such that the interval between the first head module 210C1 and the third head module 210C3, which are adjacent to the second head module 210C2, is set in the allowable range. In addition, the position adjustment is performed so as to minimize the misregistration between the second head module 210M2 of the magenta ink jet head 200M, the second head module 210Y2 of the yellow ink jet head 200Y, and the second head module 210K2 of the black ink jet head 200K. Further, the mounting positions of the head modules 210 of the ink jet heads 200 are adjusted such that the printing area widths L of the ink jet heads 200C, 200M, 200Y, and 200K are equal. Thereby, it is possible to minimize occurrence of misalignment between colors, and thus it is possible to further record a high quality image.

In the above described example, the case of adjusting the mounting positions of the head modules 210 of the ink jet heads 200 in the ink jet recording apparatus 10 has been described, but the mounting positions of the head modules 210 may be adjusted outside the apparatus.

Monitoring of Mounting Positions of Head Modules

As described above, the head modules 210 are positioned and mounted on the base frame 212. However, when the head modules 210 are being used, the mounting positions are being gradually misaligned. Then, in a state where the mounting positions of the head modules 210 are misaligned, when the ink jet head 200 is continuously used, quality of the image recorded on the sheet of paper P is lowered. Consequently, it is preferable to correct the mounting positions of the head modules 210 before the misalignment exceeds an allowable range.

Meanwhile, in order to determine whether or not the mounting positions of the head modules 210 are misaligned, it is necessary to monitor the mounting positions of the head modules 210. Hereinafter, a method of monitoring the mounting positions of the head modules 210 will be described.

First Example

In the ink jet head 200 of the present embodiment, as unit (position detection unit) that detects the mounting positions of the head modules 210, there are provided the magnetic sensor 298 and the magnet 260. The magnetic sensor 298 detects the amounts of displacement of the head modules 210, thereby detecting the mounting positions thereof. Consequently, the misalignment in the mounting positions of the head modules 210 is monitored using the position detection unit formed of the magnetic sensor 298 and the magnet 260. This process is performed by the system controller 100 in accordance with the predetermined control program.

When the adjustment (positioning) of the mounting positions of the head modules 210 is completed, the system controller 100 acquires the information of the amounts of displacement of the head modules 210 from the magnetic sensor 298. Then, the acquired information of the amounts of displacement is recorded as initial position information into the nonvolatile memory (storage unit) 134.

Thereafter, the system controller 100 acquires the information of the amounts of displacement of the head modules 210 from the magnetic sensor 298 at detection timing which is set in advance. Then, the acquired information of the amounts of displacement is recorded into the nonvolatile memory 134. Simultaneously, the system controller (determination unit) 100 calculates the amounts of displacement from initial positions (positions at the adjustment of the mounting positions) as amounts of misalignment. Subsequently, the calculated amounts of misalignment are compared with a threshold value. The threshold value is set as an allowable range of the amounts of misalignment in the mounting positions of the head modules 210. When determining that an amount of misalignment is equal to or greater than the threshold value, the system controller 100 determines that unallowable positional misalignment occurs in the head module 210.

When determining that the unallowable positional misalignment occurs in the head module 210, the system controller 100 performs a predetermined warning operation. For example, a message for recommending the position adjustment of the head module 210 is displayed on the display section 132 as warning unit. Alternatively, when there is provided alarm unit, an alarm is given, or when there is provided a warning lamp, the warning lamp is turned on. An operator adjusts the head module 210 in response to the warning.

As described above, the mounting positions of the head modules 210 are monitored, and the mounting positions of the head modules 210 are corrected before the misalignment exceeds an allowable range. Thereby, it is possible to constantly keep the ink jet head 200 in the best condition. Thereby, it is possible to record a high quality image at any time.

In the configuration of the above described example, when the adjustment (positioning) of the mounting positions of the head modules 210 is completed, the initial positions are set. Examples of the timing of adjusting the mounting positions of the head modules 210 include: the time of manufacture of the ink jet head 200; the time of replacement of the head modules 210; the time of activation of the ink jet recording apparatus 10; the time of maintenance of the ink jet head 200; the time after the transport of the ink jet head 200 (for example, after delivery such as shipping from the factory); the time before installation into the ink jet recording apparatus 10; and the like. Further, the position adjustment may be performed whenever recording is performed on a predetermined number of sheets, or may be performed for every predetermined recording time period (operation time period). Furthermore, the position adjustment may be performed for every printing job.

Further, it is preferable that the timing (detection timing) of detecting the positions (amounts of displacement) is set around the time of a situation where the positional misalignment of the head modules 210 tends to occur. Examples of the timing include: the time of completion of the printing job performed on the set number of sheets; the time of activation of the ink jet recording apparatus 10; the time of maintenance periodically performed on the ink jet head 200 (the time of cleaning of the nozzle surfaces of the ink jet head 200); the time of transport of the ink jet head 200; the time of movement of the ink jet head 200 (for example, the time of movement of the ink jet head 200 to the maintenance section for maintenance); the time of change in the temperature; and the like. As described above, by performing monitoring only around the time of a situation where the change in the positions of the head modules tends to occur, it is possible to reduce the number of operations of the sensor, and it is possible to increase the life of the sensor.

In the configuration of the above described example, when it is detected that unallowable positional misalignment occurs in the head module 210, the predetermined warning operation is performed. However, the process, which is performed when it is determined that the unallowable positional misalignment occurs in the head module 210, is not limited to this. Otherwise, the following operations may be performed: stopping of the image recording operation; imprinting of the mark indicating that the positional misalignment occurs on the sheet of paper P; enhancement of quality checking for a portion printed by the head module 210 in which the positional misalignment occurs; and the like.

Further, as described above, when the unallowable positional misalignment occurs in the head module 210, unevenness (so-called connection unevenness) in the ink ejection such as streaks or unevenness in the seams occurs. Therefore, in order to correct the unevenness, ink discharge control (connection unevenness correction) may be performed. That is, the system controller (discharge control unit) 100 generates dot data from the image data. At the time of generation of this dot data, the system controller 100 creates dot data for correcting connection unevenness. Thereby, even when positional misalignment occurs in the head module, it is possible to record a high quality image.

Furthermore, as described later, when each head module 210 includes driving unit for driving the X-directional mounting position adjustment unit (mounting position adjustment unit), positional misalignment may be automatically corrected. Thereby, it is possible to constantly prevent positional misalignment from occurring (to keep positional misalignment in the allowable range).

Second Example

The head modules 210 and the base frame 212 may be deformed through expansion or contraction caused by heat. Accordingly, if the temperature of the environment in the case where the head modules 210 are positioned is different from the temperature of actual use environment, misalignment occurs in the mounting positions of the head modules 210. The amount of misalignment caused by the temperature change depends on a material to be used, and thus the amount of misalignment can be calculated in advance. Accordingly, if ambient temperatures of the head modules 210 are detected, it is possible to detect (estimate) the amounts of misalignment in the mounting positions. Hereinafter, a method of monitoring the mounting positions of the head modules 210 on the basis of the ambient temperatures of the head modules 210 will be described.

Figure 16:
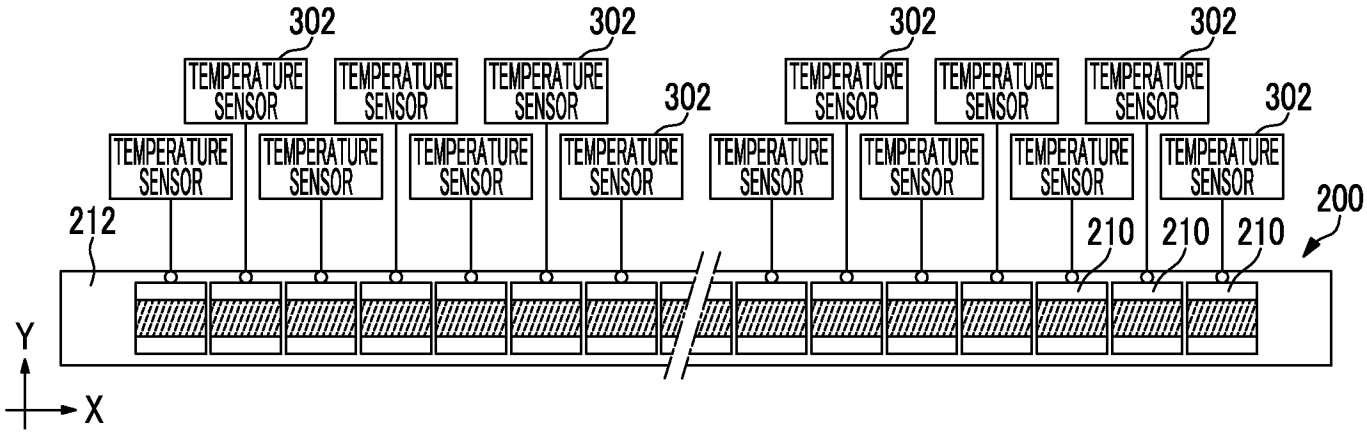
FIG. 16 is a schematic configuration diagram of an ink jet head for monitoring the mounting positions of the head modules.

In this method, information of the ambient temperatures of the head modules 210 is necessary. Hence, as shown in FIG. 16, the base frame 212 includes temperature sensors 302 as temperature detection unit provided to correspond to the mounting positions of the respective head modules 210. For example, each temperature sensor is provided in the vicinity of the magnetic sensor 298.

When the adjustment (positioning) of the mounting positions of the head modules 210 is completed, the system controller 100 acquires the information of the ambient temperatures of the head modules 210 from the temperature sensors 302. Then, the acquired information of the ambient temperatures is recorded as temperature information at the time of positioning into the nonvolatile memory (storage unit) 134.

Thereafter, the system controller 100 acquires the information of the ambient temperatures of the head modules 210 from the temperature sensors 302 at detection timing which is set in advance. Then, the acquired information of the ambient temperatures of the head modules 210 is recorded into the nonvolatile memory 134. Simultaneously, the system controller 100 calculates temperature differences between the ambient temperatures and the temperatures at the time of positioning. Subsequently, the calculated temperature difference is compared with a threshold value. The threshold value is set as the temperature difference at which unallowable positional misalignment occurs. The threshold value is set as an allowable range of the amounts of misalignment in the mounting positions of the head modules 210. When determining that the temperature difference is equal to or greater than the threshold value, the system controller 100 determines that unallowable positional misalignment occurs in the head module 210.

When determining that the unallowable positional misalignment occurs in the head module 210, the system controller 100 performs a predetermined warning operation. An operator adjusts the head module 210 in response to the warning.

In the configuration of the above described example, when the adjustment (positioning) of the mounting positions of the head modules 210 is completed, the temperature at the time of position adjustment is detected. In a manner similar to that of the case of detecting the initial positions, examples of the timing of adjusting the mounting positions of the head modules 210 include: the time of manufacture of the ink jet head 200; the time of replacement of the head modules 210; the time of activation of the ink jet recording apparatus 10; the time of maintenance periodically performed on the ink jet head 200 (the time of cleaning of the nozzle surfaces); the time after the transport of the ink jet head 200 (for example, after delivery such as shipping from the factory); the time of installation into the ink jet recording apparatus 10 (the time before or after installation into the ink jet recording apparatus 10); and the like. Further, the position adjustment may be performed whenever recording is performed on a predetermined number of sheets, or may be performed for every predetermined recording time period (operation time period). In addition, the position adjustment may be performed for every printing job.

Further, in a manner similar to that of the timing of detecting the positions (amounts of displacement), it is also preferable that the timing of detecting the ambient temperatures is set around the time of a situation where the positional misalignment of the head modules 210 tends to occur. Examples of the timing include: the time of completion of the printing job performed on the set number of sheets; the time of activation of the ink jet recording apparatus 10; the time of maintenance periodically performed on the ink jet head 200; the time of transport of the ink jet head 200; the time of movement of head modules 210; the time of change in the temperature; and the like. As described above, by performing monitoring only around the time of a situation where the change in the positions of the head modules tends to occur, it is possible to reduce the number of operations of the sensor, and it is possible to increase the life of the sensor.

Further, in the process which is performed when it is determined that the unallowable positional misalignment occurs in the head module 210, not only the warning operation but also the following operations may be performed: correction of connection unevenness; stopping of the image recording operation; imprinting of the mark indicating that the positional misalignment occurs on the sheet of paper P; enhancement of quality checking for a portion printed by the head module 210 in which the positional misalignment occurs; and the like.

Furthermore, as described later, when each head module 210 includes driving unit that drives the X-directional mounting position adjustment unit (mounting position adjustment unit), positional misalignment may be automatically corrected. Thereby, it is possible to constantly prevent positional misalignment from occurring (to keep positional misalignment in the allowable range).

Other Examples

In the configuration of the above described example, the detection of the amounts of displacement and the detection of the ambient temperatures are separately performed. However, the amounts of displacement and the ambient temperatures may be detected at the same time, and may be respectively recorded into the memory. In this case, on the basis of the information of the ambient temperatures, it is possible to correct amounts of displacement. Thereby, it is possible to further accurately detect the amounts of misalignment.

Further, in the configuration of the ink jet head 200 of the present example, the position adjustment in the X direction is manually performed. However, in a case of a head (to be described later) including the driving unit that moves the head modules 210 in the X direction, the position adjustment may be automatically performed.

Furthermore, in the configuration of the above described example, the information of the amounts of displacement is recorded into the nonvolatile memory 134 provided in the ink jet recording apparatus 10. However, the head itself may have a memory, and the displacement information may be recorded into the memory which is provided in the head. In this case, the base frame 212 may have a memory, and each head module 210 may have a memory.

Further, the information of the amounts of displacement recorded into the memory may be rewritten (updated) whenever the amount of displacement is detected, and may remain as the history.

Sensitivity Correction of Magnetic Sensors

In the ink jet head 200 of the present embodiment, the position detection unit that detects the position of the head module 210 is formed of the magnet 260 and the magnetic sensor 298.

The magnets 260 are provided in the head modules 210, and the magnetic sensors 298 are provided in the base frame 212. When the head module 210 is mounted on the base frame 212, the magnet 260 and the magnetic sensor 298 are disposed to face each other, whereby it is possible to detect the amount of displacement of the head module 210.

Meanwhile, in the ink jet head 200 of the present embodiment, the plurality of head modules 210 is arranged and mounted on the base frame 212 so as to be connected in line. At this time, the order of arrangement of the head modules 210 can be arbitrarily determined. That is, since each head module 210 has the same structure, it is possible to mount the head module at any position, and it is possible to arbitrarily replace the head module. Hence, there are various combinations between the magnetic sensor 298 and the magnet 260.

However, when the head module 210 has moved (moved in the X direction), a value which is output from the magnetic sensor 298, that is, a sensitivity (gain) of the magnetic sensor 298 changes in accordance with the combination between the magnetic sensor 298 and the magnet 260. Examples of the factors of the change in the sensitivity of the magnetic sensor 298 include: an individual difference of the output of the magnetic sensor 298; an individual difference of magnetic force of the magnet 260; misalignment (for example, misalignment in the Y or Z direction) in the mounting positions of the magnetic sensor 298 and the magnet 260; and the like. Consequently, even when the magnetic sensor 298 and the magnet 260 arbitrarily combined are used, it is possible to use a sensitivity kept constant by correcting the sensitivity of the magnetic sensor 298 if the information of the combination can be acquired.

Hereinafter, a method of correcting the sensitivities of the magnetic sensors 298 will be described.

Figure 17:
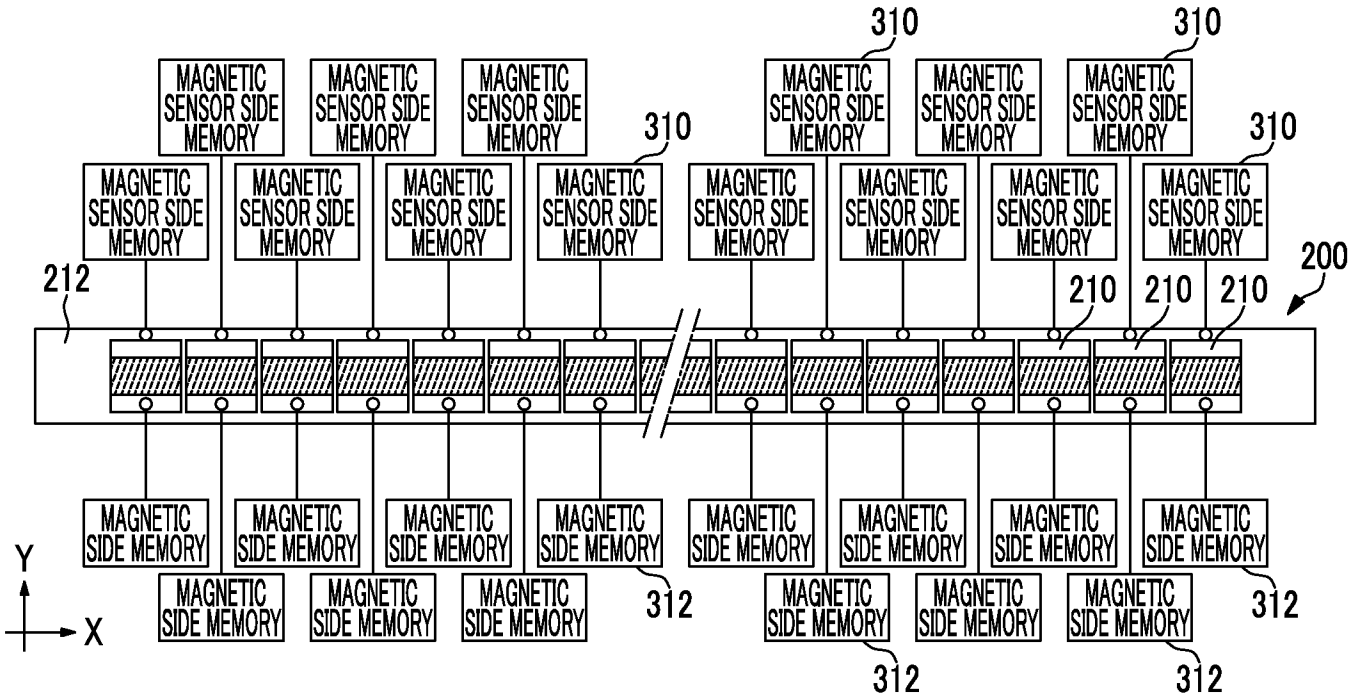
FIG. 17 is a schematic configuration diagram of an ink jet head for correcting a sensitivity of a magnetic sensor.

As shown in FIG. 17, in the base frame 212 on which the magnetic sensors 298 are mounted, a magnetic sensor side memory (sensor side storage unit) 310 is provided for each magnetic sensor 298. Information (sensor side correction information) necessary for correcting the sensitivity of the magnetic sensor 298, for which the magnetic sensor side memory 310 is provided, is recorded into the magnetic sensor side memory 310.

Meanwhile, each head module 210, on which the magnet 260 is mounted, includes a magnet side memory (detection target side storage unit) 312. Correction information (detection target side correction information)) of the sensitivity of the magnetic sensor 298, which is necessary when the magnet 260 mounted on the head module 210 is used, is recorded into the magnet side memory 312.

When the head module 210 is mounted on the base frame 212, the system controller 100 as sensitivity correction unit reads the sensor side correction information from the magnetic sensor side memory 310. Further, the magnet side correction information is read from the magnet side memory 312 of the magnet 260 corresponding to the magnetic sensor 298 for which the magnetic sensor side memory 310 is provided. Then, the sensitivity of the magnetic sensor 298 is corrected, on the basis of the read sensor side correction information and magnet side correction information.

Thereby, even when the magnetic sensor 298 and the magnet 260 arbitrarily combined are used, it is possible to use the sensitivity of the magnetic sensor 298 kept constant.

Here, as the sensor side correction information, individual information (individual data of the detection sensitivity (gain)) of the output of the magnetic sensor 298, information of the mounting position of the magnetic sensor 298, and the like are recorded. In contrast, as the magnet side correction information, information of a magnetic force as individual information of the magnet 260, information of the mounting position of the magnet 260, and the like are recorded.

For example, the information of the mounting position of the magnetic sensor 298 may be recorded as the sensor side correction information, and the information of the mounting position of the magnet 260 may be recorded as the magnet side correction information. In this case, it is possible to calculate misalignment (an amount of misalignment and a misalignment direction) between the mounting positions of the magnetic sensor 298 and the magnet 260. Then, when the misalignment between the mounting positions of the magnetic sensor 298 and the magnet 260 is known, the amount of correction in the sensitivity of the magnetic sensor 298 can be obtained. Therefore, the system controller 100 corrects the sensitivity of the magnetic sensor 298, on the basis of the misalignment between the mounting positions of the magnetic sensor 298 and the magnet 260.

Likewise, when the information of the individual information of the output of the magnetic sensor 298 is known, the output difference caused by the individual difference can be corrected. Therefore, when the individual information (individual data of the detection sensitivity (gain)) of the magnetic sensor 298 is recorded as the sensor side correction information, the information is read, and the sensitivity of the magnetic sensor 298 is corrected.

Further, when the magnetic force of the magnet 260 is known, the sensitivity of the magnetic sensor 298 can be corrected in accordance with the magnetic force of the magnet 260. Therefore, when the information of the magnetic force of the magnet 260 is recorded as the magnet side correction information, the information is read, and the sensitivity of the magnetic sensor 298 is corrected.

In such a manner, each of the magnetic sensors 298 and the magnets 260 individually retains the information which is necessary for correcting the sensitivity of the magnetic sensor 298. Thereby, even when the magnetic sensor 298 and the magnet 260 arbitrarily combined are used, it is possible to use the sensitivity kept constant by correcting the sensitivity of the magnetic sensor 298.

In addition, the information recorded into the magnetic sensor side memory 310 and the magnet side memory 312 has only to be information which is available for correcting the sensitivity of the magnetic sensor 298. Thus, the type of the information and the like are not particularly limited. Otherwise, for example, the information of the ambient temperature of each magnetic sensor 298 can be recorded as the sensor side correction information in each magnetic sensor side memory 310. In other words, the sensitivity or the mounting position of the magnetic sensor may change depending on the temperature. Thus, by recording the information of the ambient temperatures as the sensor side correction information in the magnetic sensor side memory 310, it is possible to correct the change in the sensitivity of the magnetic sensor 298 based on the temperature. Likewise, the magnetic force or the mounting position of the magnet 260 may also change depending on the temperature. Thus, by recording the information of the ambient temperatures as the magnet side correction information into the magnet side memory 312, it is possible to correct the change in the sensitivity of the magnetic sensor 298 based on the temperature. Thereby, it is possible to perform further high accuracy measurement.

In addition, when the information of the ambient temperature of the magnetic sensor 298 is stored in the magnetic sensor side memory 310, a temperature sensor is separately provided in the vicinity of the magnetic sensor 298. The information of the ambient temperature may be recorded at regular intervals on a periodic basis. Alternatively, the information may be detected and recorded at a preset timing of detection (for example, the time when the printing job for the set number of sheets is completed, the time of activation of the ink jet recording apparatus 10, the time of maintenance periodically performed on the ink jet head 200, the time of transport of the ink jet head 200, the time of movement of the ink jet head 200, and the like).

Likewise, when the information of the ambient temperature of the magnet 260 is stored in the magnet side memory 312, a temperature sensor is separately provided in the vicinity of the magnet 260. The information of the ambient temperature may be recorded at regular intervals on a periodic basis, or may be detected and recorded at the preset timing of detection.

In addition, after the head module 210 is mounted on the base frame 212, the magnet 260 and the magnetic sensor 298 are disposed to be close to each other. Therefore, the temperature sensor may be commonly used. For example, as shown in FIG. 16, when the temperature sensor 302 for detecting the ambient temperature of the head modules 210 is provided, the information of the temperature sensor 302 may be acquired, and stored in the magnetic sensor side memory 310 and the magnet side memory 312.

Further, if there is no bias in the temperature distribution on one ink jet head 200, the information of the ambient temperatures of all the magnetic sensors 298 and the magnets 260 may be measured through a single temperature sensor. Alternatively, an area to be measured is divided into a plurality of parts, and a temperature may be measured for each area part.

In the configuration of the above described example, the magnetic sensor side memory 310 is provided for each magnetic sensor 298. However, for the magnetic sensors 298, a single magnetic sensor side memory 310 may be provided, and the sensor side correction information of each magnetic sensor 298 may be recorded to be identifiable in the magnetic sensor side memory 310.

Further, one administration table may be provided, and the sensor side correction information of the magnetic sensors 298 and the magnet side correction information of the magnets 260 may be recorded in the administration table. In this case, unique identification information (for example, a bar-code or a two-dimensional bar-code) is given to each of the magnetic sensors 298 and the magnets 260, the identification information is read, the corresponding sensor side correction information and the corresponding magnet side correction information are read from the administration table, and the information is used.

Further, the sensor side correction information and the magnet side correction information may be recorded into and read from the bar-code or the two-dimensional bar-code.

In the above described example, the system controller 100 performs the process of correcting the sensitivity of the magnetic sensor 298 (the system controller 100 functions as the sensitivity correction unit by executing the predetermined control program). For example, a micro computer as the sensitivity correction unit may be provided in the ink jet head 200, and the micro computer may perform the process of correcting the sensitivity of the magnetic sensor 298.

Other Example of Position Detection Unit

In the embodiment, the position detection unit that detects the position of the head module 210 is formed of the magnetic sensor 298 and the magnet 260. The configuration of the position detection unit is not limited to this. Otherwise, the position detection unit may be formed of a laser distance sensor or an infrared distance sensor, an eddy-current sensor, and the like.

Laser Distance Sensor

In a case of using the laser distance sensors, for example, the laser distance sensors are provided on the base frame 212 side, and detection target sections (laser irradiation sections) of the laser distance sensors are provided on the head module 210 side.

Also in the case of using the laser distance sensors, in a manner similar to that of the magnetic sensors, it is preferable to correct the sensitivities of the sensors. That is, in a manner similar to that of the magnetic sensors, there are individual differences between the outputs of the laser distance sensors. Therefore, a memory (sensor side storage unit) is provided for each sensor, and the information (sensor side correction information) for correcting the sensitivity is stored in the memory. For example, the individual information (individual data of detection sensitivity (gain)) of each laser distance sensor, the information of the mounting position, and the like are stored as the sensor side correction information. Likewise, on the detection target section side, the sensitivity of the sensor changes depending on the reflectance, the ambient illuminance, the ambient temperature, and the like. Therefore, a memory (detection target side storage unit) is provided for the detection target section side, and the memory stores correction information (detection target side correction information) for the sensitivity of the laser distance sensor which is necessary when detection is performed using the detection target section. For example, the memory stores the information of the reflectance, the ambient illuminance, the ambient temperature, and the mounting position of the detection target section, and the like, as the detection target side correction information. Thereby, even when the laser distance sensor and the detection target section of a certain combination are used, it is possible to use the sensitivity kept constant through the correction.

Infrared Distance Sensor

In a case of using the infrared distance sensors, for example, the infrared distance sensors are provided on the base frame 212 side, and detection target sections (infrared irradiation sections) of the infrared distance sensors are provided on the head module 210 side.

Also in the case of using the infrared distance sensors, in a manner similar to that of the magnetic sensors, it is preferable to correct the sensitivities of the sensors. That is, in a manner similar to that of the magnetic sensors, there are individual differences between the outputs of the infrared distance sensors. Therefore, a memory (sensor side storage unit) is provided for each sensor, and the information (sensor side correction information) for correcting the sensitivity is stored in the memory. For example, the individual information (individual data of detection sensitivity (gain)) of each infrared distance sensor, the information of the mounting position, and the like are stored as the sensor side correction information. Likewise, on the detection target section side, the sensitivity of the sensor changes depending on the reflectance, the ambient temperature, the temperature of the detection target, the color of the detection target, the ambient illuminance, and the like. Therefore, a memory (detection target side storage unit) is provided for the detection target section side, and the memory stores correction information (detection target side correction information) for the sensitivity of the infrared distance sensor which is necessary when detection is performed using the detection target section. For example, the memory stores the information of the surface roughness, the reflectance, and the ambient temperature of the detection target section, the information of the temperature, the color, and the ambient illuminance of the detection target, and the like, as the detection target side correction information. Thereby, even when the infrared distance sensor and the detection target section of a certain combination are used, it is possible to use the sensitivity kept constant through the correction.

Eddy-Current Sensor

In a case of using the eddy-current sensor, for example, the eddy-current sensors are provided on the base frame 212 side, and detection target sections of the eddy-current sensors are provided on the head module 210 side.

Also in the case of using the eddy-current sensors, in a manner similar to that of the magnetic sensors, it is preferable to correct the sensitivities of the sensors. That is, in a manner similar to that of the magnetic sensors, there are individual differences between the outputs of the eddy-current sensors. Therefore, a memory (sensor side storage unit) is provided for each sensor, and the information (sensor side correction information) for correcting the sensitivity is stored in the memory. For example, the individual information (individual data of detection sensitivity (gain)) of each eddy-current sensor, the information of the mounting position, and the like are stored as the sensor side correction information. Likewise, on the detection target section side, the sensitivity of the sensor changes depending on the conductivity, the magnetic permeability, the temperature of the detection target, and the like. Therefore, a memory (detection target side storage unit) is provided for the detection target section side, and the memory stores correction information (detection target side correction information) for the sensitivity of the eddy-current sensor which is necessary when detection is performed using the detection target section. For example, the memory stores the information of the conductivity and the magnetic permeability of the detection target section, the temperature and the mounting position of the detection target, and the like, as the detection target side correction information. Thereby, even when the eddy-current sensor and the detection target section of a certain combination are used, it is possible to use the sensitivity kept constant through the correction.

Others

Otherwise, displacement detection unit that detects the amount of displacement of the head module 210 has high resolution, and thereby it is possible to appropriately use a small measurement instrument.

Another Example of X-Directional Mounting Position Adjustment Unit

The X-directional mounting position adjustment unit (mounting position adjustment unit) of the embodiment is configured to manually rotate the eccentric roller 248. However, as shown in FIG. 18, driving unit may be mounted on the head module 210, and may be configured to automatically rotate the roller.

Figure 18:
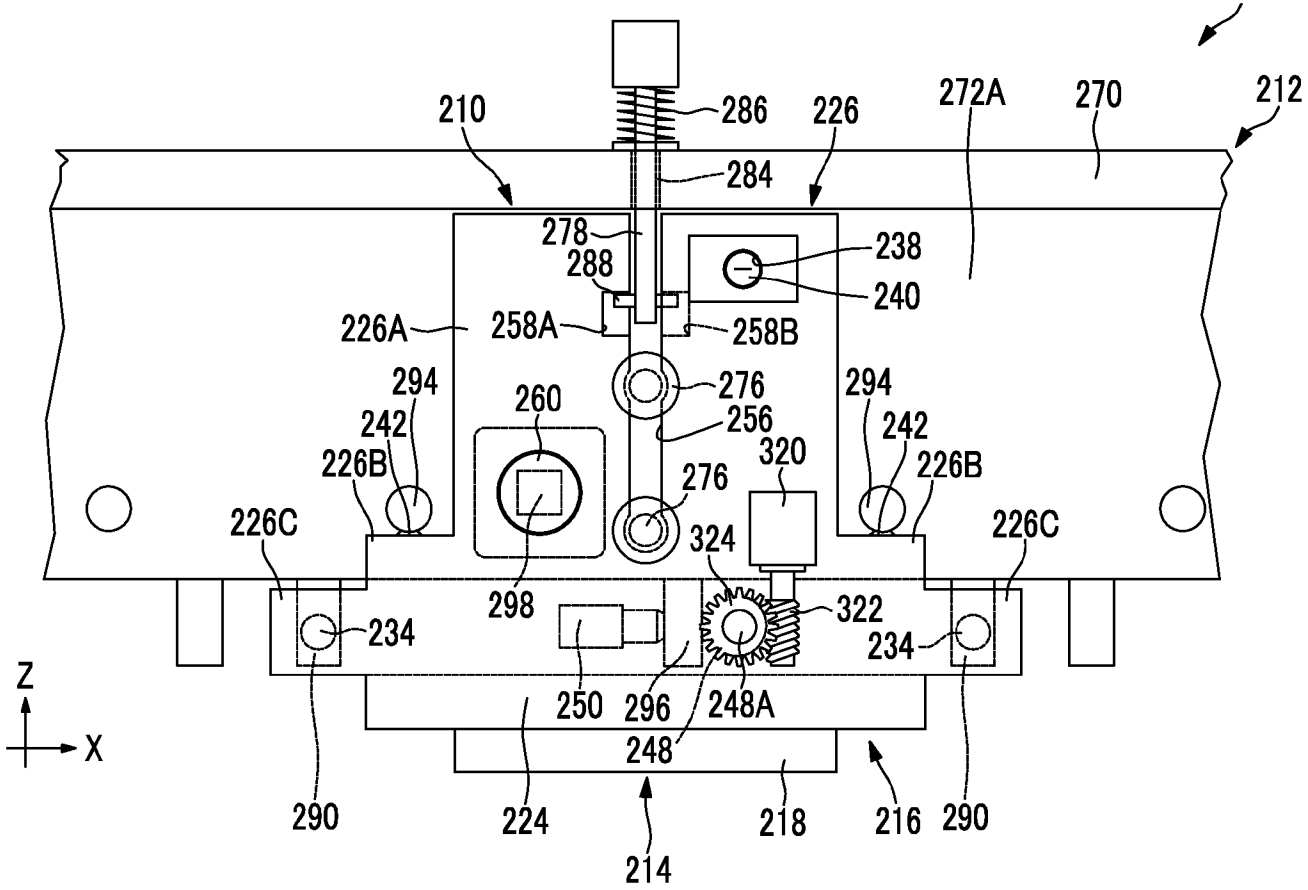
FIG. 18 is a front view illustrating another example of the front view of the head module.

In the example shown in FIG. 18, a motor 320 as the driving unit of the eccentric roller 248 is mounted on the head module 210. A spiral wheel (worm) 322 is connected to the driving shaft of the motor 320. A toothed wheel (worm wheel) 324 is connected to a shaft portion 248A of the eccentric roller 248. The spiral wheel 322 is engaged with the toothed wheel 324. When the spiral wheel 322 is rotated by driving the motor 320, the toothed wheel 324 is rotated. As a result, the eccentric roller 248 is rotated. In this case, the shaft portion 248A of the eccentric roller 248 is not a male screw, and is formed in a columnar shape. In addition, an eccentric roller mounting hole 252 is not a screw hole, and is formed as a through-hole.

As described above, the eccentric roller 248 may be configured to be automatically rotated. In this case, the process of positioning the head modules 210 can be automatically performed. Further, even when unallowable positional misalignment occurs in the head module 210, it is possible to automatically perform the correction process.

In the embodiment, the eccentric roller 248, the plunger 250, and the X-directional positioning reference pin 296 constitute the X-directional mounting position adjustment unit. However, the configuration of the X-directional mounting position adjustment unit is not limited to this. Otherwise, for example, the X-directional mounting position adjustment unit may be configured to include a moving mechanism such as a ball screw mechanism.

Another Example of Method of Positioning Head Modules

As described above, after the head modules 210 are mounted on the base frame 212, the position adjustment (positioning) is performed.

An amount of displacement (movement) of a certain head module 210, which is necessary for mounting the head module 210 at a correct position, can be calculated from the relative position relationship between the head modules 210.

Accordingly, an indicator, which indicates the amount of correction necessary for each head module 210, is provided, and the position of the head module 210 is adjusted on the basis of the indication of the indicator. Thereby, it is possible to further easily adjust the positions of the head modules 210.

Figure 19:
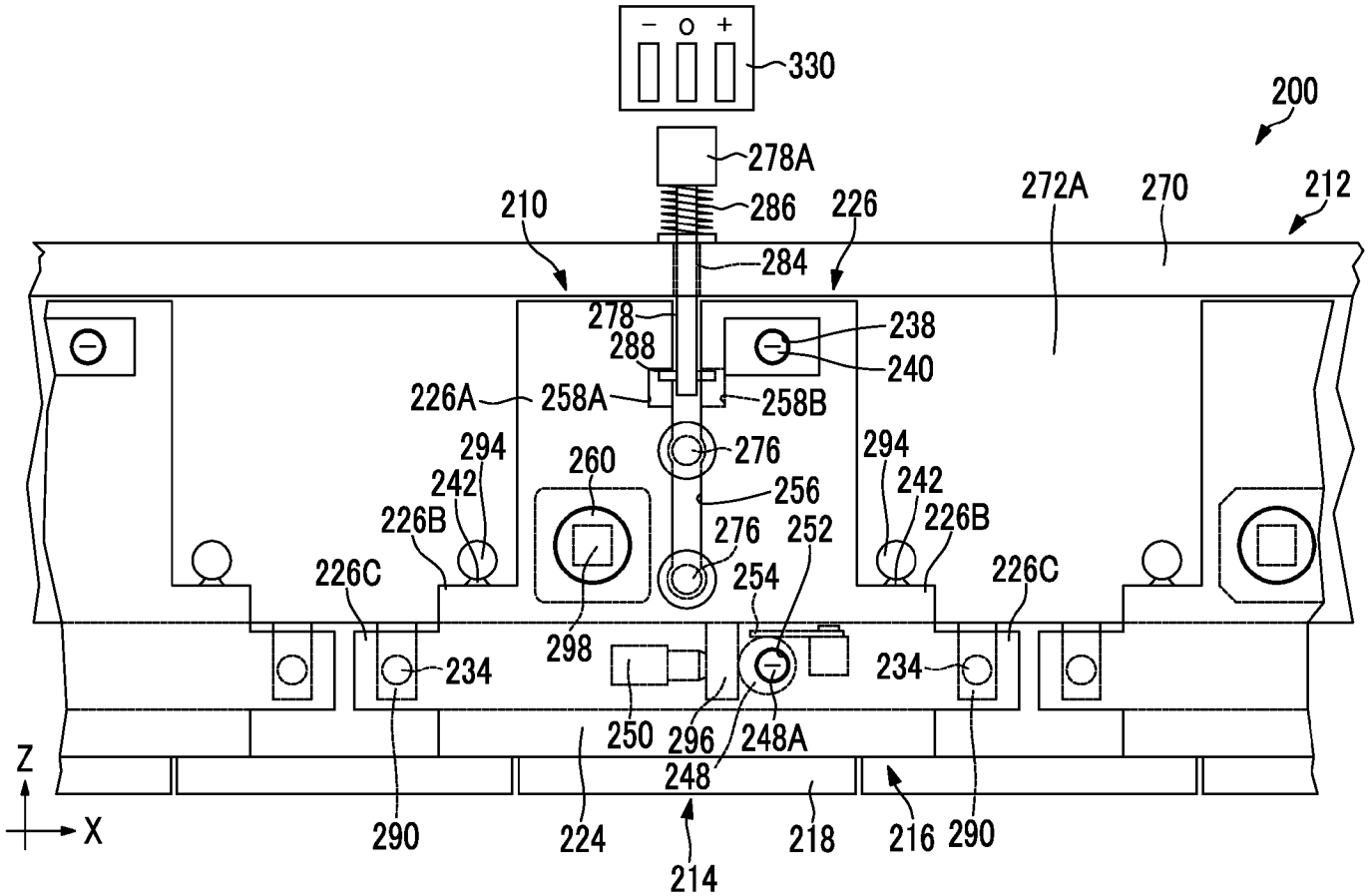
FIG. 19 is a schematic configuration diagram of a principal section of an ink jet recording apparatus having an indicator.

FIG. 19 is a diagram illustrating an example in a case where the position of the head module is adjusted on the basis of the indication of the indicator.

As shown in the drawing, there is provided an indicator (instruction unit) 330 which indicates the amount of correction necessary for the head module 210. The indicator 330 is provided on, for example, a holder (not shown in the drawing) mounted on the ink jet head 200. Further, the indicator 330 is provided for each head module 210.

The indicator 330 shown in the drawing is configured to indicate the signs of minus (−), zero (0), and plus (+) through lamps (light emitting diodes (LEDs)). In this indicator 330, a lamp indicating a direction, in which the correction is necessary, is turned on. For example, if correction in a negative direction is necessary, the lamp indicating the minus (−) sign is turned on. In addition, if correction in a positive direction is necessary, the lamp indicating the plus (+) sign is turned on. If correction is not necessary, the lamp indicating the zero (0) sign is turned on.

For example, when the lamp indicating the minus (−) sign is turned on, an operator displaces the head module 210 in the negative direction. The system controller 100 acquires displacement information of the head module 210 which is output from the magnetic sensor 298, performs correction by a necessary amount of correction, and then turns on the lamp indicating the zero (0) sign. In contrast, if correction is performed by an amount more than the necessary amount, then the lamp indicating the plus (+) sign is turned on. In this case, the operator displaces the head module 210 in the positive direction.

As described above, by adjusting the position of each head module 210 through the indicator 330, it is possible to easily perform the position adjustment.

Other Embodiments

In the embodiment, when the position of the head module 210 is adjusted in the Y direction, the positioning is performed in the following manner: the Y-directional head module fixed-contact members 234 and the Y-directional head module movable-contact member 236 provided on the head module side are brought into direct contact with the Y-directional fixed-contact base frame positioning members 290 and the Y-directional movable-contact base frame positioning member 292 provided on the base frame side. However, in a manner similar to that of the positioning in the X direction, the position may be adjusted by the mounting position adjustment unit using the eccentric roller. It is the same for the Z direction.

In a manner similar to that of the embodiment, the Y-directional head module fixed-contact members 234 and the Y-directional head module movable-contact member 236 provided on the head module side are brought into direct contact with the Y-directional fixed-contact base frame positioning members 290 and the Y-directional movable-contact base frame positioning member 292 provided on the base frame side. In this case, when positioning in the Y direction is performed, it is preferable that the position of the Y-directional head module movable-contact member 236 is adjusted in advance such that the head module 210 is mounted at a correct position in the Y direction. It is the same for the Z direction. Thus, it is preferable that the positions of the Z-directional head module contact members 242 are adjusted in advance. For example, it is preferable that the position adjustment is performed at the factory.

In the embodiment, the eccentric roller 248 and the plunger 250 are provided on the head module 210 side, and the X-directional positioning reference pin 296 is provided on the base frame 212 side. However, the eccentric roller 248 and the plunger 250 may be provided on the base frame 212 side, and the X-directional positioning reference pin 296 may be provided on the head module 210 side.

In the embodiment, the magnetic sensor 298 is provided on the base frame 212 side, and the magnet 260 is provided on the head module 210 side. However, the magnetic sensor 298 may be provided on the head module 210 side, and the magnet 260 may be provided on the base frame 212 side.

In the embodiment, as the eccentric roller 248, a roller, which is configured such that the roller portion 248B and the shaft portion 248A are decentered, is used. However, even when a roller having an elliptical shape is used, it is possible to obtain the same effects and advantages.

In the embodiment, when the relative position relationship between the head modules is detected, the in-line sensor 58 mounted on the ink jet recording apparatus 10 reads the test pattern. The image with the test pattern may be read by the image reading unit (scanner or the like) outside the apparatus, and the relative position relationship between the head modules may be detected.

What is claimed is:

1. A droplet-discharging head that is constituted of a plurality of head modules each having a nozzle surface on which a plurality of nozzles is arranged, the droplet-discharging head comprising:

a base frame that has the head modules mounted thereon;

a head module support unit that individually supports the head modules, the head module support unit provided on the base frame;

a mounting position adjustment unit that individually adjusts mounting positions of the head modules supported by the head module support unit; and a displacement detection unit that individually detects amounts of displacement of the head modules when the mounting positions of the head modules is adjusted by the mounting position adjustment unit, wherein the mounting position adjustment unit has X-directional mounting position adjustment unit that adjusts the mounting positions in an X direction parallel to an arrangement direction of the nozzles, wherein the displacement detection unit detects the amounts of displacement of the head modules in the X direction, wherein the base frame has three Y-directional base frame positioning members that serve as a reference for positioning the based frame in a Y direction orthogonal to the arrangement direction of the nozzles, and two Z-directional base frame positioning members that serve as a reference for positioning the based frame in a Z direction orthogonal to the nozzle surfaces, wherein the head module has three Y-directional head module positioning members that are brought into direct contact with the Y-directional base frame positioning members, and two Z-directional head module positioning members that are brought into direct contact with the Z-directional base frame positioning members, and wherein the head module support unit has Y-directional biasing unit that biases the head modules in the Y direction in engagement with the head modules and bringing the Y-directional head module positioning members into direct pressure contact with the Y-directional base frame positioning members, and Z-directional biasing unit that biases the head modules in the Z direction in engagement with the head modules and bringing the Z-directional head module positioning members into direct pressure contact with the Z-directional base frame positioning members.

2. The droplet-discharging head according to claim 1, wherein the X-directional mounting position adjustment unit has an X-directional positioning reference pin which is provided on one of the base frame and the head module, an eccentric roller which is provided on the other thereof, and an X-directional biasing unit that biases the head modules in the X direction and bringing the eccentric roller into direct pressure contact with the X-directional positioning reference pin, and wherein the X-directional mounting position adjustment unit moves the head modules in the X direction by rotating the eccentric roller brought into direct pressure contact with the X-directional positioning reference pin.

3. The droplet-discharging head according to claim 2, wherein the base frame has three Y-directional base frame positioning members that serve as a reference for positioning the based frame in a Y direction orthogonal to the arrangement direction of the nozzles, and two Z-directional base frame positioning members that serve as a reference for positioning the based frame in a Z direction orthogonal to the nozzle surfaces, wherein the head module has three Y-directional head module positioning members that are brought into direct contact with the Y-directional base frame positioning members, and two Z-directional head module positioning members that are brought into direct contact with the Z-directional base frame positioning members, and wherein the head module support unit has Y-directional biasing unit that biases the head modules in the Y direction in engagement with the head modules and bringing the Y-directional head module positioning members into direct pressure contact with the Y-directional base frame positioning members, and Z-directional biasing unit that biases the head modules in the Z direction in engagement with the head modules and bringing the Z-directional head module positioning members into direct pressure contact with the Z-directional base frame positioning members.

4. The droplet-discharging head according to claim 3, wherein at least either the Y-directional base frame positioning members or the Y-directional head module positioning members are provided to be movable in the Y direction, and are able to adjust the mounting positions of the head modules, which are supported by the head module support unit, in the Y direction.

5. The droplet-discharging head according to claim 1, wherein the number of the Y-directional biasing unit is set to be plural, and wherein biasing forces of the Y-directional biasing unit arranged to be closer to the X-directional mounting position adjustment unit are set to be greater than biasing forces of the Y-directional biasing unit arranged to be further from the X-directional mounting position adjustment unit.

6. The droplet-discharging head according to claim 1, wherein at least either the Y-directional base frame positioning members or the Y-directional head module positioning members are provided to be movable in the Y direction, and are able to adjust the mounting positions of the head modules, which are supported by the head module support unit, in the Y direction.

7. The droplet-discharging head according to claim 1, wherein at least either the Z-directional base frame positioning members or the Z-directional head module positioning members are provided to be movable in the Z direction, and are able to adjust the mounting positions of the head modules, which are supported by the head module support unit, in the Z direction.

8. The droplet-discharging head according to claim 1, wherein the Y-directional base frame positioning members are formed to have a higher hardness than the Y-directional head module positioning members, and wherein the Z-directional base frame positioning members are formed to have a higher hardness than the Z-directional head module positioning members.

9. The droplet-discharging head according to claim 8, wherein the Y-directional base frame positioning members and the Z-directional base frame positioning members are formed of stainless steel.

10. The droplet-discharging head according to claim 1, wherein the Y-directional head module positioning members and the Z-directional head module positioning members are formed in spherical shapes.

11. The droplet-discharging head according to claim 1, wherein the base frame has a first mounting portion and a second mounting portion parallel to each other, and wherein the head module support unit are alternately disposed on the first mounting portion and the second mounting portion.

12. The droplet-discharging head according to claim 11, wherein an installation interval between the two Z-directional base frame positioning members is set to be greater than lengths of columns of the nozzles arranged on the nozzle surface of the head module.

13. The droplet-discharging head according to claim 11, wherein an installation interval between two of the three Y-directional head module positioning members is set to be greater than the lengths of the columns of the nozzles arranged on the nozzle surface of the head module.

14. The droplet-discharging head according to claim 1, wherein the base frame is formed of a material of which a linear expansion coefficient is equal to or less than 10 ppm/° C.

15. The droplet-discharging head according to claim 14, wherein the base frame is formed of ceramic, invar, or super invar.

16. The droplet-discharging head according to claim 1, wherein the displacement detection unit has a magnet that is provided on one of the base frame and the head modules, and a magnetic sensor that is provided on the other thereof.

17. An image-forming device comprising: the droplet-discharging head according to claim 1;

an image reading unit that reads an image drawn by the droplet-discharging head; and a position detection unit that detects relative positions of the plurality of head modules constituting the droplet-discharging head by processing the image which is read by the image reading unit.

18. A method for positioning head modules of the droplet-discharging head according to claim 1, the method for positioning head modules of the droplet-discharging head comprising:

drawing a test pattern on a recording medium by using the droplet-discharging head in which the head modules are mounted on the base frame;

reading the image of the test pattern drawn on the recording medium;

detecting relative positions of the head modules on the basis of the read image;

calculating amounts of correction of mounting positions of the head modules on the basis of the detected relative positions of the head modules; and adjusting the mounting positions of the head modules on the basis of the calculated amounts of correction.

* * * * *